US005960391A

United States Patent [19]

Tateishi et al.

[11] Patent Number: 5,960,391

[45] Date of Patent: Sep. 28, 1999

[54] SIGNAL EXTRACTION SYSTEM, SYSTEM AND METHOD FOR SPEECH RESTORATION, LEARNING METHOD FOR NEURAL NETWORK MODEL, CONSTRUCTING METHOD OF NEURAL NETWORK MODEL, AND SIGNAL PROCESSING SYSTEM

[75] Inventors: Masahiko Tateishi; Shinichi Tamura, both of Nagoya, Japan

[73] Assignee: Denso Corporation, Kariya, Japan

[21] Appl. No.: 08/766,633

[22] Filed: Dec. 13, 1996

[30] Foreign Application Priority Data

| | | | |
|---|---|---|---|
| Dec. 13, 1995 | [JP] | Japan | 7-324565 |
| Mar. 12, 1996 | [JP] | Japan | 8-054942 |
| Aug. 6, 1996 | [JP] | Japan | 8-207134 |

[51] Int. Cl.[6] ..... G10L 3/02; G10L 9/00; G10L 5/02

[52] U.S. Cl. ..... 704/232; 704/202; 704/259

[58] Field of Search ..... 704/232, 259, 704/202

[56] References Cited

U.S. PATENT DOCUMENTS

| | | | |
|---|---|---|---|
| 5,408,424 | 4/1995 | Lo . | |
| 5,425,130 | 6/1995 | Morgan | 704/259 |
| 5,461,697 | 10/1995 | Nishimura et al. . | |
| 5,526,465 | 6/1996 | Carey | 704/250 |

FOREIGN PATENT DOCUMENTS

| | | |
|---|---|---|
| 2-072398 | 3/1990 | Japan . |
| 2-273798 | 11/1990 | Japan . |
| 2-273799 | 11/1990 | Japan . |
| 3-253966 | 11/1991 | Japan . |
| 4-076685 | 3/1992 | Japan . |
| 5-035899 | 2/1993 | Japan . |
| 5-019337 | 3/1993 | Japan . |
| 5-232986 | 9/1993 | Japan . |
| 7-049847 | 2/1995 | Japan . |
| 8-123486 | 5/1996 | Japan . |

OTHER PUBLICATIONS

Kadambe, S., Srinivasan, P., Application of adaptive wavelets for speech coding, IEEE–SP, pp. 632–635, Oct. 1994.

Boll: "Suppression of Acoustic Noise in Speech Using Spectral Substraction", IEEE Transactions on Acoustics, Speech and Signal Processing, vol. Assp–27, No. 2, Apr. 1979, pp. 113–121.

Graps: "An Introduction to Wavelets", IEEE Computational Science and Engineering, Summer, 1995, Vol. 2, No. 2, pp. 1–18.

Rumelhart et al: "Parallel Distributed Processing, Explorations in the Microstructure of Cognition".

Sato: "A Learning Algorithm to Teach Spatiotemporal Patterns, to Recurrent Neutal Networks", Biological Cybernetics, 1990, pp. 1–5.

Sato: :Learning Algorithms for Recurrent Neural Networks, Jan. 4, 1989, pp. 1–6.

Funahashi: "On the Approximation of Dynamical Systems by Continuous Time Recurrent Neural Networks", Jan. 18, 1992, pp. 27–34.

*Primary Examiner*—David D. Knepper
*Assistant Examiner*—Robert Louis Sax
*Attorney, Agent, or Firm*—Pillsbury Madison & Sutro LLP

[57] ABSTRACT

A signal extraction system for extracting one or more signal components from an input signal including a plurality of signal components. This system is equipped with a neural network arithmetic section designed to process information through the use of a recurrent neural network. The neural network arithmetic section extracts one or more signal components, for example, a speech signal component and a noise signal component from an input signal including a plurality of signal components such as a speech and noises and outputs the extracted signal components. Owing to the presence of this neural network arithmetic section, the signal extraction becomes possible with a high accuracy.

8 Claims, 37 Drawing Sheets

(PRIOR METHOD)

SIGNAL EXTRACTION SYSTEM, SYSTEM AND METHOD FOR SPEECH RESTORATION, LEARNING METHOD FOR NEURAL NETWORK MODEL, CONSTRUCTING METHOD OF NEURAL NETWORK MODEL, AND SIGNAL PROCESSING SYSTEM

BACKGROUND OF THE INVENTION

1. Field of the Invention

The present invention relates to a signal extraction system for extracting a necessary signal component from an inputted signal including a plurality of signal components, and further relates to a speech restoration system and speech restoration method for restoring or reproducing a speech from a noise superimposed speech using the signal extraction system. This invention also relates to a learning method for a neural network model, a constructing method of a neural network model, and a signal processing system.

2. Description of the Prior Art

As such a kind of signal extraction system, there has been known a system using a spectral subtraction method (which will be referred hereinafter to as an SS method). For example, a technique based on this SS method has been disclosed by the paper "Suppression of Acoustic Noise in Speech Using Spectral Subtraction" (referred hereinafter to as a document 1) reported in IEEE TRANSACTIONS ON ACOUSTIC, SPEED, AND SIGNAL PROCESSING, VOL. ASSP-27, NO 2, APRIL 1979. This technique is for the purpose of accepting as an input signal a signal in a time domain (taking time on the horizontal axis) developed due to the introduction of noises into a speech and extracting a speech signal from this input signal, and has frequently been employed as a preliminary treatment or preparation for noise countermeasures taken in speech recognition. A brief description will be made hereinbelow of the SS method for this technique.

That is, this SS method involves processes conducted as follows.

(1) First of all, after the observation of a noise signal, the finite length zone or interval of this noise signal undergoes Fourier transform to provide Fourier spectrum N(w) where w represents a frequency. A memory stores and retains the amplitude value |N(w)| of the Fourier spectrum N(w).

(2) Secondly, the finite length interval of a speech signal including noises experiences the Fourier transform to provide a Fourier Spectrum I(w) where w signifies a frequency.

(3) Subsequently, the subtraction of the amplitude value |N(w)| of the Fourier spectrum N(w) of the noise signal from the amplitude value |I(w)| of the Fourier spectrum I(w) of the noise included speech signal is calculated as the following equation to produce an amplitude value |I'(w)|. In this case, a portion where the production result becomes negative is replaced with a positive small constant.

$$|I'(w)|=|I(w)|-|N(w)|$$

(4) Furthermore, a phase value of the Fourier spectrum I(w) is added to the produced amplitude value |I'(w)| to produce a Fourier spectrum I'(w) according to the following equation.

$$I'(w)=|I'(w)|\cdot(I(w)/|I(w)|)$$

(5) Then, the inverse Fourier transform of the produced Fourier spectrum I'(w) is performed to output the resultant as a speech signal where noises are suppressed in the corresponding interval.

(6) Finally, a speech signal (noise-suppressed speech signal) is extracted from the input signal comprising a speech and noises introduced thereinto in a manner that the aforesaid processes from (2) to (5) are repeatedly conducted along the time axis.

There is a problem which arises with the above-mentioned SS method, however, in that, because of extracting the speech signal by the subtraction of the amplitude value of the noise Fourier spectrum, in cases where the noise Fourier spectrum greatly overlaps with the voice Fourier spectrum, much of the voice Fourier spectrum is subjected to the removal to thereby result in difficulty to extract the speech signal. Besides, for the same reason, even if being extracted, the speech signal may lack the original speech information to some extent.

In addition, although for the production of the Fourier spectrum I'(w) of the speech signal the phase value (I(w)/|I(w)|) of the Fourier spectrum I(w) is added to the amplitude value |I'(w)| resulting from the subtraction of the amplitude value of the noise Fourier spectrum from the amplitude value |I(w)| of the Fourier spectrum I(w), this phase value signifies a phase value of a signal where noises are introduced into or superimposed on a speech and hence the Fourier spectrum I'(w) of the speech signal includes the phases of the noises. In other words, difficulty is encountered to restore the phase information of the original speech signal.

Furthermore, when a speech is extracted from an inputted noise superimposed speech in accordance with the aforesaid SS method, a problem still remains in that difficulty is encountered to remove unsteady or transient noises. For the elimination of this problem, a noise removal system using a neural network model has been disclosed by Japanese Examined Patent Publication No. 5-19337, where a neural network estimates a speech included in an inputted noise superimposed speech to output a voice estimation value to be used for the restoration of the speech. In this system, a hierarchical or layered neural network is used as the neural network and estimates the speech through learning and outputs the voice estimation value.

An operation of this layered neural network will be described hereinbelow with reference to FIG. 36. As shown in FIG. 36 data is taken out by a length corresponding to a speech extraction interval T from a noise superimposed speech Al and is given as input signals A2 (more specifically, input values I1, I2, . . . , Ip−1, Ip) to a learning-finished layered neural network 1. Thus, the layered neural network 1 picks a speech included in the input signal A2 to output it as output signals A3 (more specifically, output values S1, S2, . . . , Sp−1, Sp). Further, the layered neural network 1 repeatedly performs this operation to successively issue the output signals A3, thus finally outputting a speech (a voice estimation value) A4.

In addition, another example of noise removal system has been disclosed in Japanese Unexamined Patent Publication No. 2-72398, the technique of which is such that a plurality of microphone signals are produced through a plurality of microphones and inputted into a hierarchical neural network which in turn, issues a noise removed voice estimation value as an output signal through learning.

There is a problem which arises with such noise removal systems based on a neural network, however, in that a high-frequency component is lacking in the outputted voice estimation value. Particularly, in the case of restoring a speech with many consonants constituting high-frequency components, the aforesaid deficiency tends to remarkably occur. For this reason, the consonants are missing in the voice estimation value outputted from a noise removal system using a neural network, and hence, the speech due to the voice estimation value becomes unclear and hard to hear as compared with the original speech. An actual example of the lack of the high-frequency components will be described in detail with reference to FIGS. 37A and 37B.

FIG. 37A shows a waveform of the original speech developed when a male speaker says "Suichoku" (=vertical in English), while FIG. 37B illustrates a waveform of a voice estimation value outputted from a noise removal system using the neural network in the case that a noise superimposed speech produced by superimposing a noise on the original speech is inputted in the noise removal system. As obvious from FIGS. 37A and 37B, the consonants "s", "ch" and "k" are missing in the waveform of the voice estimation value, besides the high-frequency components of the voice portion "ui" are also lacking therein. Thus, a listener may take such a voice estimation value (see FIG. 37B) for "uiyoku".

Moreover, as described above the SS method being the noise suppression method taken in order to realize a speech recognition having no influence of environmental noises or a speech communication in a noisy environment encounters the difficulty of removing the unsteady noises, and for elimination of this problem there has been known a noise suppressing method (for example, Japanese Examined Patent Publication No. 5-19337 and Japanese Unexamined Patent Publication No. 2-72398) using a neural network model modeled on a human brain. In the noise removing system using a neural network model disclosed in Japanese Examined Patent Publication No. 5-19337, a layered neural network model learns to extract and output an aural signal from a noise superimposed speech and, after the learning, removes noises from an input signal. FIG. 38 shows a structure in a learning mode in the Japanese Examined Patent Publication No. 5-19337. For the input to a layered neural network model 2000, a noise superimposed speech is taken out by a length corresponding to a speech extraction interval and input signals I1, I2, I3 . . . , Ip produced by sampling the waveform within that interval at a sampling frequency are inputted to an input layer 2001. Further, teacher signals T1, T2, . . . , Tp to be compared with output signals S1, S2, . . . , Sp outputted from an output layer 2003 due to the input are signals attained in such a manner that an aural signal included in the input signals is sampled at a sampling frequency. The connection weights between the units (indicated by circles) constructing the layered neural network model 2000 are updated on the basis of the comparison between the output signals and the teacher signals so that model 2000 learns. In fact, for the learning the parameters of a multiplier is adjusted to sufficiently reduce the square error between the output signals and the teacher signals.

After the completion of the learning, a noise suppression mode, i.e., an execution mode, is made by a switching operation so that the actual noise superimposed speech is inputted to the layered neural network model 2000 and the output signals are D/A-converted to restore the aural signal. That is, the neural network model 2000 is required to output an output signal at a determined sampling frequency to external units. The sampling frequency necessary for the output signal will be referred hereinafter to as a requirements sampling frequency f0. In the above-mentioned prior art, the sampling frequencies of the teacher signal and the output signal are equal to the requirements sampling frequency f0. In general, in the case of a noise suppression neural network model directly receiving a noise superimposed speech waveform, the sampling frequency of the standard input signal is also made to be equal to the requirements sampling frequency f0. Also in the other prior art such as Japanese Unexamined Patent Publication 2-72398 the sampling frequencies of the teacher signal and the output signal are set to be equal to the requirements sampling frequency f0. Thus, in the prior noise suppression methods using a neural network model, the teacher signal is a speech sampled at a sampling frequency equal to the requirements sampling frequency f0.

However, as shown in FIG. 39A, a neural network model 3000 needs to realize a map, i.e., T1=S1 (i=1, 2, . . . p) mapping teacher signals T1, T2, . . . , Tp comprising P sampled values from the standard input signals I1, I2, I3, . . . , Ip comprising P sampled values. For this reason, the neural network model is required to estimate a desirable output waveform from the teacher signals T1, T2, . . . , Tp. In cases where as shown in FIG. 39B the desirable output waveform is chiefly composed of a low-frequency component and the output waveform slowly varies with respect to the sampling frequency, the estimation of the desirable output waveform is easy and the output waveform estimated by the neural network model substantially coincides with the desirable output waveform.

On the other hand, in cases where as shown in FIG. 39C the desirable output waveform includes a large high-frequency component, in other words, if the waveform has a complicated configuration, the estimation of the desirable output waveform becomes difficult to make the learning of the neural network model difficult. To put it concretely, the high-frequency component included in the output waveform estimated by the neural network model can not follow the high frequency component of the desirable output waveform, with the result that the high-frequency component tends to be missing.

In the case of using the neural network, a number of neural networks in which the learning is completed correctly are prepared and one which can exhibit the best performance is selected therefrom and put to use. However, in cases where, like the above-mentioned example, the learning is difficult, such a procedure cannot be taken, which greatly hinders the application of the neural network.

For getting a neural network model which can easily conduct learning and which can estimate the desirable waveform, the sampling frequency may be heightened, that is, the number of samples may be increased. In this case, it is necessary to increase the number of units of at least an input layer 2001 and the output layer 2003. The increase in the number of units causes the increase in the memory in a system which finally employs the neural network model. In addition, the calculation amount corresponding to the connection weights between the large number of units exceedingly increases, which requires a high-speed processing circuit. For these reasons, the system incorporating the neural network model becomes extremely high in cost.

SUMMARY OF THE INVENTION

It is therefore an object of the present invention to provide a signal extraction system which is capable of accurately extracting one or more signal components from an input signal including a plurality of signal components, and particularly capable of precisely extracting a speech signal even in cases where a voice Fourier spectrum greatly overlaps with a noise Fourier spectrum, and further capable of accurately reproducing the phase information of the original speech signal.

Another object of the present invention is to provide a speech restoration system and speech restoration method which are capable of preventing the occurrence of the lack of high-frequency components in a speech restored from a noise superimposed speech to the utmost so as to reduce the difference between the restored speech and the original speech on the sense of hearing.

A further object of the present invention is to provide a neural network model learning method and a neural network model constructing method which are capable of offering a relative number of suitable neural network models through easy learning concurrently with no increase in the number of units or less increase as compared with the prior art, and further to provide a signal processing system incorporating those neural network models.

In accordance with the present invention, a signal extraction system is arranged such that an information processing means, which processes information through the use of a recurrent neural network, extracts one or more signal components from an input signal including a plurality of signal components to produce one or more output signals. In this arrangement, in general the recurrent neural network involves an interconnecting neural network or a neural network referred to as a neural network model with a recursive connection. This recurrent neural network has been known as a common nonlinear dynamic model having an input and an output, and it has been proven that, through the adjustment of the parameters (such as a weight on connection and a time constant), an arbitrary output signal can be produced through the approximation with an arbitrary accuracy on the basis of a given input signal. For example, this demonstration was made by the paper "ON THE APPROXIMATION OF DYNAMICAL SYSTEMS BY CONTINUOUS TIME RECURRENT NEURAL NETWORKS" (referred hereafter to as a document 2) written in "Electronic Information Communication Scientific Society Technical Research Report" (published on Jan. 18, 1992).

Thus, when a signal having a plurality of signal components mixed is given as an input signal and the parameters of the recurrent neural network are adjusted to output the respective component signals as an output signal, the extraction of one or more signal components is possible with an arbitrary accuracy (precisely). This signifies that, even in the case of the input signal where noises are introduced into a speech, the speech signal and noise signal are extractable with a high accuracy, besides the original speech signal including the phase information is reproducible with a high accuracy.

In the aforesaid arrangement, the parameter adjustment process is called learning, and as this learning there has been known a finite time interval learning algorithm, a real-time learning method based on the minimizing principle, a real-time learning method based on a steepest descent method, or the like (for example, see the paper "LEARNING ALGORITHMS FOR RECURRENT NEURAL NETWORKS" (referred hereinafter to as a document 3) written in "Electronic Information Communication Scientific Society Technical Research Report" (published on Dec. 4, 1989). These processes are usable for the aforesaid adjustment of the aforesaid parameters.

Furthermore, in the signal extraction system according to this invention, a waveform signal in a time domain is given as an input signal to the information processing means and a waveform signal in a time domain is outputted from the information processing means. In addition, a waveform signal in a time domain divided through a plurality of filter groups into signals corresponding a plurality of bands is given as an input signal to the information processing means which in turn, outputs a waveform signal in a time domain or a waveform signal in a time domain divided into a plurality of bands. Moreover, a Fourier spectrum produced by the Fourier transform of a waveform signal in a time domain is fed as an input signal to the information processing means which in turn, outputs a Fourier spectrum.

Still further, wavelet conversion data produced through the wavelet conversion of a waveform signal in a time domain is supplied as an input signal to the information processing means to be outputted from the information processing means. Moreover, a waveform signal in a time domain is supplied as an input signal to the information processing means so that a Fourier spectrum is outputted from the information processing means. In addition, a Fourier spectrum obtained by the Fourier transform of a waveform signal in a time domain is given as an input signal to the information processing means which in turn, outputs a waveform signal in a time domain. Further, wavelet conversion data being the wavelet conversion result of a waveform signal in a time domain is given as an input signal to the information processing means so that a waveform signal in a time domain is outputted from the information processing means.

On the other hand, in an aspect of a speech restoration system according to the present invention, a noise superimposed speech inputted is separated through a neural network into a voice estimation value and a noise estimation value, and a load mean of the noise superimposed speech, the voice estimation value and the noise estimation value is calculated to restore a speech. With this arrangement, since the high-frequency components left out from the voice estimation value and the noise estimation value are included in the noise superimposed speech, the load mean of the noise superimposed speech, the voice estimation value and the noise estimation value results in a speech having less attenuation of the high-frequency components and close to the original speech.

Furthermore, in another aspect of a speech restoration system according to this invention, the load coefficient used for the calculation of the load mean is a coefficient which can minimize the square error of the restored speech with respect to a sample speech. This allows the restored speech (that is, the load mean of the noise superimposed speech, the voice estimation value and the noise estimation value) to be extremely close to the original speech.

Still further, a further aspect of a speech restoration system according to this invention is that prepared are a plurality of sets of load coefficient data each set comprising three load coefficients corresponding to the noise superimposed speech, the voice estimation value and the noise estimation value, respectively. Thus, the optimal load coefficient data can be chosen in accordance with the speaker, that is, the speech is restorable in accordance with the speaker, with the result that the restored speech becomes close to the original speech.

Moreover, a further aspect of a speech restoration system according to this invention is that the optimal load coefficient data is selected in accordance with the kind of noise in the use environment. Accordingly, the speech can be restored in accordance with the kind of noise in the use environment, which also causes the restored speech to approach the original speech.

In addition, the optimal load coefficient data is chosen in accordance with the S/N (signal-to-noise) ratio, which can also permit the restored speech to become close to the original speech. This invention allows the detection of the S/N ratio of the inputted noise superimposed speech which has hitherto been difficult. That is, according to this invention, for the detection of the S/N ratio, the mean powers of the voice estimation value and the noise estimation value separated through a neural network are calculated to obtain the ratio of these mean powers. This mean power ratio corresponds to the S/N ratio of the noise superimposed speech.

Furthermore, according to the present invention, in the learning mode to adjust the weights on connections between the units or to themselves in accordance with the teacher signal and the output signal from the neural network model, the learning is made using a number of output units, which is larger than the number of the output units in the execution mode in which the connection weights are fixed after the completion of the learning to process the actual signals, and the teacher signals corresponding to the number of the output units. That is, as compared with the execution mode, in the learning mode, the more detailed examination of the output signal is made by the comparison between the number of output units and the teacher signals detailed corresponding to the number of output units.

Accordingly, for the learning of the neural network model, the sampling frequency is heightened to increase the number of samples, and therefore, even if the input signal waveform of the object to be processed has a complicated configuration, the estimation of the desirable output waveform becomes easy and the learning becomes easy. In consequence, a relatively large number of preferable neural network models are attainable and the neural network model most suitable for the object to be processed can be selected therefrom, thus providing a neural network mode with a high performance. In addition, in the execution mode to execute the actual signal in a state that the weights on connections are fixed after the completion of the learning in the learning mode, a neural network mode is constructed so that the number of output units is smaller than the number of output units in the learning mode. The neural network model with a smaller number of output units than that in the learning mode is built in a signal processing system.

Although at the execution mode the neural network model has the smaller number of available output units, owing to the detailed learning the desired signal is sufficiently extractable from the signal with a complicated configuration. Further, the output units, which are not used in the execution mode, may be omitted in the execution mode if the omission has no influence on the processing in the execution mode. Accordingly, with the omission of such output units, the application of the neural network model to the signal processing system does not cause the increase in the number of units as compared with the prior art. Even if the output units not put to use cannot be omitted, although the number of output units increases, it does not cause the increase in the memory in the signal processing system. Moreover, because the number of output units does not increase (or increases to a lesser extent), the calculation amount corresponding to the weights on connections between the units or to the same units is preventable from exceedingly increasing and the high-speed processing circuit becomes unnecessary, thus suppressing the increase in cost of the system incorporating the neural network model.

In this instance, the neural network model can be constructed as a layered neural network model or a recurrent neural network. For example, in the case of constructing it as the layered neural network model, in the model a plurality of input units are provided and the input signals whose number is equal to the number of input units are inputted in parallel to the respective input units. In the learning mode, the output signals outputted in parallel from a larger number of output units than that of the input units are compared with the teacher signals, while in the execution mode after the completion of the learning it is possible to construct the neural network model with the decreased number of available output units. The decrease in the number of available output units can be done, for example, by actually decreasing the number of output units up to the number of input units or by merely decreasing the number of available output units up to the number of input units without changing the number of output units. In the case of actually trimming the output units, it is possible to further save the memory in the signal processing system. For decreasing the number of output units used, it is also possible to use, in the execution mode, the output units extracted at a given interval from the output units in the learning mode.

On the other hand, in the case of constructing the neural network model as a recurrent neural network, the neural network model can be made such that the input signals are successively inputted in time series to the input units, and in the learning mode the output signals successively outputted in time series from the output units whose number is larger than the number of the input units are compared with the teacher signals, whereas in the execution mode after the completion of the learning the number of output units is decreased. The decrease in the number of output units can be done, for example, by equalizing the number of output units to the number of input units or by merely decreasing the number of output units used to the number of input units. In the case of the actual reduction in the output units, it is possible to further save the memory in the signal processing system.

The number of output units used in the learning mode can be set to integer times more than twice the number of output units used in the execution mode. For example, the teacher signals can be produced from a time series signal. An aural signal or the like is exemplified as the time series signals.

The output units to be used in the learning mode can be made such that all the output signals output a variation pattern of a signal being an object undergoing the extraction (equivalent to the high sampling frequency method which will be described later) or the output units can be divided into output units for the comparison with the teacher signals and output units for the comparison with additional teacher signals of a given frequency band component included in a frequency band of the teacher signal (corresponding to a band division method which will be described later). That is, for the learning the output units can be divided into output units for outputting a variation pattern of a signal being an object undergoing the extraction and output units for outputting a variation pattern of a signal with a given frequency band component of the teacher signal. This can exhibit the same effects as those in the case that all the output units output the variation pattern of the signal being extracted.

Moreover, it is also possible to use a plurality of given frequency band components, that is, it is also possible to provide output units at every frequency band component. The output units for the comparison with the additional teacher signals with the given frequency band components included in the frequency band of the teacher signals are reducible in the execution mode. Particularly, in cases where the neural network model is constructed as the layered neural network model, the signal processing system is equipped with the layered neural network model constructed as described above, acoustic wave reception means (microphone) for receiving a sound to output it as an analog signal, an A/D converter for converting the analog signal from the acoustic wave reception means into a digital signal, an input buffer for outputting the digital signal from the A/D converter in parallel to input units of the neural network model at every number of input units of the neural network model, an output buffer for outputting the digital signals outputted in parallel from output units of the neural network model in the form of a serial digital signal, a D/A converter for converting the serial digital signal from the output buffer into an analog signal, and acoustic wave outputting means for outputting the analog signal from the D/A converter as a sound. Thus, the system can exhibit the above-described effects in taking out only a specific acoustic wave from the acoustic wave it receives.

On the other hand, in the case of constructing the neural network model as a recurrent neural network, the signal processing system is provided with the layered neural network model constructed as described above, acoustic wave reception means for receiving a sound to output it as an analog signal, an A/D converter for converting the analog signal from the acoustic wave reception means into a digital signal to output it to an input unit of the neural network model, a D/A converter for converting the digital signal outputted from an output unit of the neural network model into an analog signal, and acoustic wave outputting means for outputting the analog signal from the D/A converter as a sound. Accordingly, it is possible to realize a signal processing system which has the above-mentioned effects in taking out only a specific acoustic wave from the acoustic wave it receives.

Furthermore, in the case of constructing the neural network model for the ban extension, that is, if, of output units used in the learning mode, there exist the output units for the comparison with the teacher signals and the output units for the comparison with the additional teacher signals of a given frequency band component, which are not included in the frequency band of the teacher signals, in order to expand the frequency band of the input signal in the execution mode to output it as an output signal, even in the execution mode, the number of output units exceeds the number of input units. Accordingly, in the learning mode in the case of such a band extension, the learning is made using more output units, with the result that it is possible to accurately learn the waveform of the output band. In addition to the above-mentioned effects, a band extension waveform with a higher quality is obtainable in the execution mode.

BRIEF DESCRIPTION OF THE DRAWINGS

The object and features of the present invention will become more readily apparent from the following detailed description of the preferred embodiments taken in conjunction with the accompanying drawings in which.

DESCRIPTION OF THE PREFERRED EMBODIMENTS

Figure 1:
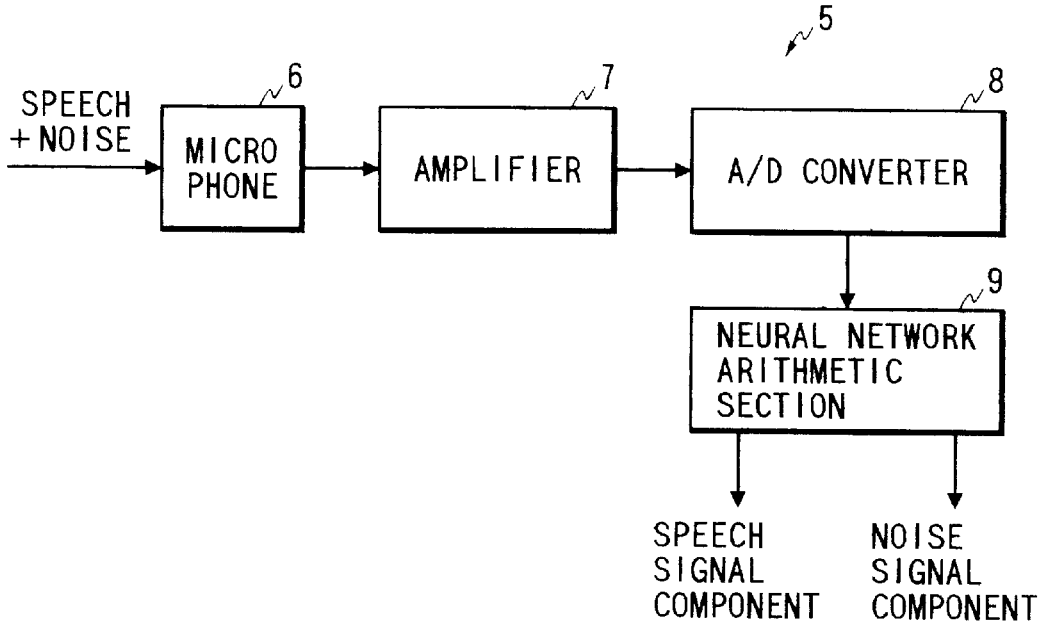
FIG. 1 is a block diagram showing an arrangement of a signal extraction system according to a first embodiment of the present invention.
Figure 2:
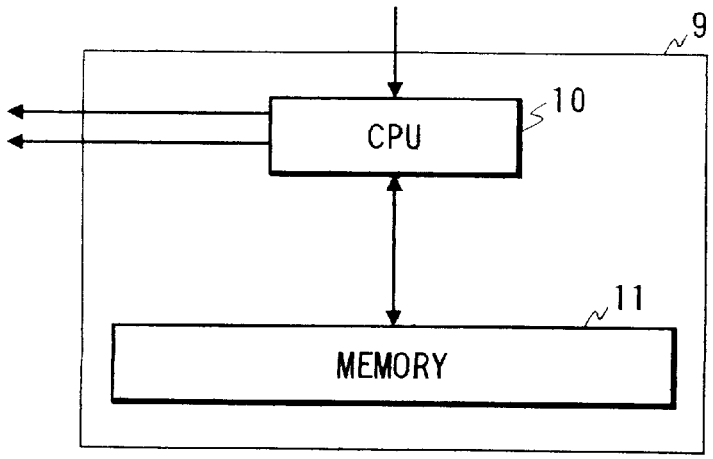
FIG. 2 is a block diagram showing an arrangement of a neural network arithmetic section.
Figure 3:
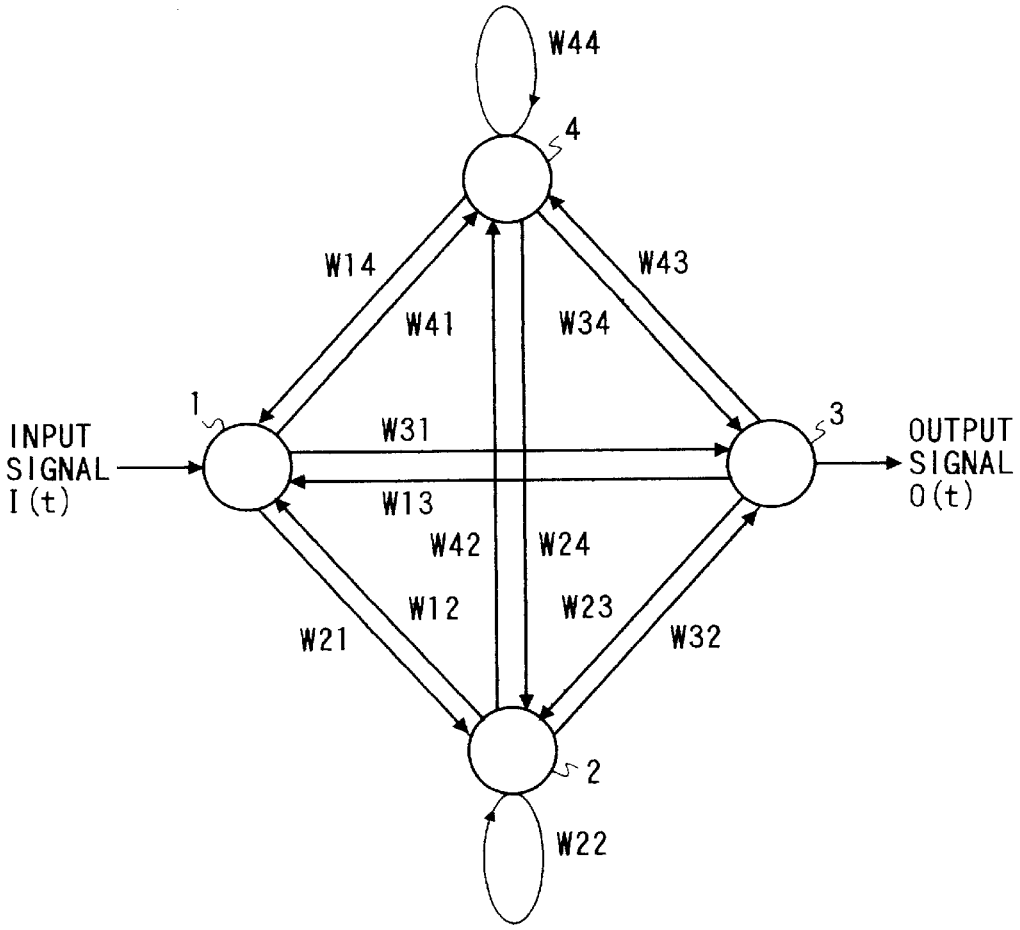
FIG. 3 is an illustration of an example of a recurrent neural network.

Referring now to FIGS. 1 to 6, a description will be made hereinbelow of a signal extraction system according to a first embodiment of the present invention. The description will begins with an example of a recurrent neural network with reference to FIG. 3. The recurrent neural network shown in FIG. 3 is composed of four neurons 1 to 4, each of which is a unit of processing and is equivalent to a nerve cell of a living being. In addition, in FIG. 3, arrows wij drawn to make connections between the respective neurons 1 to 4 or to return to the same neuron are called weights on connections which shows the directions of flow of signals between neurons and the ease of flow of signals (expressed with real numbers), where i=1, 2, 3, 4 and j=1, 2, 3, 4. In this instance, neuron 1 is for the purpose of receiving an input signal waveform in a time domain, and is referred to as an input neuron, whereas neuron 3 is for outputting an output signal waveform in a time domain, and is called an output neuron. The respective neurons i (i=1, 2, 3, 4) conform to the following operational equation (ordinary differential equation).

$$\frac{d}{dt}xi(t) = -tixi(t) + \sum_{j=1}^{4} wijyj(t) + Ii(t) \tag{1}$$

$$yi(t)=s(xi(t)),\ s(x)=1/(1+e^{-x}) \tag{2}$$

where Ii(t) represents an input signal waveform and assumes 0 except for i=1, wij designates a weight on connection from the neuron j to the neuron i, xi(t) denotes a scalar quantity indicative of the internal state of the neuron i, ti depicts a time constant relative to the internal state quantity of the neuron i, yi(t) signifies an output of the neuron i and corresponds to an output signal waveform (referred hereinafter to as O(t)) when i=3, and s(x) stands for a nonlinear function to produce a neuron output on the basis of the values of the internal state of the neuron.

Although as mentioned above the FIG. 3 recurrent neural network is composed of four neurons, if constructing a recurrent neural network with a sufficient number of neurons, in the case of a recurrent neural network with this structure, it has been proven that, through the adjustment of ti and wij, an arbitrary output signal O(t) can be approximated with an arbitrary accuracy and outputted in relation to a given input signal I(t) (see the above-mentioned document 2).

The adjustment of the aforesaid parameters is called learning, and through the numerical calculation by a computer, the parameters are determinable on the basis of an sample input and an output signal component corresponding thereto according to a nonlinear optimizing technique (for example, a finite time interval learning algorithm, a real-time learning method based on the minimizing principle, a real-time learning method based on a steepest descent method) (see the aforesaid document 3). Whereupon, it is found that, if the output neurons are taken by the number of the signal components undergoing the extraction, the respective signals components can be separation-extracted from the input signal I(t) including a plurality of signal components and outputted through the approximation with an arbitrary accuracy.

Secondly, referring to FIGS. 1, 2, 4, 5 and 6, a description will be taken hereinbelow of an example of a signal extraction system according to this embodiment which separates and extracts an speech signal and a noise signal from a signal where traveling noises of a motor vehicle are introduced into a speech. The signal extraction system according to this embodiment is applicable to the preparation of a speech recognition process in the interior of a motor vehicle, a noise reduction process for a car telephone, the preparation of an external environment recognition process on a separated and extracted vehicle noise, and like processes.

FIG. 1 schematically shows the entire arrangement of a signal extraction system according to this embodiment. As shown in FIG. 1 the signal extraction system, designated generally at numeral 5, comprises a microphone 6 for receiving a sound where a traveling noise of a motor vehicle is introduced into a speech to output an aural signal (an electric signal in a time domain), an amplifier 7 for amplifying the aural signal outputted from the microphone 6, an A/D converter 8 for performing an analog-to-digital conversion of the aural signal outputted from the amplifier 7, and a neural network arithmetic section 9 for receiving the digital signal outputted from the A/D converter 8 to output a speech signal component and a noise signal component.

In this case, the A/D converter 8 samples the aural signal outputted from the amplifier 7 at 12 kHz (sampling time: 1/12000 sec) to convert it into a digital signal and further supplies the converted digital signal (a signal waveform in a time domain) to the neural network arithmetic section 9. Further, the neural network arithmetic section 9 serves as an information processing means which processes information through a recurrent neural network, for example, comprising 30 neurons, and numbers of 1 to 30 are given to the 30 neurons of the recurrent neural network and all the neurons including themselves are coupled to each other (recursive connection). In the recurrent neural network, the weight wij on connection and the time constant ti being its parameters are adjusted in advance, for example, according to a finite time interval learning algorithm (the document 3) to accept as an input signal a sound digital signal produced with motor vehicle traveling noises being introduced into a speech and to output as arbitrary output signals a speech signal component and a noise signal component.

The adjustment of the aforesaid parameters (the weight wij on connection and the time constant ti) is made in such a manner as to give an input signal in which a vehicle noise being a sample is added to a speech being a sample and to conduct a numerical calculation on a computer so that a speech signal component and a vehicle noise signal component are outputted as output signal components on the basis of the aforesaid samples. Although the parameter adjustment process is written in detail in the aforesaid document 3, a brief description will be made hereinbelow of a method the inventor actually employed, i.e., Sato finite time interval learning algorithm.

First, when a square error from time T1 to time T2 of the neuron i is taken as E, an equation is given as follows.

$$E = \int_{T1}^{T2} dt \sum_{i \in V} \frac{1}{2}(Qi(t) - yi(t))^2$$

where Qi(t) depicts a teacher signal which, for example, is a signal with only a sample speech, yi(t) denotes the actual output of the neuron i, and V designates a set of numbers of output neurons.

Furthermore, the parameters wij and ti are adjusted to minimize the aforesaid error E. In this case, since the error E is a function of the parameters wij and ti, the error E can be expressed by the following equation.

$$E=E\ (w11, w12, w3, \ldots)\ (, t1, t2, \ldots)$$

From this equation, a problem to minimize the error E is replaced with a problem to find the minimum value of the aforesaid multivariable function E. In this case, the multivariable function E is found through the use of a steepest descent method. At this time, if we vary the parameters E so that E most rapidly decreases, its variation is given by the following equation.

$$Dwij = -h\frac{\partial E}{\partial wij},\ Dt1 = -h\frac{\partial E}{\partial ti}$$

where h represents a quantity to be decreased by one calculation.

Figure 6:
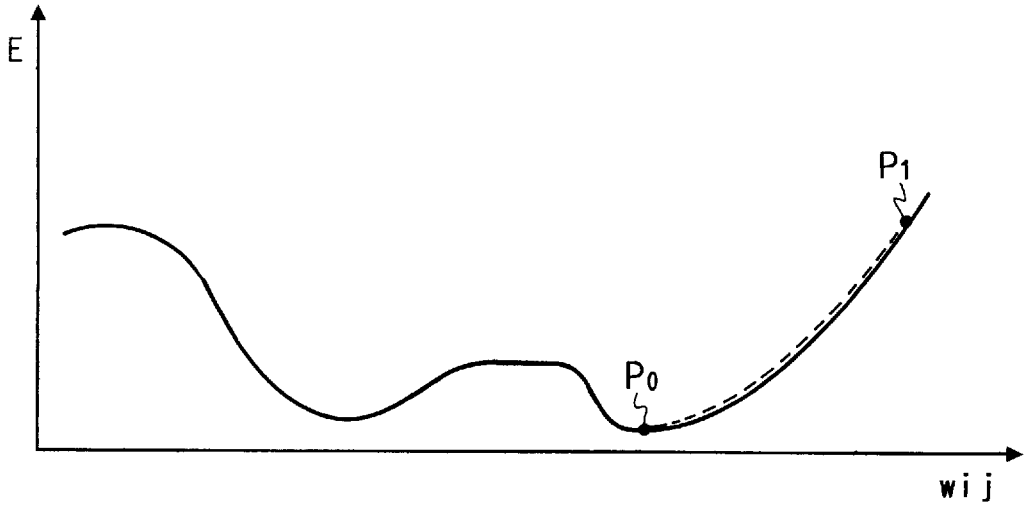
FIG. 6 is an illustration useful for describing the steepest descent method of the finite time interval learning algorithm.

Furthermore, if the discovery of the minimum value of the multivariable function E through the steepest descent method is expressed with a graph, that graph becomes as shown in FIG. 6. In FIG. 6, a point P1 indicates an initial value, and the calculation is successively made in a state where the parameter is changed from the point P1 as indicated by arrows. When reaching the lowest point P0, the aforesaid parameters Dwij and Dti become zero and the variation stops. That is, the calculation is made to attain the parameters which can produce this result. This numerical calculation is programmed and executed by a computer. In the case of this embodiment, since the number of neurons is 30, there is a need to determine approximately 930 parameters. If using a computer such as a so-called a work station, the 930 parameters can be determined for approximately one week.

The neural network arithmetic section 9 concretely comprises a CPU 10 and a memory 11 as shown in FIG. 2. In this instance, the CPU 10 is composed of a DSP (Digital Signal Processor) manufactured by Texas Instruments Corporation, which is a processor particularly made to calculate the sum of products at a high speed. Further, the memory 11 is constituted, for example, using approximately 12 Mbytes of a RAM.

The recurrent neural network organizing the neural network arithmetic section 9 operates in accordance with the above-mentioned operational equations (1) and (2). However, since difficulty is experienced to directly conduct the calculation by the CPU (microprocessor) 10, in this embodiment the equations (1) and (2) are subjected to the time discrete processing to obtain the following operational equations (3) and (4), and the CPU calculates these operational equations (3) and (4).

$$xi(n+1) = K1\ xi(n) + K2\sum_{j=1}^{4} wij\ yi(n) + K2\ Ii(n) \tag{3}$$

$$(i = 1, 2, 3 \ldots, 30, n = 0, 1, 2, \ldots)$$

$$K1 = 1 - tiDT,\ K2 = DT,\ Ii(n) = I(n)(i-1),\ 0(i \neq 1)$$

where DT=1/12000 (second), wij represents a weight on connection from the neuron j onto the neuron i, ti designates a time constant relative to the internal state quantity of the neuron i.

$$yi(n+1)=s(xi(n+1)),\ Z(n+1)=y29(n+1),\ S(n+1)=y30(n+1)\ (i=1, 2, 3 \ldots, 30, n=0, 1, 2, \ldots)\ s(x)=1/(1+e^{-x}) \tag{5}$$

In this case, the time discrete processing of the above-mentioned equations (1) and (2) is conducted as follows. That is, when the discrete processing internal is taken to be DT, the following equation is attainable.

$$\frac{d}{dt}x(t) = \frac{x(t+DT) - x(t)}{DT}$$

If rearranging the above-mentioned equations (1) and (2) by substituting the right side of this equation thereinto and replacing t by n and further DT by 1, the above-mentioned operational equations (3) and (4) are attainable.

Moreover, the recurrent neural network constituting the neural network arithmetic section 9 receives a digital signal I(n) from the A/D converter 8 and operates in accordance with the aforesaid discrete-processed operational equations (3) and (4) to thereby output a noise signal component Z(n) being in a digital form and a speech signal component S(n) being in a digital form, where n=0, 1, 2, 3, . . . In this structure, the neuron 1 serves as an input neuron for receiving the input signal I(n), the neuron 29 serves as an output neuron for outputting the noise signal component Z(n), and the neuron 30 acts as an output neuron for outputting the speech signal component S(n). The outputted speech signal component S(n) is fed, for example, to a speech recognition system. Further, the outputted noise signal component Z(n) is given to an external environment recognition system.

Subsequently, referring to the flow charts of FIGS. 4 and 5, a description will be made hereinbelow of a concrete operation of the recurrent neural network of the neural network arithmetic section 9, i.e., an control operation of the CPU 10 composing the neural network arithmetic section 9.

When receiving one digital data I(n) at every DT seconds, the CPU 10 uses K1, K2 wij (where i, j=1, 2, 3, . . . , 30), xi(n) (where i=1, 2, 3, . . . , 30) and yi(n) (where i=1, 2, 3, . . . 30) stored in advance in the memory 11 to calculate xi(n+1) (where i=1, 2, 3, . . . , 30) and yi(n+1) (where i=1, 2, 3, . . . , 30) and sets y29(n+1) and y30(n+1) to noise signal component data Z(n+1) and speech signal component data S(n+1), respectively. This calculation processing is designed to be completed within the sampling time DT seconds. The above calculation processing is concretely expressed by the flow charts as shown in FIGS. 4 and 5. In these flow charts, x(i, k), y(i, k) (where i=1, 2, 3 . . . , 30, k=1, 2), w(i, k) (where i, j=1, 2, 3, . . . , 30), S(n+1), Z(n+1) (where n=1, 2, 3, . . . ) respectively assume two-dimensional or one-dimensional arrangements or arrays. A brief description will be taken hereinbelow of the control operation executed according to the flow charts of FIGS. 4 and 5.

Figure 4:
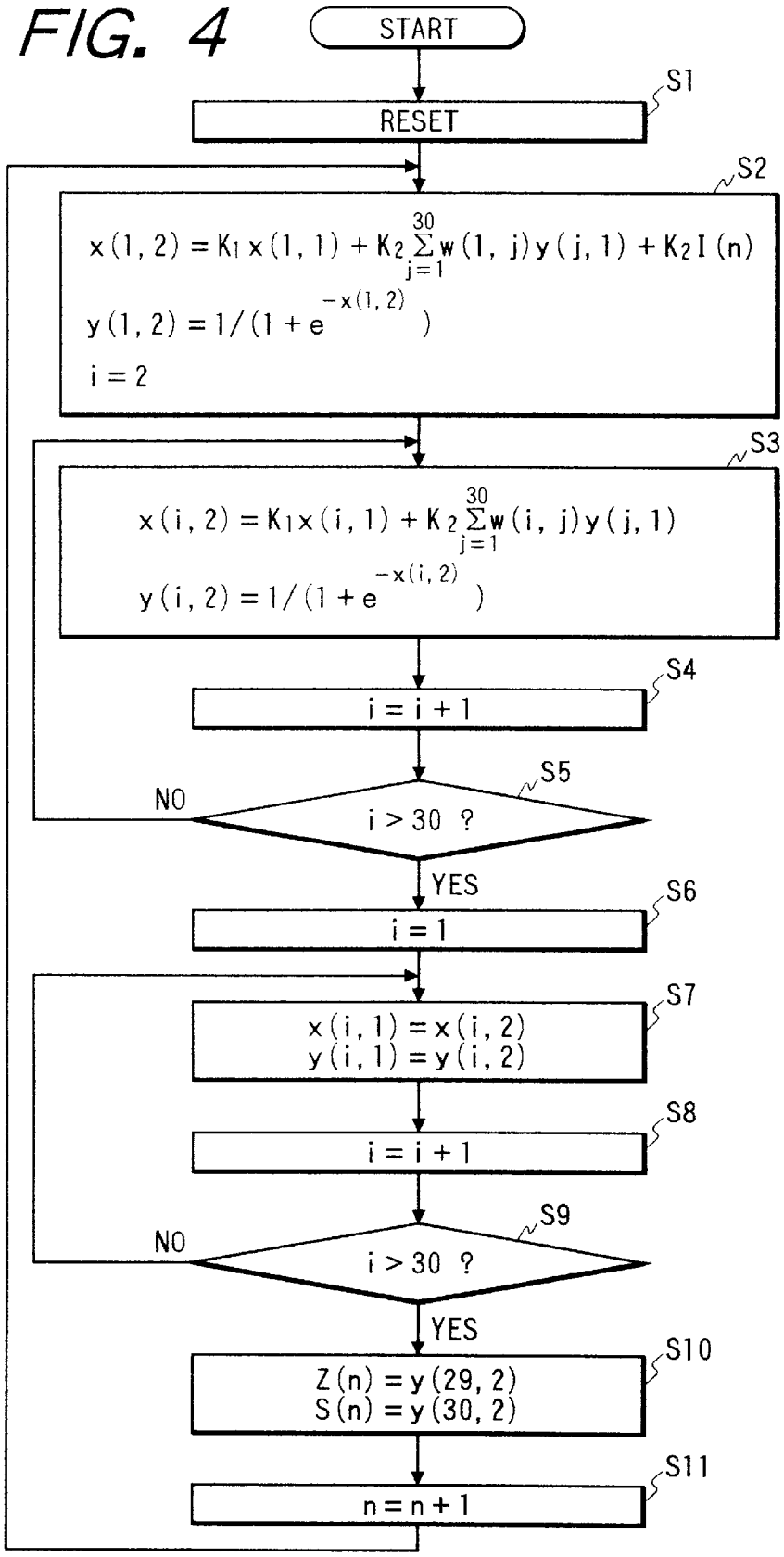
FIGS. 4 and 5 are flow charts showing operations of a recurrent neural network.
Figure 5:
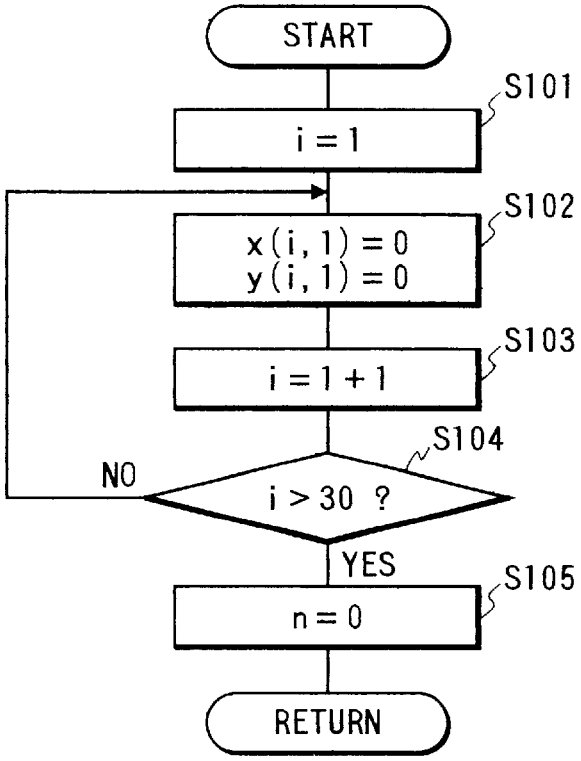

In response to the operation of the starting switch of the signal extraction system 5, a step S1 in FIG. 4 begins to implement reset processing. This reset processing is executed by the operation in the FIG. 5 flow chart, where steps S101 to S105 set all x(i, 1) and y(i, 1) (where i=1, 2, 3, . . . , 30) to 0 and further set n=0. Subsequently, a step S2 calculates x(1, 2) and y(1, 2) and sets i=2, then followed by steps S3 to S5 to calculate x(i, 2) and y(i, 2) (where i=1, 2, 3, . . . , 30). Thereafter, a step S6 sets i=1, and steps S7 to S9 set x(i, 1) and y(i, 1) (where i=1, 2, 3, . . . , 30). Further, a step S10 sets y(29, 2) and y(30, 2) to Z(n) and S(n), respectively, then followed by a step S11 to set n=n+1. After this, the operational flow returns to the step S2 to repeatedly carry out the above operations. When due to the repetition of the calculation process the area of the memory 11 is filled with the arrangements of Z(n) and S(n), the operational flow advances to the step S1 to perform the reset processing and then proceeds to the step S2 to repeat the above operations.

According to this embodiment with this structure, the neural network arithmetic section 9, using a recurrent neural network for processing information, extracts one or more signal components from an input signal including a speech and a noise, more specifically extracts a speech signal component and a noise signal component therefrom to output these two output signals. In this case, the recurrent neural network can extract the aforesaid two signal components with an arbitrary accuracy (accurately) in a manner of adjusting its parameters. Accordingly, even if the input signal includes a speech and a noise introduced thereinto, the speech signal and the noise signal are extractable with a high accuracy, besides the original speech signal including the phase information and other information is accurately reproducible.

Although in the above-described embodiment the recurrent neural network of the neural network arithmetic section 9 is made up of 30 neurons, this embodiment is not limited to this number, and it is possible to use the neurons whose number is less than 30 or use the neurons whose number is more than 30. In addition, although the process to adjust the parameters of the recurrent neural network depends upon the nonlinear optimizing method, if the structure of the recurrent neural network is restricted in advance through the human knowledge and experiences, in the case of, for example, the recurrent neural network as shown in FIG. 3, since there is no need for the input to directly flow to the output neuron, if the connection from the input neuron 1 to the output neuron 3 is cut off, that is, if w31 is set to zero, it is possible to simplify (reduce the calculation quantity) the numerical calculation necessary for the adjustment of the parameters.

Figure 7:
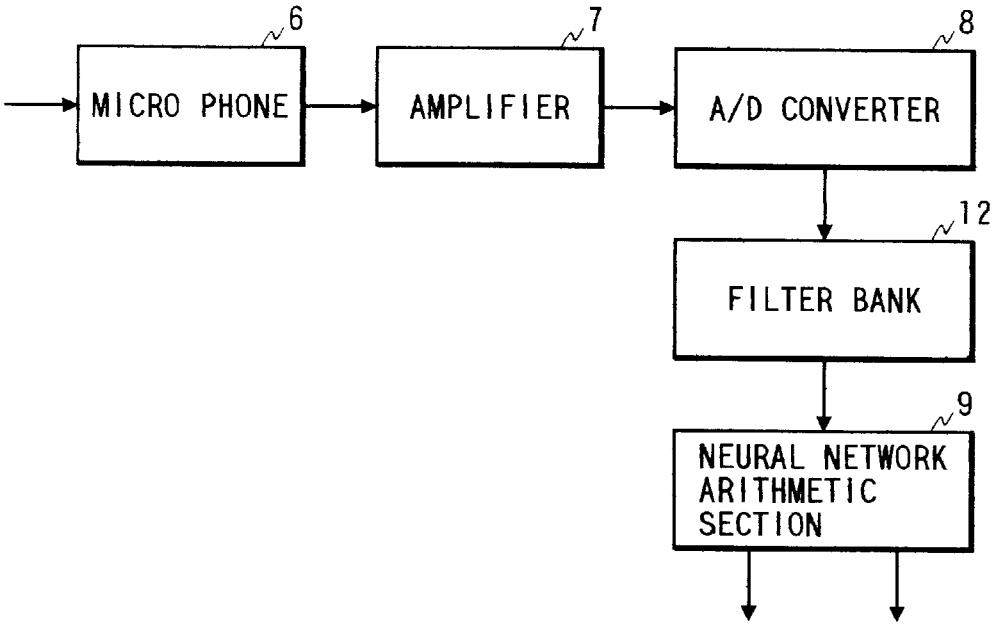
FIG. 7 is a block diagram showing an signal extraction system according to a second embodiment of the present invention.

FIG. 7 shows a signal extraction system according to a second embodiment of the present invention. A description will be taken of the difference of this embodiment from the above-described first embodiment. In the second embodiment, parts equal to or corresponding to those in the first embodiment are marked with the same numerals. As shown in FIG. 7 a filter bank 12 is provided between the A/D converter 8 and the neural network arithmetic section 9. This filter bank 12 is composed of a plurality of digital filter groups and has a function to divide or separate the sound digital signal outputted from the A/D converter into signals having a plurality of bands, for instance, 0 to 1000 Hz, 1000 to 5000 Hz, 5000 to 10000 Hz and 10000 to 20000 Hz. In this case, the respective divided signals are waveform signals in a time domain.

Furthermore, the recurrent neural network of the neural network arithmetic section 9 receives as the input signals the signals with the plurality of bands divided through the filter bank 12 and outputs a waveform signal in a time domain (more specifically, two output signals being a speech signal component and a noise signal component) which are not divided into the bands or waveform signals in a time domain which are divided into a plurality of bands (each of the signals with the respective bands is two output signals consisting of a speech signal component and a noise signal component). In other words, the weight wij on connection and the time constant ti which are the parameters of the recurrent neural network of the aforesaid neural network arithmetic section 9 are adjusted in advance through the learning so as to input and output the above-mentioned respective signals. The other structure of the second embodiment other than the above description is the same as that of the First embodiment.

Accordingly, the second embodiment can substantially exhibit the same effects as those in the first embodiment. Particularly, since in the second embodiment the input signal given to the neural network arithmetic section 9 is divided into a plurality of bands and the output signal given from the neural network arithmetic section 9 is not divided into a plurality of bands or is divided into a plurality of bands, if the plurality of bands obtained by the division are made to match with the band characteristics of the ears of the human beings, it is possible to improve the recognition accuracy of a speech recognition system which receives the output signal from the neural network arithmetic section 9.

Figure 8:
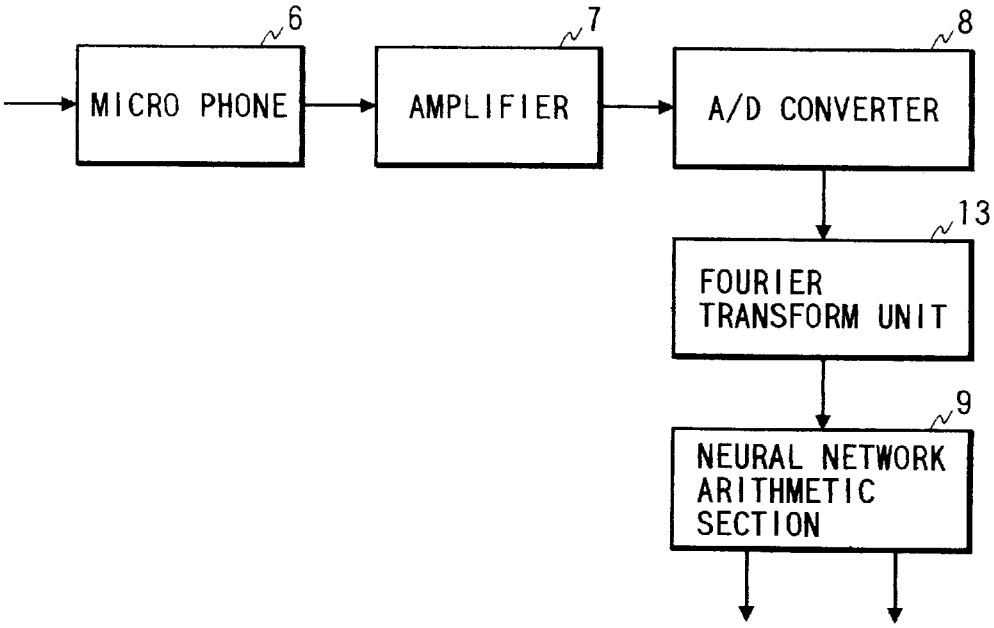
FIG. 8 is a block diagram showing an signal extraction system according to a third embodiment of the present invention.

FIG. 8 is an illustration of a signal extraction system according to a third embodiment of the present invention. A description will be taken hereinbelow of only the difference of this embodiment from the first embodiment. In the third embodiment, parts equal to or corresponding to those in the first embodiment are marked with the same numerals. In the third embodiment, as shown in FIG. 8 a Fourier transform unit 13 is provided between the A/D converter 8 and the neural network arithmetic section 9. This Fourier transform unit 13 performs the Fourier transform of the sound digital signal (a waveform signal in a time domain) outputted from the A/D converter 8 by means of an FFT (Fast Fourier Transform) to output a Fourier spectrum. The recurrent neural network of the neural network arithmetic section 9 accepts as an input signal the Fourier spectrum being the Fourier transform result by the aforesaid Fourier transform unit 13 to output a Fourier spectrum (more specifically, a Fourier spectrum corresponding to two output signals being a speech signal component and a noise signal component). That is, the weight wij on connection and the time constant ti which are the parameters of the recurrent neural network of the neural network arithmetic section 9 are adjusted in advance through the learning so as to input and output the aforesaid respective Fourier spectrums.

The structure of the third embodiment other than the above description is the same as that of the first embodiment. Accordingly, the third embodiment can substantially display the same effects as those in the first embodiment.

Figure 9:
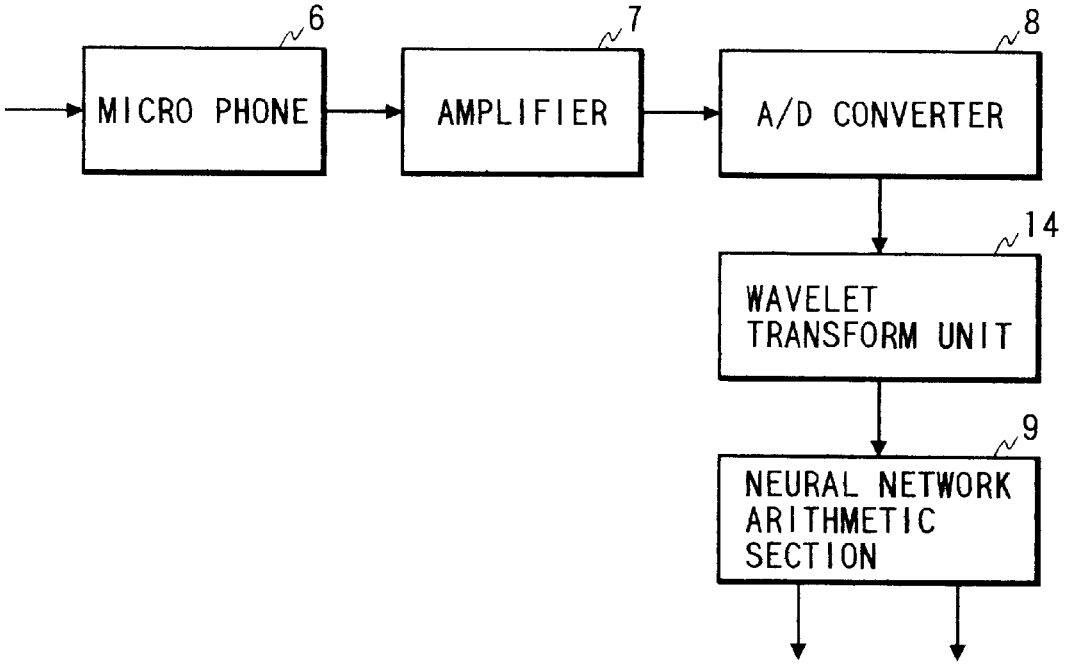
FIG. 9 is a block diagram showing an signal extraction system according to a fourth embodiment of the present invention.

FIG. 9 shows a signal extraction system according to a fourth embodiment of the present invention. The description thereof will be made of only the difference from the first embodiment. The same or corresponding parts are marked with the same numerals. In the fourth embodiment, as shown in FIG. 9 a wavelet transform unit 14 is provided between the A/D converter 8 and the neural network arithmetic section 9. This wavelet transform unit 14 performs the wavelet transform of the sound digital signal (that is, a waveform signal in a time domain) outputted from the A/D converter 8 to output wavelet transform data. This wavelet transform has been disclosed by, for example, the paper "An Introduction to Wavelets" reported in the IEEE "Computational Science and Engineering" (Summer 1995, vol 2, num 2) and is a well-known signal processing technique. Briefly speaking, the wavelet transform is a Fourier transform capable of varying the resolution on time and frequency.

The recurrent neural network of the neural network arithmetic section 9 receives as an input signal the wavelet transform data from the wavelet transform unit 14 to output wavelet transform data (more specifically, data equivalent to two output signals being a speech signal component and a noise signal component). That is, the parameters (the weight wij on connection and the time constant ti) of the recurrent neural network of the aforesaid neural network arithmetic section 9 are adjusted in advance through the learning so as to input and output the above-mentioned respective wavelet transform data.

The structure of the fourth embodiment other than the description here is the same as that of the first embodiment. Accordingly, the fourth embodiment can substantially demonstrate the same effects as those in the first embodiment. Particularly, since in the fourth embodiment the neural network arithmetic section 9 is made to output the wavelet transform data, the resolution of the extracted signal can be set to an arbitrary accuracy, thus improving the recognition accuracy of a speech recognition system or an external environment recognition system.

This invention is not limited to the above-described embodiments. For example, it is also appropriate that a waveform signal in a time domain is given as an input signal to the neural network arithmetic section 9 and a Fourier spectrum is outputted from the same neural network arithmetic section 9. Further, it is also preferable that a Fourier spectrum obtained by the Fourier transform of a waveform signal in a time domain is given as an input signal to the neural network arithmetic section 9 so that a waveform signal in a time domain is outputted from the same neural network arithmetic section 9. Moreover, it is more preferable that the wavelet transform data gained by the wavelet transform of a waveform signal in a time domain is fed as an input signal to the neural network arithmetic section 9 so that a waveform signal in a time domain is outputted from the same neural network arithmetic section 9.

Figure 10:
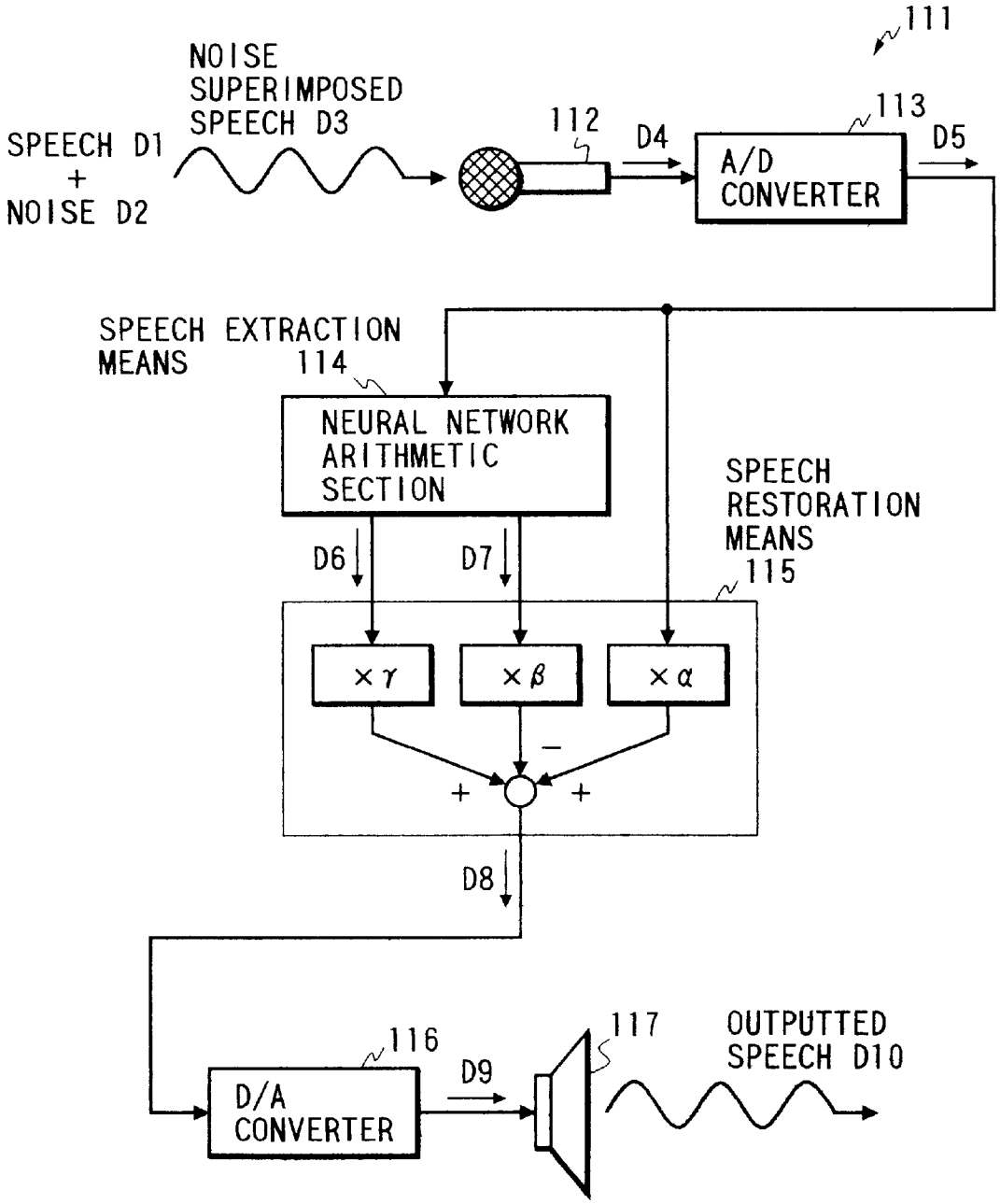
FIG. 10 is a block diagram showing a speech restoration system according to a fifth embodiment of the present invention.

Referring now to FIGS. 10 to 15B, a description will be made hereinbelow of a speech restoration system according to a fifth embodiment of the present invention. FIG. 10 shows an electric arrangement of a speech restoration system in the form of a combination of functional blocks. In FIG. 10, a speech restoration system, designated at numeral 111, is composed of a microphone 112, an A/D converter 113, a neural network arithmetic section 114, a weighted mean calculation section 115, a D/A converter 116, and a speaker 117.

The microphone 112 takes in a noise superimposed speech D3 being a speech D1 plus a noise D2 to output an analog input signal D4. This analog input signal D4 is produced by converting the noise superimposed speech D3 into an electric signal. Further, the A/D converter 113 receives the analog input signal D4 outputted from the microphone 12 and performs the analog-to-digital (A/D) conversion thereof to output a digital signal D5. This digital signal D5 is a signal obtained by the conversion of the noise superimposed speech D3 into a digital electric signal, i.e., a noise superimposed aural signal. In this case, the A/D converter 113 is made to sample the analog input signal D4 at, for example, 12 kHz (sampling time: $1/12000$ second) to convert the sampled result into the digital signal D5. Incidentally, it is also appropriate that an amplifier for amplifying the analog input signal D4 is provided between the microphone 112 and the A/D converter 113.

Furthermore, the neural network arithmetic section 114 accepts the noise superimposed aural signal (digital signal) D5 outputted from the A/D converter 113 and separates the noise superimposed aural signal D5 into a voice estimation value (aural signal component) D6 and a noise estimation value (noise signal component) D7 with a neural network to output these values D6 and D7. This neural network arithmetic section 114 organizes a speech extraction means. In this case, the neural network arithmetic section 114 uses, for example, a recurrent neural network (hereinafter referred to as a RNN) as the neural network for conducting the signal extraction processing. The RNN is a neural network model having feedback connections (recursive connections) and is made such that a plurality of neurons are coupled (recursively connected) to each other or connected to itself. In this embodiment, for example, the RNN is constructed with 30 neurons. Each of the neurons of the RNN has a film potential state. The output of each of the neurons is determined as a film potential function (output function). When the number of neurons is taken as N, the output function of the ith neuron (i=1, 2, . . . , N) is taken as fi, and the film potential and the output value at time t are respectively taken to be xi(t) and yi(t), the following equation is satisfied.

$$yi(t)=fi\ (xi(t))$$

Furthermore, in the RNN, the film potential of each of the neurons varies with time. In this case, the rate of change of the film potential with respect to time is given by the following equation.

$$\tau_i \, dx_i(t)/dt = -x_i(t) + \sum_{j=1}^{N} w_{ij} y_j(t) + I_i(t)$$

where $dx_i(t)/dt$ represents the rate of change of the film potential, $t_i$ designates the time constant of the ith neuron, $I_i(t)$ depicts the input signal to the ith neuron, and wij denotes a weight on connection from the jth neuron to the ith neuron.

Figure 11:
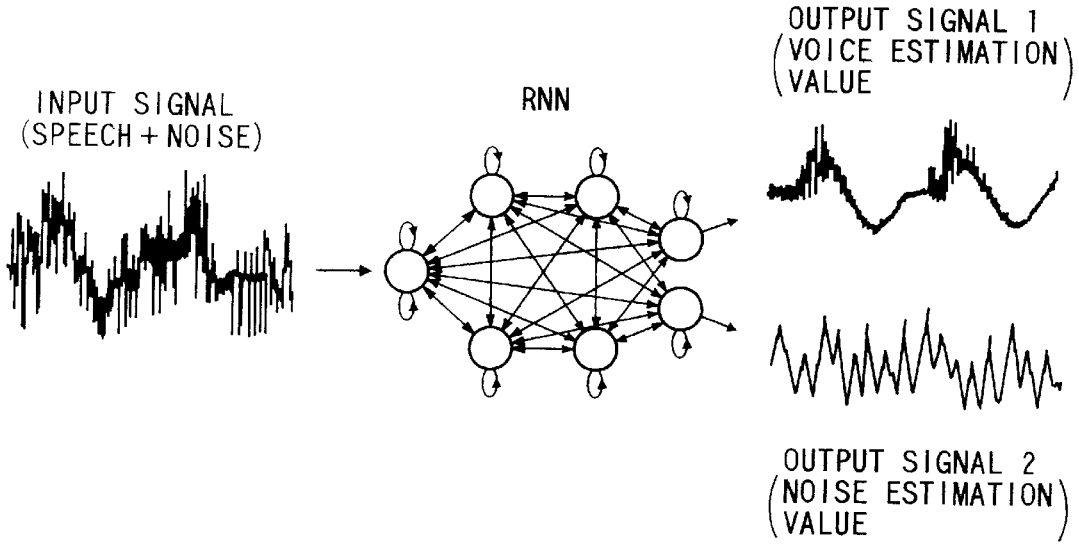
FIG. 11 is an illustration of a recurrent neural network in the fifth embodiment.

Still further, as shown in FIG. 11 the RNN is a model having one input (noise superimposed speech) and two outputs (a speech estimation value plus a noise estimation value). In this instance, when the input signal at time t is taken as I(t) and a speech and a noise included in this input signal I(t) are respectively taken to be s(t) and n(t), the input and output relation of the RNN can be expressible by the following equation.

| | |
|---|---|
| Input | $I(t)\ (=s(t)+n(t))$ |
| Output 1 | $s(t)$ |
| Output 2 | $n(t)$ |

Moreover, in order for the RNN to attain the aforesaid input and output relation, a learning is made in advance with respect to the RNN through the use of appropriately chosen sample speech and sample noise to adjust (determine) the weight wij on connection and the time constant ti of the RNN. This learning algorithm is well known and, for example, is written in "Sato M. A learning algorithm to spatio-temporal patterns to recurrent neural networks, Biol. Cybern., 62, pp. 259–263 (1990)". In this embodiment, the neural network arithmetic section 114 uses a RNN which takes the above-mentioned learning in advance.

Furthermore, the weighted mean calculation section 115 receives the noise superimposed aural signal D5 outputted from the A/D converter 113 and both the voice estimation value D6 and noise estimation value D7 outputted from the neural network arithmetic section 114 to calculate the weighted mean of these three signals and to output the calculated weighted means as a restored aural signal D8. This weighted means calculation means 115 constitutes a speech restoration means. The principle and operation of the speech restoration function of the weighted mean calculation section 115 will be described later.

Furthermore, the D/A converter 116 receives the restored aural signal D8 outputted from the weighted mean calculation section 115 to convert it into an analog output signal D9 and output the analog output signal D9. The speaker 117 receives the analog output signal D9 outputted from the D/A converter 116 to convert it into a sound and output the sound as an outputted speech (restored speech) D10. It is also appropriate that an amplifier for amplifying the analog output signal D9 is provided between the D/A converter 116 and the speaker 117.

Secondly, a description will be taken hereinbelow of the principle and operation of the speech restoration function of the weighted mean calculation section 115. Let it be assumed that the noise superimposed aural signal D5, the voice estimation value D6 and the noise estimation value D7 at time t are respectively taken to be I(t), $s_{out}(t)$ and $n_{out}(t)$, the restored aural signal D8 is taken as S(t) and the aural signal (original aural signal) included in the noise superimposed aural signal D5 is taken as sr(t). Assuming that the neural network arithmetic section 114 correctly estimates the voice estimation value D6 and the noise estimation value D7, the following two equations are satisfied.

$$S(t)=s_{out}(t)=sr(t) \tag{6}$$

$$S(t)=I(t)-n_{out}(t)=sr(t) \tag{7}$$

In the case of the equation (2), an aural signal is given by the subtraction of the noise estimation value D7 from the noise superimposed aural signal D5. However, in the voice estimation value D6 and the noise estimation value D7 extracted through the neural network arithmetic section 114, the high-frequency components are lacking, and hence both the above-mentioned equations (6) and (7) do not contribute to correct restoration of the aural signal. That is, in the case of the equation (6), since in the voice estimation value D6 (restored aural signal D8), for example, the aforesaid consonants being the high-frequency components are missing, the restored aural signal D8 results in an unclear speech which is hard to listen to. Further, in the case of the equation (7), the high-frequency components of the noise is mixed into the restored aural signal D8. A description will be made here of the reason that the high-frequency components of the noise are introduced into the restored aural signal D8.

Let it be assumed that the noise signal included in the noise superimposed aural signal D5 is taken as nr(t) and the low-frequency component and high-frequency component of the noise signal nr(t) are respectively taken to be nrL(t) and nrH(t). Accordingly, the following two equations comes into existence.

$$I(t)=sr(t)+nr(t)$$

$$nr(t)=nrL(t)+nrH(t)$$

If modifying the above-mentioned equation (7) using these two equations, the modification is as follows. In this case, since the noise estimation value lacks the high-frequency components, the following relation comes into satisfaction.

$$n_{out}(t)=nrL(t)$$

Through the use of this relation, the above-mentioned equation (7) is deformed as follows.

$$\begin{aligned} S(t) &= I(t) - n_{out}(t) \\ &= (sr(t) + nr(t)) - nout(t) \\ &= (sr(t) + (nrL(t) + nrH(t))) - n_{out}(t) \\ &= sr(t) + nrH(t) \end{aligned}$$

As obvious from this, the high-frequency component nrH of the noise is mixed into the restored aural signal sr(t). Further, in the case of restoring a speech in accordance with the equation (7), there is an advantage in that the restored aural signal D8 does not develop the lack of the high-frequency component, i.e., the consonant. However, in this case, if the sound pressure of the noise signal included in the noise superimposed aural signal D5 becomes high, its high-frequency component nrH(t) increases, thus deteriorating the sense of hearing to cause the difficulty of hearing. As a way to eliminate this problem, it is considered that the aural signal is restored using the following equation (8) given by a combination of the above-mentioned equations (6) and (7).

This equation (8) signifies the calculation of the weighted mean of the equations (6) and (7).

$$S(t)=A(I(t)-n_{out}(t))+B_{sout}(t) \quad (8)$$

where A≧0, B≧0, A+B=1, and these coefficients A and B designate weight coefficients.

In this equation (8), the weight coefficients A and B are commonly are set as follows. That is, in the case that the S/N ratio of the noise superimposed aural signal D5 is high, the weight coefficients A and B are set to A>B in order to prevent the consonant of a speech from being missing. On the other hand, in the case of a low S/N ratio of the noise superimposed aural signal D5, they are set to A<B in order to prevent the introduction of the high-frequency component of the noise. Accordingly, the weight coefficients A and B can be considered as being coefficients for adjusting the trade-off of the introduction of the high-frequency component of the noise. Thus, if the weight coefficients A and B are appropriately determined, it is possible to prevent the lack of the consonant of a speech and the introduction of the high-frequency component of a noise, with the result that a speech easy to catch is restorable.

In this embodiment, the weighted mean calculation section 15 calculates the noise superimposed aural signal D5, the voice estimation value D6 and the noise estimation value D7 in accordance with the following equation (9) obtained by generalizing the above-mentioned equation (8).

$$S(t)=\alpha I(t)-\beta n_{out}(t)+\gamma s_{out}(t) \quad (9)$$

where α, β and γ denote weight coefficients of the noise superimposed aural signal D5, the voice estimation value D6 and the noise estimation value D7, respectively.

In this embodiment, these weight coefficients α, β and γ are determined in accordance with a method which will be described hereinbelow, i.e., the so-called method of least square coefficients.

For determination of the weight coefficients α, β and g, an appropriate noise is first superimposed on an appropriately selected same speech to produce the noise superimposed aural signal I(t). Subsequently, this noise superimposed aural signal I(t) is inputted through the microphone 112 and the A/D converter 113 into the neural network arithmetic section 114 so that the neural network arithmetic section 114 outputs the voice estimation value $s_{out}(t)$ and the noise estimation value $n_{out}(t)$. Further, the sample speech included in the noise superimposed speech I(t) is defined as sr(t). When the length of the sample speech is taken as L, the square error E with respect to the sample speech of the restored speech is defined by the following equation. This square error E is an index indicating the deviation between the restored speech and the sample speech, and if the weight coefficients α, β and γ are determined to minimize the square error E, the optimization of the restored speech is realizable.

$$E = (1/2)\times\sum_{t=1}^{L}(sr(t)-S(t))^2$$

$$= (1/2)\times\sum_{t=1}^{L}(sr(t)-\alpha I(t)-\beta n_{out}(t)+\gamma s_{out}(t)))^2$$

In the above equation for the square error E, although t represents time, since the noise superimposed aural signal is converted through the A/D converter 113 into a digital signal, the time t signifies the sampling number. More specifically, in this embodiment, the noise superimposed aural signal is sampled at 2 kHz (the sampling time: 1/12000 second), and hence if the length L is set to correspond to one second, the time t takes a number from 1 to 12000.

In order to make the restored speech closest to the original speech (sample speech), the weight coefficients α, β and γ are determined to minimize the square error E. These weight coefficients α, β and γ are obtainable by the solution of the following simultaneous equations.

$$\partial E/\partial\alpha=0$$

$$\partial E/\partial\beta=0$$

$$\partial E/\partial\gamma=0$$

Developing the above simultaneous equations provides the following simultaneous equations with three unknowns, and the simultaneous equations with three unknowns are solved in terms of α, β and γ.

$$A_{11}\alpha-A_{12}\beta+A_{13}\gamma=A_{14}$$

$$A_{21}\alpha-A_{22}\beta+A_{23}\gamma=A_{24}$$

$$A_{31}\alpha-A_{32}\beta+A_{33}\gamma=A_{34}$$

The coefficients $A_{11}$ to A34 in the above-mentioned simultaneous equations with three unknowns are defined as follows.

$$A_{11}=\sum_{t=1}^{L}I(t)I(t) \qquad A_{12}=\sum_{t=1}^{L}n_{out}(t)I(t)$$

$$A_{13}=\sum_{t=1}^{L}s_{out}(t)I(t) \qquad A_{14}=\sum_{t=1}^{L}sr(t)I(t)$$

$$A_{21}=\sum_{t=1}^{L}I(t)n_{out}(t) \qquad A_{22}=\sum_{t=1}^{L}n_{out}(t)n_{out}(t)$$

$$A_{23}=\sum_{t=1}^{L}s_{out}(t)n_{out}(t) \qquad A_{24}=\sum_{t=1}^{L}sr(t)n_{out}(t)$$

$$A_{31}=\sum_{t=1}^{L}I(t)s_{out}(t) \qquad A_{32}=\sum_{t=1}^{L}n_{out}(t)s_{out}(t)$$

$$A_{33}=\sum_{t=1}^{L}s_{out}(t)s_{out}(t) \qquad A_{34}=\sum_{t=1}^{L}sr(t)s_{out}(t)$$

Moreover, in this embodiment, the weighted mean calculation section 115, using the weight coefficients α, β and γ determined through the above-mentioned method, calculates the weighted means S(t) of the noise superimposed aural signal D5, the voice estimation value D6 and the noise estimation value D7 to output the calculated weighted mean S(t) as the restored aural signal D8. This restored aural signal D8, i.e., the outputted speech (restored speech) D10 to be outputted from the speaker 117, becomes a speech in which the lack of the consonant and the introduction of the high-frequency component are minimized. Thus, it is possible to restore a clear speech which is easy to hear.

Furthermore, the weight coefficients α, β and γ used in the weighted mean calculation section 115 tend to considerably depend upon the used sample speech and superimposed noise. For this reason, it is preferable that the weight coefficients α, β and γ are determined using a speaker and a noise closest to the environment wherein the speech restoration system 111 is used. More specifically, in the case that it is possible to specify the speaker who generates a voice, the speech of that speaker is used as the sample speech. In addition, when it is possible to specifying the noise source, that noise is used as the noise to be superimposed. it is preferable that the weight coefficients α, β and γ are determined through the aforesaid method of least square coefficients on the basis of such sample speech and superimposed noise.

Furthermore, a description will be made hereinbelow of an experiment for evaluating the speech restored through the speed restoration system 111 according to this embodiment. In this evaluation experiment, in addition to the use of the speech restoration system 111 according to this embodiment, the speech restoration system (which will be referred hereinafter to as an SS method comparative system) based on the SS method which has been described in the description of the Prior Art and the previously described system (for example, first embodiment) (hereinafter referred to as a first embodiment comparative system) are used for the comparison with this system 111. Further, as the evaluation experiment, there are conducted two experiments roughly classified, that is, an experiment A in which the S/N ratios of the restored speeches by the respective systems are compared with each other and an experiment (an experiment on the sense of hearing) B in which the comparison is made in the manner that a plurality of listeners listen to the restored speeches by the respective systems. These two experiments A and B will be described in order.

The description will begins with a method of the experiment A. Using speeches of one male speaker, 10 sets of speech data are prepared, each set of speech data consisting of, for example, 7 words (to put it concretely, "ue (=up)", "shita (=down)", "migi (=right)", "hidari (=left)", "kakudai (=magnification)", "shukusho (=reduction)", and "waido (wide)") which are map control commands in a car navigation. The 10 sets of speech data have numbers from 0 to 9, respectively. Further, as the noise data, there is used a noise in a car interior which occurs when a car "Landcruiser" manufactured by Toyota Co., Ltd. travels (to put it concretely, that car travels on a national road No. 1 in a state where windows are in open condition and an air conditioner is in operation). Still further, as the neural network of the neural network arithmetic section 114, there is employed an RNN having 30 neurons, and using the 0th speech data the learning of the neural network arithmetic section 14 is made in advance for 400 hours. The experiment comprising the following two steps was conducted. In the step 1, the noise data is superimposed on the 0th to 4th speech data, i.e., 7 words×5 sets=35 words, to produce noise superimposed speeches whose S/N ratios are 10, 5, 0 and −5 dB. These noise superimposed speeches are inputted into the neural network arithmetic section 114 to obtain the voice estimation values and the noise estimation values. In addition, the weight coefficients α, β and γ are determined in according with the method of least square coefficients. In this instance, when the length of the ith words (i=1, 2, . . . , 35) is taken as $L_i$, the weight coefficients α, β and γ are determined in accordance with the following equation.

$$E_i = \sum_{t=1}^{L_i} (SR_i(t) - (\alpha_i I_i(t) - \beta_i n_i(t) + \gamma_i s_i(t)))^2$$

-continued $$\partial E_i / \partial a_i = \partial E_i / \partial b_i = \partial E_i / \partial g_i = 0$$

where $SR_i(t)$, $I_i(t)$, $n_i(t)$, $s_i(t)$ represent the original speech, the noise superimposed speech, the noise estimation value and the voice estimation value, respectively.

In the step 2, the weight coefficients α, β and γ determined in the above-mentioned step 1 are used for the weighted mean calculation section 115 to calculate the weighted mean. Further, the noise data is superimposed on the 10 sets of speech data to produce the noise superimposed speeches with the S/N ratios of 10, 5, 0 and −5 dB. Subsequently, the noise superimposed speeches are inputted into the speech restoration system 111 which in turn, outputs the restored speeches. In addition, the same noise superimposed speeches are also inputted into the SS method comparative system so that the SS method comparative system outputs the restored speeches. Moreover, the same noise superimposed speeches are also inputted into the first embodiment comparative system so that the first embodiment comparative system outputs the restored speeches. Thereafter, the restored speeches outputted from the respective systems are compared in S/N ratio with each other.

Figure 12A:
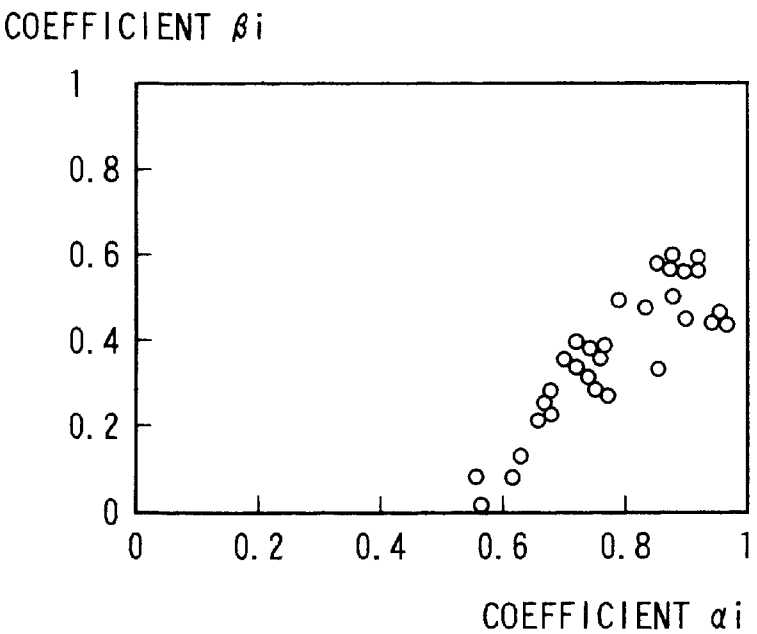
FIGS. 12A and 12B are illustrations of the correlation between the load coefficients $\alpha$, $\beta$ and $\gamma$.
Figure 12B:
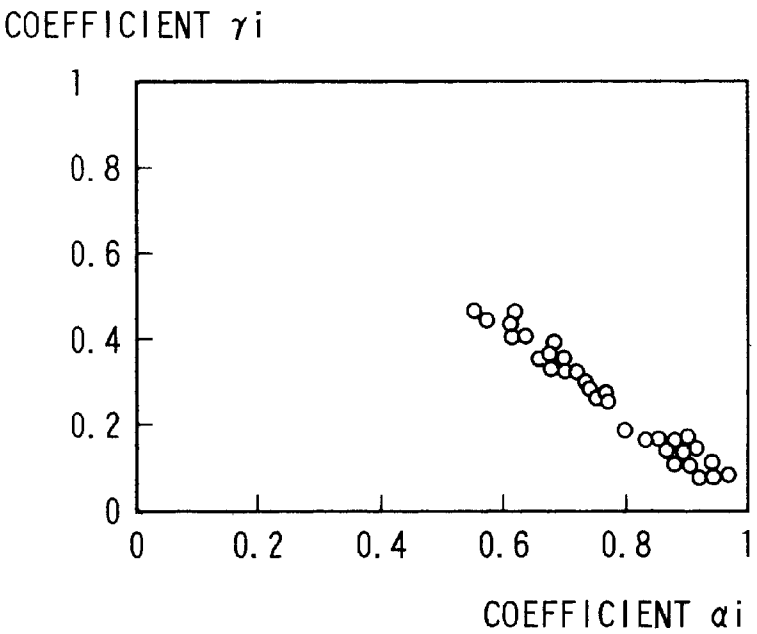
Figure 13B:
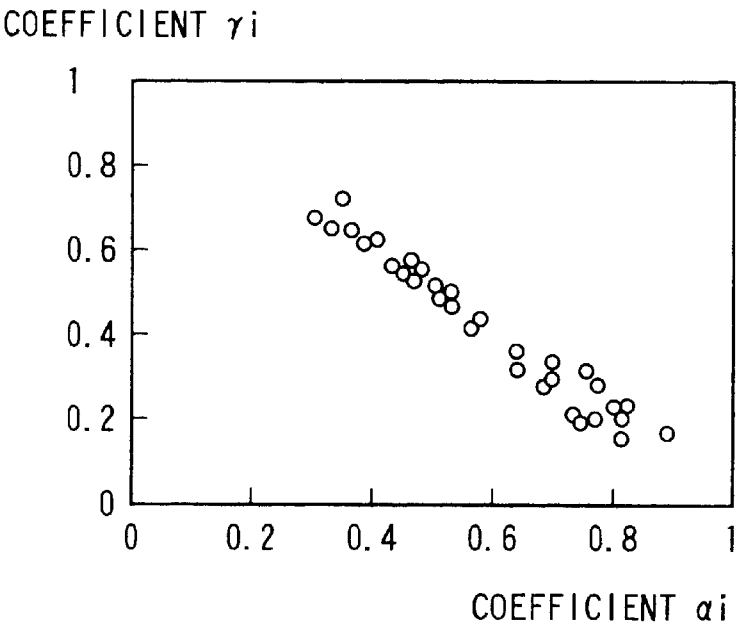
FIGS. 13A and 13B are illustrations of the correlation between the load coefficients $\alpha$, $\beta$ and $\gamma$ in the case of another S/N ratio.
Figure 13A:
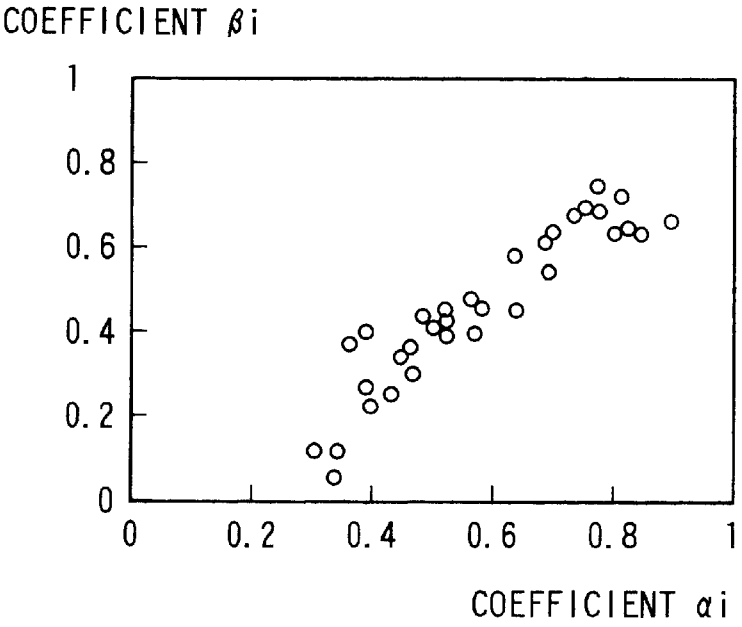
Figure 14A:
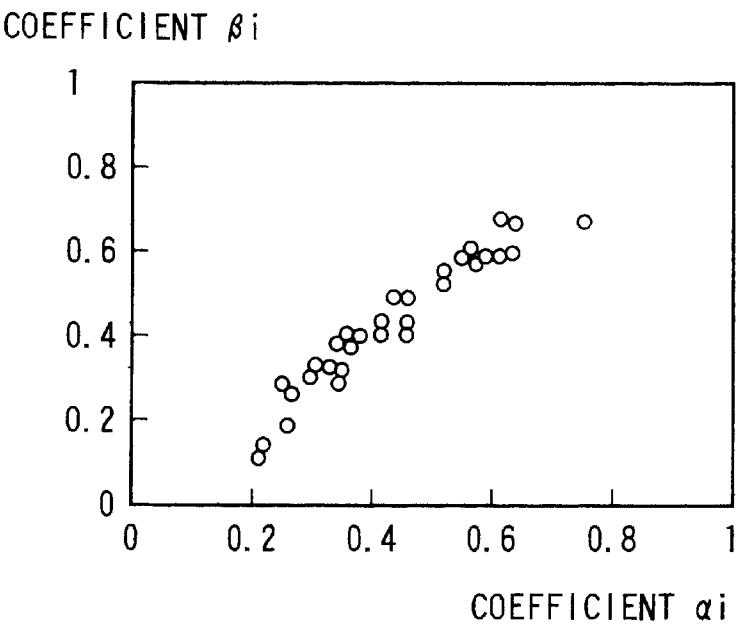
FIGS. 14A and 14B are illustrations of the correlation between the load coefficients $\alpha$, $\beta$ and $\gamma$ in the case of a different S/N ratio.
Figure 14B:
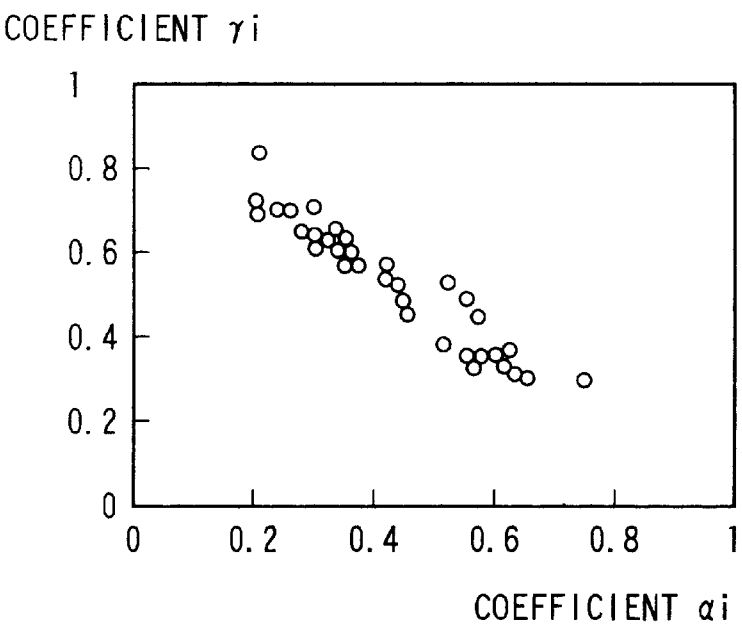
Figure 15A:
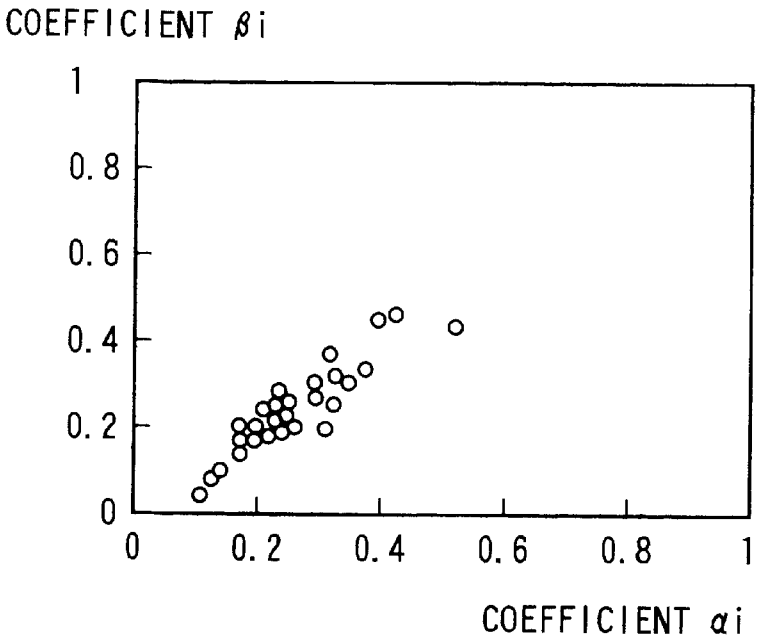
FIGS. 15A and 15B are illustrations of the correlation between the load coefficients $\alpha$, $\beta$ and $\gamma$ in the case of a different S/N ratio.
Figure 15B:
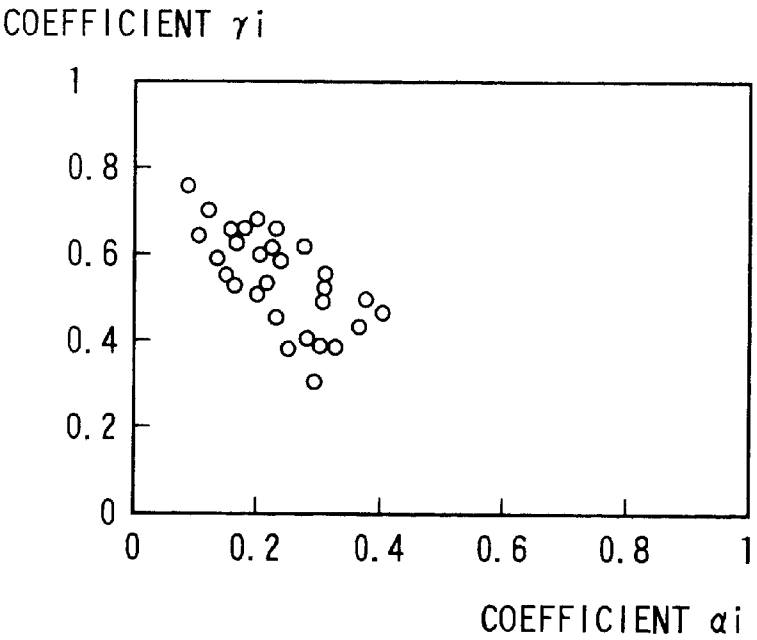

A description will be taken hereinbelow of the experimental results due to the above-mentioned steps 1 and 2. FIGS. 12A to 15B are scatter diagrams showing the correlation of the weighted coefficients αi, βi and γi (I=1, 2, . . . , 35) obtained in the step 1 in the case that the S/N ratios of the noise superimposed speeches being the input signals are 10, 5, 0 and −5 dB. FIGS. 12A and 12B show the correlation in the case that the S/N ratio is 10 dB, FIGS. 13A and 13B show the correlation in the case that the S/N ratio is 5 dB, FIGS. 14A and 14B show the correlation in the case that the S/N ratio is 0 dB, and FIGS. 15A and 15B illustrate the correlation in the case that the S/N ratio is −5dB. It is found from FIGS. 12A to 15B that a positive correction takes place between the ai and bi and a negative correlation takes place between ai and gi. In addition, as the S/N ratio of the noise superimposed speech decreases, ai and bi decreases while gi increases. The following table 1 shows the mean values of the weight coefficients obtained in relation to the S/N ratios of the input signals (noise superimposed speeches).

TABLE 1

Mean Values of Weight Coefficients

| S/N Ratio of | αi | βi | γi |
|---|---|---|---|
| Input Signal | | | |
| 10dB | 0.777 | 0.371 | 0.253 |
| 5dB | 0.607 | 0.476 | 0.420 |
| 0dB | 0.429 | 0.424 | 0.537 |
| −5dB | 0.258 | 0.239 | 0.529 |

Further, it has been known from another experiment that the S/N ratios of the speeches of the map control commands in a car navigation located in the interior of a motor vehicle approximately come into the range of 5 dB to 0 dB. Further, the experiment of the step 2 was conducted in the manner that the weight coefficients α, β and γ are set to the mean values of the S/N ratios of 5 dB and 0 dB, more specifically, on the condition of α=0.518, β=0.450 and γ=0.479.

A description will be made hereinbelow of the experimental results of the step 2. In this instance, the speech restoration system 111 according to this embodiment restores the speeches through the use of the weight coefficients α, β and γ determined in the above-mentioned step 1. The first embodiment comparative system uses a neural network arithmetic section having the same arrangement as that of the neural network arithmetic section 114 of the speech restoration system 111 according to this embodiment and produces the restored speeches through the subtraction of the noise estimation value from the noise superimposed speeches. Accordingly, the first embodiment comparative system results in a system equivalent to the speech restoration system 111 according to this embodiment which uses the weight coefficients α=1, β=1 and γ=0.

A table 2 shows the S/N ratios of speech restored in a manner that the noise superimposed signals obtained by superimposing the noise data on the 0th to 4th speech data are inputted in the speech restoration system 111 according to this embodiment. In this table 2, the numerals in the word columns other than the "heikin (=mean)" column designate the mean values of the S/N ratios of five restored speeches corresponding to the 0th to 4th speech data (noise superimposed signals).

TABLE 2

This Embodiment (Method of Least Square Coefficients)

| Input S/N | Ue | Shita | Migi | Hidari | Kaku-dai | Shu-kusho | Waido | Heikin |
|---|---|---|---|---|---|---|---|---|
| 10dB | 11.4 | 12.8 | 10.5 | 11.4 | 11.0 | 10.8 | 11.5 | 11.3 |
| 5dB | 9.0 | 10.8 | 8.4 | 9.2 | 8.9 | 9.2 | 9.8 | 9.3 |
| 0dB | 5.5 | 7.4 | 5.1 | 5.8 | 5.6 | 6.3 | 6.7 | 6.0 |
| −5dB | 1.8 | 3.5 | 1.5 | 2.3 | 2.3 | 2.2 | 3.0 | 2.4 |

Furthermore, a table 3 shows the S/N ratios of the speeches restored in a manner that the noise superimposed signals produced by superimposing the noise data on the 0th to 4th speech data are inputted in the first embodiment comparative system.

TABLE 3

First Embodiment Comparative System

| Input S/N | Ue | Shita | Migi | Hidari | Kaku-dai | Shu-kusho | Waido | Heikin |
|---|---|---|---|---|---|---|---|---|
| 10dB | 11.1 | 12.8 | 10.4 | 11.0 | 10.5 | 10.8 | 11.0 | 11.1 |
| 5dB | 8.8 | 10.7 | 8.3 | 8.8 | 8.5 | 9.2 | 9.4 | 9.1 |
| 0dB | 5.4 | 7.3 | 5.0 | 5.5 | 5.3 | 6.1 | 6.4 | 5.9 |
| −5dB | 1.6 | 3.3 | 1.3 | 1.9 | 2.1 | 1.9 | 2.7 | 2.1 |

Moreover, a table 4 shows the S/N ratios of the speeches restored when the noise superimposed signals produced by superimposing the noise data on the 0th to 4th speech data are inputted in the SS method comparative system.

TABLE 4

SS Method Comparative System

| Input S/N | Ue | Shita | Migi | Hidari | Kaku-dai | Shu-kusho | Waido | Heikin |
|---|---|---|---|---|---|---|---|---|
| 10dB | 10.1 | 10.3 | 11.5 | 9.9 | 9.3 | 9.7 | 9.8 | 10.1 |
| 5dB | 7.0 | 7.2 | 8.9 | 6.9 | 6.4 | 6.6 | 6.7 | 7.1 |
| 0dB | 4.3 | 4.5 | 6.4 | 4.3 | 3.8 | 3.8 | 4.1 | 4.5 |
| −5dB | 2.1 | 2.4 | 4.0 | 2.1 | 1.9 | 1.7 | 2.2 | 2.4 |

Still further, a table 5 shows the S/N ratios of speech restored in a manner that the noise superimposed signals obtained by superimposing the noise data on the 5th to 9th speech data are inputted in the speech restoration system 111 according to this embodiment.

TABLE 5

This Embodiment (Method of Least Square Coefficients)

| Input S/N | Ue | Shita | Migi | Hidari | Kaku-dai | Shu-kusho | Waido | Heikin |
|---|---|---|---|---|---|---|---|---|
| 10dB | 11.8 | 12.9 | 9.7 | 12.5 | 11.4 | 10.0 | 11.4 | 11.5 |
| 5dB | 9.2 | 10.8 | 7.8 | 9.9 | 9.2 | 9.2 | 9.6 | 9.4 |
| 0dB | 5.5 | 7.4 | 4.7 | 6.3 | 5.9 | 6.2 | 6.4 | 6.1 |
| −5dB | 1.9 | 3.2 | 1.3 | 2.6 | 2.0 | 2.4 | 2.8 | 2.3 |

Furthermore, a table 6 shows the S/N ratios of the speeches restored in a manner that the noise superimposed signals produced by superimposing the noise data on the 5th to 9th speech data are inputted in the first embodiment comparative system.

TABLE 6

First Embodiment Comparative System

| Input S/N | Ue | Shita | Migi | Hidari | Kaku-dai | Shu-kusho | Waido | Heikin |
|---|---|---|---|---|---|---|---|---|
| 10dB | 11.6 | 12.8 | 9.6 | 12.1 | 10.9 | 10.8 | 11.0 | 11.3 |
| 5dB | 9.0 | 10.7 | 7.7 | 9.6 | 8.9 | 9.1 | 9.3 | 9.2 |
| 0dB | 5.4 | 7.2 | 4.6 | 6.0 | 5.7 | 6.0 | 6.2 | 5.9 |
| −5dB | 1.7 | 3.0 | 1.1 | 2.2 | 1.8 | 2.1 | 2.6 | 2.1 |

Moreover, a table 7 shows the S/N ratios of the speeches restored when the noise superimposed signals produced by superimposing the noise data on the 5th to 9th speech data are inputted in the SS method comparative system.

TABLE 7

SS Method Comparative System

| Input S/N | Ue | Shita | Migi | Hidari | Kaku-dai | Shu-kusho | Waido | Heikin |
|---|---|---|---|---|---|---|---|---|
| 10dB | 9.9 | 10.1 | 11.3 | 10.1 | 9.5 | 9.8 | 9.7 | 10.1 |
| 5dB | 6.9 | 7.1 | 8.7 | 7.1 | 6.6 | 6.7 | 6.7 | 7.1 |
| 0dB | 4.1 | 4.4 | 6.2 | 4.6 | 4.0 | 3.9 | 4.3 | 4.5 |
| −5dB | 2.0 | 2.3 | 3.8 | 2.4 | 2.1 | 1.8 | 2.4 | 2.4 |

As obvious from the above tables 2 to 7, the speech restoration system 111 according to this embodiment which based upon the method of least square coefficients can output the most excellent restored speech. To put it concretely, in the speech restoration system 111 according to this embodiment, the S/N ratio is higher by 0.1 to 0.3 dB as compared with that of the first embodiment comparative system, and is higher by 1 to 2 dB as compared to that of the SS method comparative system. The weight coefficients (a, b, g)=(0.518, 0.450, 0.479) used here are determined on the basis of the 0th to 4th data, while the S/N ratio can also improve even if using the 5th to 9th data being the unknown data. In addition, the comparison between the S/N ratios is made through the use of (7 words)×(4 S/N ratios)×(10 speeches)=280 data in total, nevertheless the number of data on the basis of which the S/N ratio of the speech due to the first embodiment comparative system is superior to that of the speech restoration system according to this embodiment is only 5. This signifies that the speech restoration system 11 according to this embodiment has a low data dependency and can produce an extremely stable restoration result.

Secondly, a description will be made hereinbelow of the experiment B on the sense of hearing. In this experiment B, the comparison between the senses of hearing (ease of hearing) is made in such a manner that a plurality of listeners listen to the speeches restored by the speech restoration system according to this embodiment and the first embodiment comparative system.

More specifically, an experiment comprising the following two steps was conducted. In this experiment, the weight coefficients a, b, g used in the weighted mean calculation section 115 of the speech restoration system 111 according to this embodiment are the weight coefficients (a=0.518, b=0.450, g=0.479) used for the above-described experiment A.

In the step 1, a noise is superimposed on speech data of a place name "Hokkaido Sapporo-shi Toyohira-ku" generated by one male speaker and one female speaker to produce noise superimposed speeches whose S/N ratio is 5 dB. Further, these noise superimposed speeches are inputted to the speech restoration system 111 according to this embodiment and the first embodiment comparative system to restore the speeches. Accordingly, the following four speech data are produced. The first speech data is a speech obtained by restoring the speech of the male speaker by the speech restoration system 111 according to this embodiment, the second speech data is a speech obtained by restoring the speech of the male speaker by the first embodiment comparative system, the third speech data is a speech attained by restoring the speech of the female speaker by the speech restoration system 111 according to this embodiment, and the fourth speech data is a speech attained by restoring the speech of the female speaker by the first embodiment comparative system.

In the step 2, 10 people (examinees) listen to the aforesaid four speech data to judge which is superior through the comparison therebetween. More specifically, the people first listen to the first and second speech data to give the easy-to-hear speech data to 2 points and give both to 1 point if there is no difference therebetween. Subsequently, the people listen to the third and fourth speech data and give the points in the same way. Then, the sum of the points given for each of the speech data is calculated so that the superiority on the sense of hearing is judged on the basis of the magnitude of the total point. A table 8 shows the results of the experiment B. As obvious from this table 8, regardless of the speech of the male or female speaker, the speeches restored by the speech restoration system 111 according to this embodiment get higher total point than that of the first embodiment comparative system, thus providing the ease of hearing and an excellent sense of hearing. In this table 8, the left sides the male speech and the female speech signify the speech data restored by the first embodiment comparative system while the right sides thereof show the speech data restored by the speech restoration system 111 according to this embodiment.

TABLE 8

| Results of Experiment | | | | |
|---|---|---|---|---|
| | Male Speech | | Female Speech | |
| Examinee | 2nd Data | 1st Data | 4th Data | 3rd Data |
| 1 | 0 | 2 | 1 | 1 |
| 2 | 0 | 2 | 0 | 2 |
| 3 | 0 | 2 | 0 | 2 |
| 4 | 0 | 2 | 0 | 2 |
| 5 | 1 | 1 | 0 | 2 |
| 6 | 0 | 2 | 2 | 0 |

TABLE 8-continued

| Results of Experiment | | | | |
|---|---|---|---|---|
| | Male Speech | | Female Speech | |
| Examinee | 2nd Data | 1st Data | 4th Data | 3rd Data |
| 7 | 0 | 2 | 1 | 1 |
| 8 | 0 | 2 | 1 | 1 |
| 9 | 1 | 1 | 1 | 1 |
| 10 | 0 | 2 | 0 | |
| Total | 2 | 18 | 6 | 14 |

Figure 16:
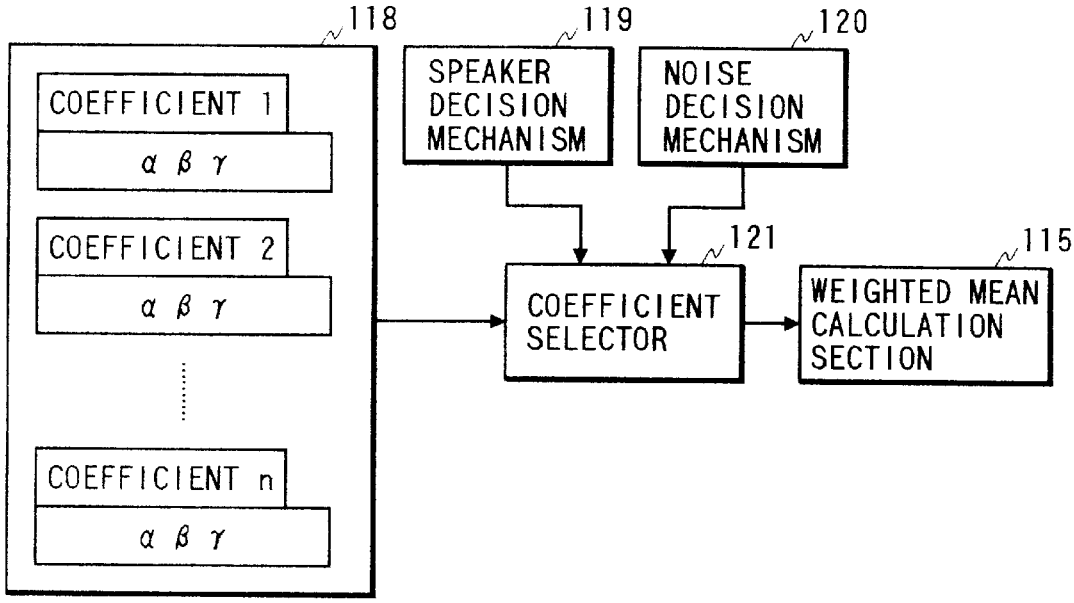
FIG. 16 is a block diagram showing a principal portion of a speech restoration system according to a sixth embodiment of this invention.

FIG. 16 shows a speech restoration system according to a sixth embodiment of the present invention. A description will be made hereinbelow of the difference from the above-described fifth embodiment. Parts corresponding to those in the fifth embodiment are marked with the same numerals. This embodiment is made such that a plurality of sets of weight coefficients each set comprising three weight coefficients $\alpha$, $\beta$ and $\gamma$ are prepared so that the optimal weight coefficient data is selected and used for coping with the situation in which the environment in which the speech restoration system 111 is put to use intensively varies to make it impossible, for example, to specify the speaker or the noise. As shown in FIG. 16 a coefficient database 118 is provided which stores a plurality of sets of weight coefficient data (coefficient 1, coefficient 2, . . . , coefficient n) each set comprising the weight coefficients $\alpha$, $\beta$ and $\gamma$. In addition, there are provided a speaker decision mechanism 119 for deciding a speaker and a noise decision mechanism 120 for judging the kind of noise. In this case, the speaker decision mechanism 119 preferably receives the voice estimation value outputted from the neural network arithmetic section 114 to automatically decide the speaker on the basis of the inputted voice estimation value. Further, the noise decision mechanism 120 preferably receives the noise estimation value outputted from the neural network arithmetic section 114 to automatically judge the kind of noise on the basis of the inputted noise estimation value.

The decision results due to the speaker decision mechanism 119 and the noise decision mechanism 120 are given to a coefficient selector 121. This coefficient selector 121 selects the optimal weight coefficient data from the plurality of weight coefficient data (coefficient 1, coefficient 2, . . . , coefficient n) stored in the coefficient database 118 on the basis of the speaker decision result and the noise kind decision result and supplies the selected weight coefficient data to the weighted mean calculation section 115. The arrangement of the sixth embodiment other than the above description is the same as that of the fifth embodiment.

Thus, the sixth embodiment can also exhibit the same effects as those of the first embodiment. Particularly, since in the sixth embodiment the optimal weight coefficient data is selected and used on the speaker decision result and the noise kind decision result, even if the use environment intensively varies, the speech restored by the weighted mean calculation section 115 becomes closer to the original speech.

In this embodiment, for the speaker decision, the speaker decision mechanism 119 can distinguish between a male speaker and a female speaker (sexual decision), decides the personal name of the speaker, or judge the property or nature (head voice or chest voice) of the voice of the speaker. For the sexual decision of the speaker, it is preferable that the weight coefficient data corresponding to the sexes are stored in the coefficient database 118. In a similar way, it is preferable that for the decision of the personal name, the weight coefficient data corresponding to the personal names are stored coefficient database 118, and for the decision of the nature of the voice of the speaker, the weight coefficient data corresponding to the voice natures are stored therein.

Although in the above-described sixth embodiment the speaker decision mechanism 119 is made to automatically decide the speaker, it is also possible that a plurality of operating switches for indicating speakers are provided so that the speaker is specified through the operation of these operating switches. In addition, it is also appropriate that in place of the automatical decision of the kind of noise by the noise decision mechanism 120, a plurality of operating switches for indicating the kinds of noises are provided so that the noise kind is indicated through the operation of these switches. Further, although in the sixth embodiment the speaker decision mechanism 119 and the noise decision mechanism 120 are provided to judge both the speaker and noise kind, it is also possible that any one of the speaker decision mechanism 119 and the noise decision mechanism 120 is provided to decide one of the speaker and the kind of noise.

Figure 17:
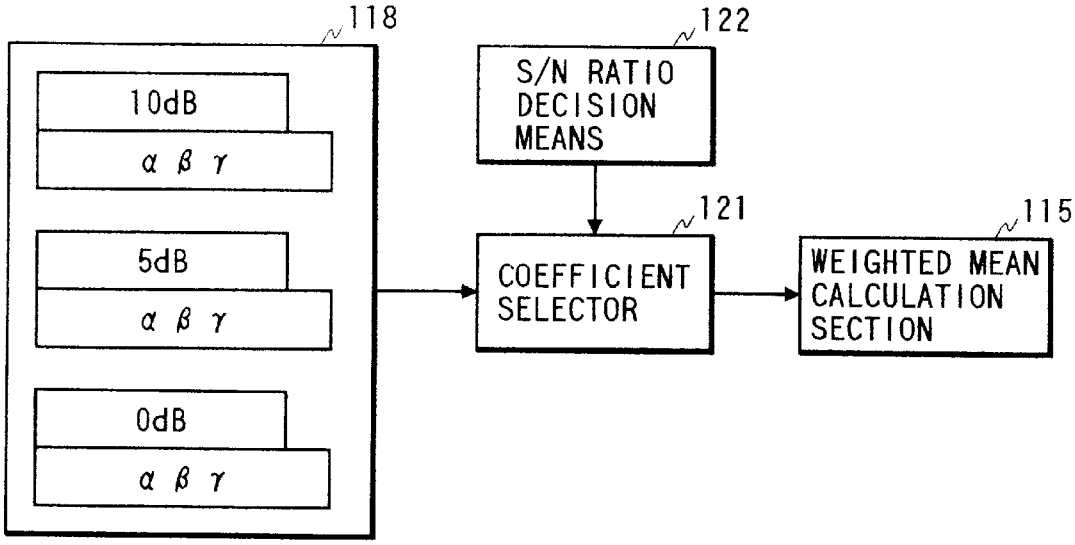
FIG. 17 is a block diagram showing a principal portion of a speech restoration system according to a seventh embodiment of this invention.

As factors to affect the weight coefficients α, β and γ, in addition to the aforesaid speaker and noise, there is the S/N ratio of the noise superimposed speech inputted. It has been known that it is generally preferable that, as the S/N ratio of the noise superimposed speech decreases, the weight coefficients a and b are made smaller while the weight coefficient g is made larger. FIG. 17 shows an arrangement of a speech restoration system according to a seventh embodiment of this invention, which is designed taking this fact into consideration. In the seventh embodiment, parts corresponding to those in the sixth embodiment are marked with the same numerals.

In the seventh embodiment, as shown in FIG. 17 a coefficient database 118 stores a plurality of sets of weight coefficient data (for example, weight coefficient data for 10 dB, weight coefficient data for 5 dB and weight coefficient data for 0 dB) each set comprising the weight coefficients α, β and γ in relation to the S/N ratios. In addition, an S/N ratio decision means 122 is provided which judges the S/N ratio of the inputted noise superimposed speech. This S/N ratio decision means 122 calculates the mean power of each of the voice estimation values and the noise estimation values separated and extracted by a neural network arithmetic section 114 and further calculates the ratio of these mean powers to estimate that the calculated mean power ratio corresponds to the S/N ratio of the noise superimposed speech. In this case, when the voice estimation values and the noise values are respectively taken to be $s_{out}(t)$ and $n_{out}(t)$ and the mean powers of the voice estimation values and the noise estimation values are respectively taken as Es and En, the mean powers Es and En are calculated in accordance with the following equation.

$$Es = \sum_{t=1}^{L} s_{out}(t)^2 / L$$

$$En = \sum_{t=1}^{L} n_{out}(t)^2 / L$$

The value of the mean power ratio Es/En is estimated as being the S/N ratio of the noise superimposed speech. In this embodiment, the S/N ratio decision means 122 organizes a mean power ratio calculation means, and the neural network arithmetic section 114 and the S/N ratio decision means 22 constitute an S/N ratio estimation unit.

Moreover, a coefficient selector 121 receives the S/N ratio estimation value (to put it concretely, the value of the mean power ratio Es/En) from the S/N ratio decision means 122 to select the weight coefficient data for the S/N ratio closest to the S/N estimation value from the plurality of sets of weight coefficient data stored in the coefficient database 118, and supplies the selected weight coefficient data to a weighted mean calculation section 115. The arrangement of the seventh embodiment other than the above description is the same as that of the sixth embodiment. The seventh embodiment can also provide the same effects as those of the sixth embodiment.

Figure 18:
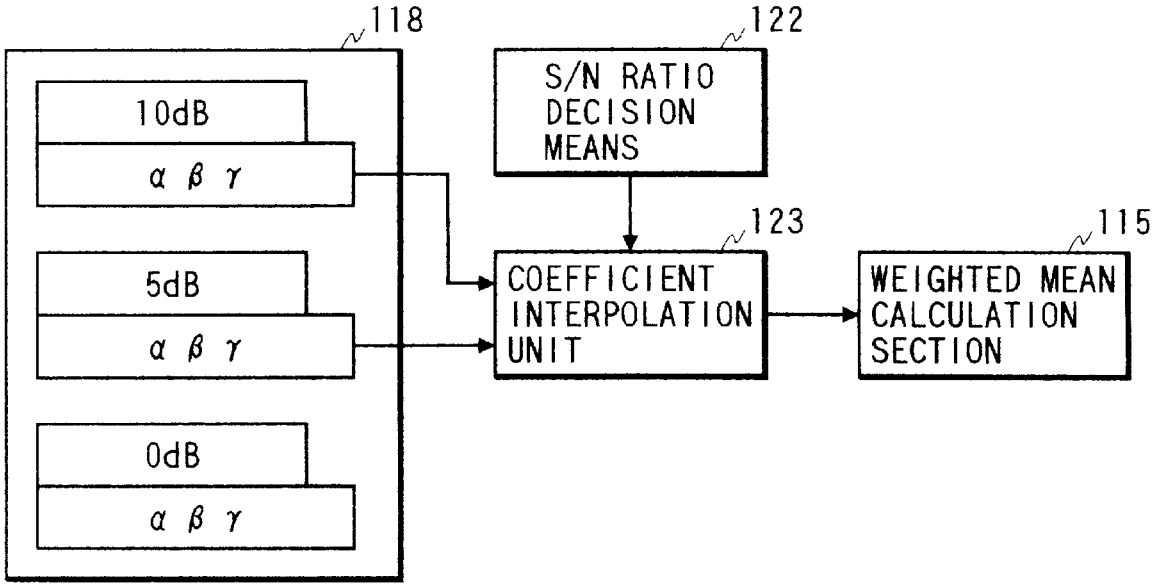
FIG. 18 is a block diagram showing a principal portion of a speech restoration system according to an eighth embodiment of this invention.

FIG. 18 is an illustration of an arrangement of a speech restoration system according to an eighth embodiment of this invention. The description of this eighth embodiment will be made of only the difference from the seventh embodiment. Parts corresponding to those in the seventh embodiment are marked with the same numerals. In this eighth embodiment, a coefficient interpolation unit 123 is provided in place of the coefficient selector 121. This coefficient interpolation unit 123 performs the linear interpolation on a plurality of sets of weight coefficient data (a plurality of sets of weight coefficient data corresponding to a plurality of S/N ratios) using the properties of the weight coefficients α, β and γ with respect to the S/N ratios of the noise superimposed speeches to calculate the weight coefficients α, β and γ corresponding to the estimated S/N ratio and supplies the calculated weight coefficients α, β and γ to a weighted mean calculation section 115.

Figure 19:
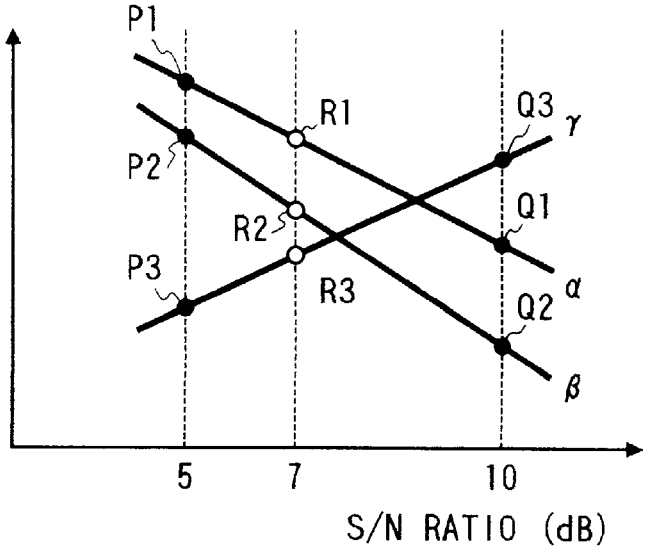
FIG. 19 is an illustration useful for describing a linear interpolation calculation for the load coefficients $\alpha$, $\beta$ and $\gamma$.

Referring to FIG. 19, a description will be taken hereinbelow of the linear interpolation calculation by the coefficient interpolation unit 123. Let it be assumed that the S/N ratio estimated by the S/N ratio decision means 122 is 7 dB. In this instance, as shown in FIG. 19, the linear interpolation (proportional calculation) is made on the basis of the weight coefficients α, β and γ (point P1, point P2 and point P3) for 5 dB and the weight coefficients α, β, and γ (point Q1, point Q2 and point Q3) for 10 dB to obtain the weight coefficients α, β and γ (point R1, point R2 and point R3) for 7 dB.

The arrangement of the eighth embodiment except the above-described arrangement is the same as that of the seventh embodiment. This eight embodiment can exhibit the same effects of those of the seventh embodiment. Particularly, since in the eighth embodiment the weight coefficients α, β and γ corresponding to the estimated S/N ratio are calculated through the linear interpolation, it is possible to more suitably set the weight coefficients α, β and γ for the S/N ratio.

In the seventh and eighth embodiments, it is also appropriate that in addition to the S/N ratio decision means 122 a speaker decision mechanism 119 and a noise decision mechanism 120 are further provided to decide the speaker and the kind of noise so that the most suitable weight coefficient data are selected in relation to the decided speaker, the decided kind of noise and the decided S/N ratio. Further, although in the above-mentioned embodiments the RNN is employed as the neural network used in the neural network arithmetic section 114, it is also possible to employ, for example, a layered neural network in place of it.

Figure 20:
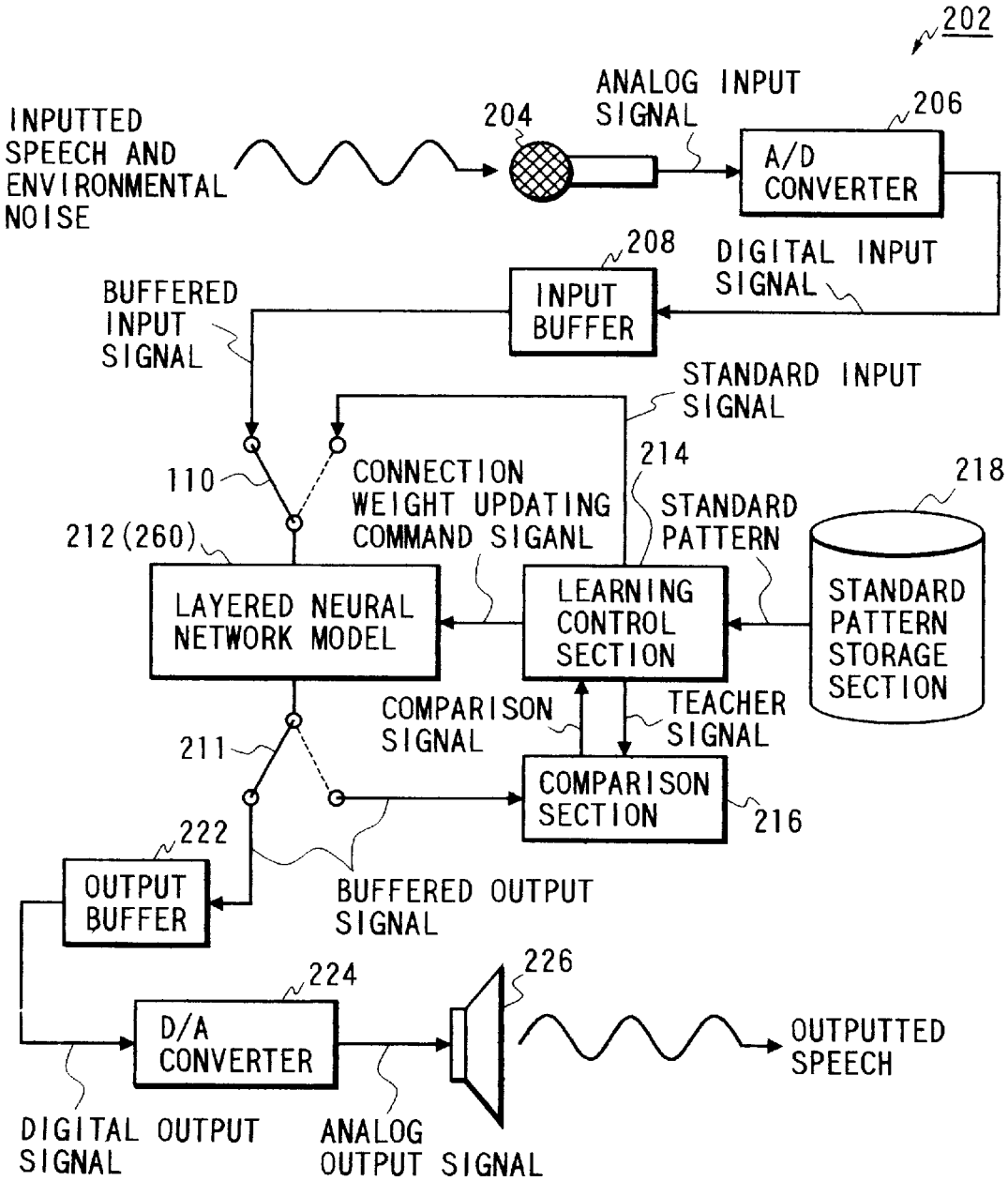
FIG. 20 is an illustration of an arrangement of a signal processing system incorporating a layered neural network model based upon a high sampling frequency method according to an ninth embodiment of the present invention.

FIG. 20 is an arrangement of a signal processing system, designated at numeral 202, which incorporates a layered neural network model realized as a speech filter to remove noises from an input aural signal according to a high sampling frequency method, according to a ninth embodiment of the present invention. This signal processing system 202 is provided with a microphone 204 serving as an acoustic wave reception means, an A/D converter 206, an input buffer 208, change-over switches 210, 211, a layered neural network model 212, a learning control section 214, a comparison section 216, a standard pattern storage section 218, an output buffer 222, a D/A converter 224 and a speaker 226 serving as an acoustic wave outputting means. An amplifier (not shown) is provided in both the microphone 204 and speaker 226. Further, the layered neural network model 212 includes rewritable or reloadable memories such as a RAM and an EEPROM. Still further, the learning control section 214, the comparison section 216 and the standard pattern storage section 218 can be constructed as computer units.

This signal processing system 202 operates in accordance with two modes: a learning mode and an execution mode. For the learning mode, through the use of the change-over switch 210, the input side of the layered neural network model 212 is switched to the learning control section 214, while through the use of the change-over switch 211 the output side of the layered neural network model 212 is switched to the comparison section 216. In the learning mode, the learning control section 214 outputs a standard input signal to the layered neural network model 212, and the comparison section 216 compares the output of the layered neural network model 212 due to the standard input signal with a teacher signal from the learning control section 214. The learning control section 214 receives the comparison result as a comparison signal and outputs a connection weight updating command signal to the layered neural network model 212. In response to this connection weight updating command signal, in the layered neural network model 212 the connection weights between the units are adjusted. Thus, in the layered neural network model 212, the learning is conducted in terms of the input and output characteristic to extract an aural signal from the noise superimposed aural signal inputted through the microphone 204.

The A/D-converted aural signal used as the learning data in the learning control section 214 is stored in the standard pattern storage section 218. This aural signal is referred to as a standard pattern. Each of the standard patterns is made up of a combination of a standard input signal and a teacher signal. The standard input signal is produced in such a manner that the noise superimposed speech with a given time length is sampled at a sampling frequency f0, while the teacher signal is produced by sampling a speech included therein at a sampling frequency 2f0. In this ninth embodiment, the sampling frequency for the teacher signal is twice the requirements sampling frequency f0. When the number of samples constituting the teacher signal in the FIG. 38 prior art is taken as P, the number of samples organizing the teacher signal due to the high sampling frequency method in this embodiment becomes 2P.

Figure 21:
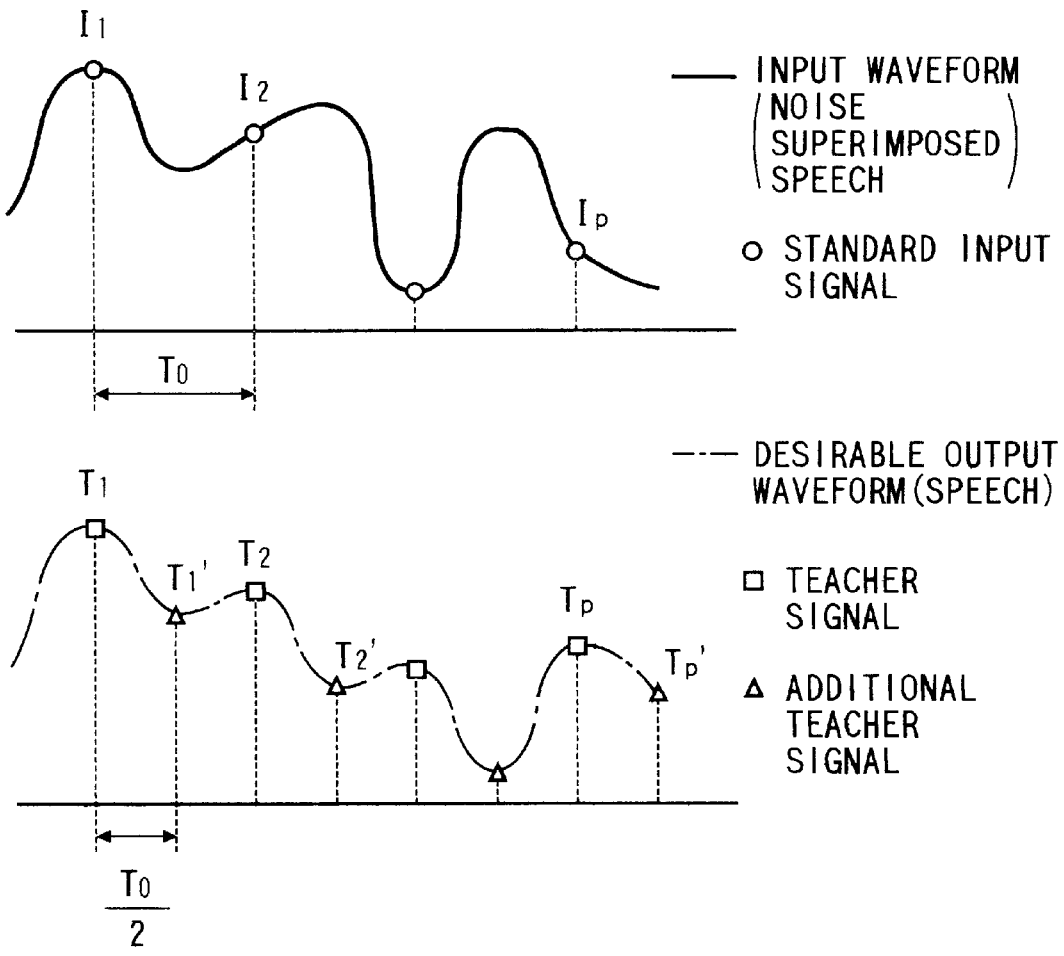
FIG. 21 is an illustration useful for describing output configurations of a standard pattern from a learning control section in the ninth embodiment.

FIG. 21 shows output configurations of a standard pattern from the learning control section 214 based upon the high sampling frequency method in this embodiment. The output configurations thereof in the prior art are shown in FIG. 4 for the purpose of comparison. When the sampled values of the standard input signal are taken as I and the sampled values of the teacher signal are taken as T, the standard pattern due to the high sampling frequency is expressed by the standard input signals: $I_1, I_2, I_3, I_p$ and the teacher signals: $T_1, T_1', T_2, T_2', T_3, T_3', \ldots, T_p, T_p'$ (2P sampled values). On the other hand, the standard pattern due to the prior method is expressed by the standard input signals: $I_1, I_2, I_3, \ldots, I_p$ and the teacher signals: $T_1, T_2, T_3, \ldots, T_p$ (P sampled values).

In the standard pattern outputting method based upon the high sampling frequency method, the outputting times of the teacher signals: $T_1, T_2, T_3, \ldots, T_p$ corresponds to the outputting times of the standard input signals $I_1, I_2, I_3, \ldots, I_p$ fixed to a given period T0 (=1/f0). The signals $T_1', T_2', T_3', \ldots, T_p'$ are the teacher signals added by the sampling at the speech sampling frequency 2f0, and the outputting times are set to the times between the respective teacher signals $T_1, T_2, T_3, \ldots, T_p$. If not particularly signified, the signals $T_1, T_1', T_2, T_2', T_3, T_3', \ldots, T_p, T_p'$ are wholly referred to as teacher signals. Further, when the signals $T_1', T_2', T_3', \ldots, T_p'$ are required to be particularly distinguished from each other, they are referred to as additional teacher signals.

Figure 22:
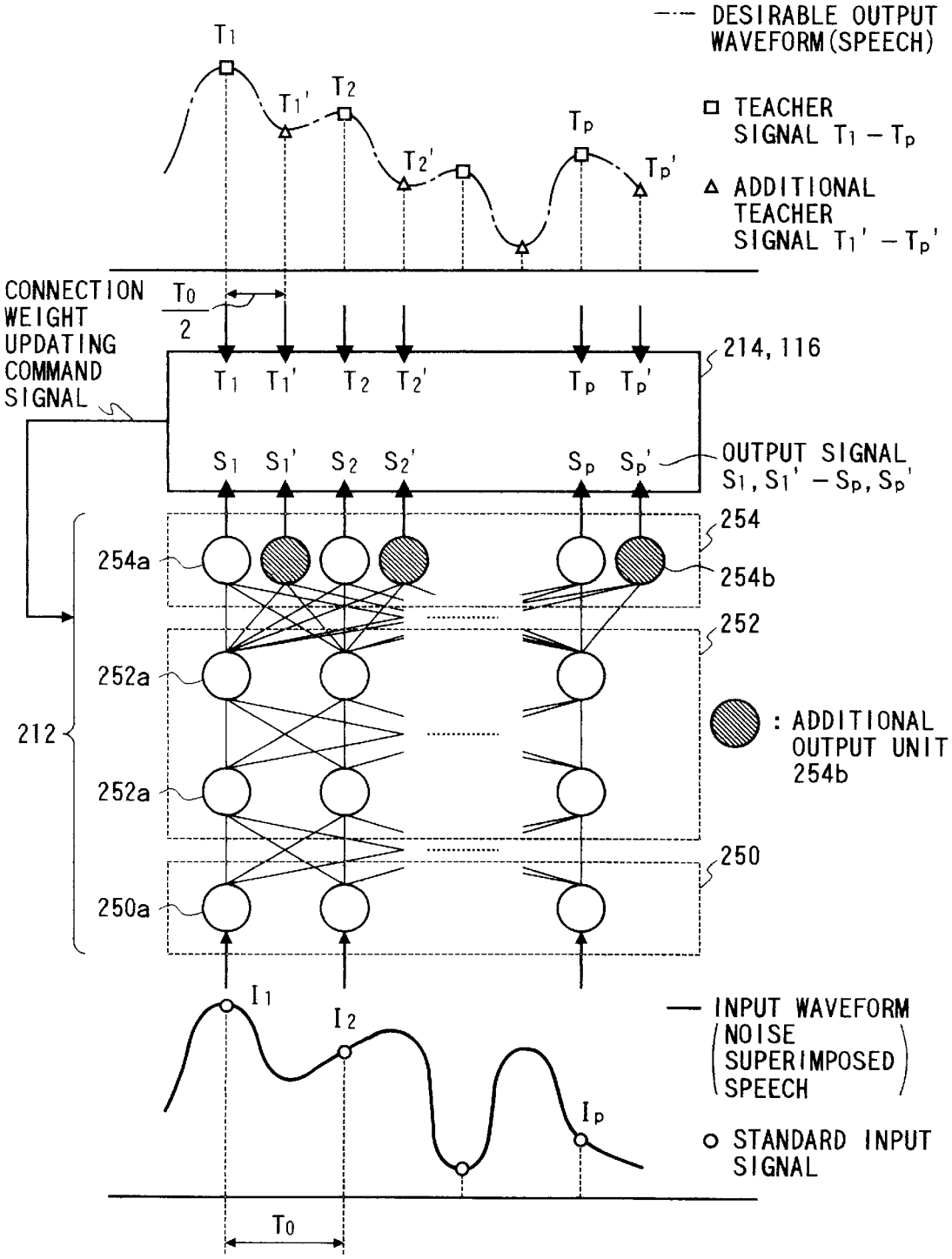
FIG. 22 is an illustration useful for describing a functional arrangement of the layered neural network model in the ninth embodiment.
Figure 38:
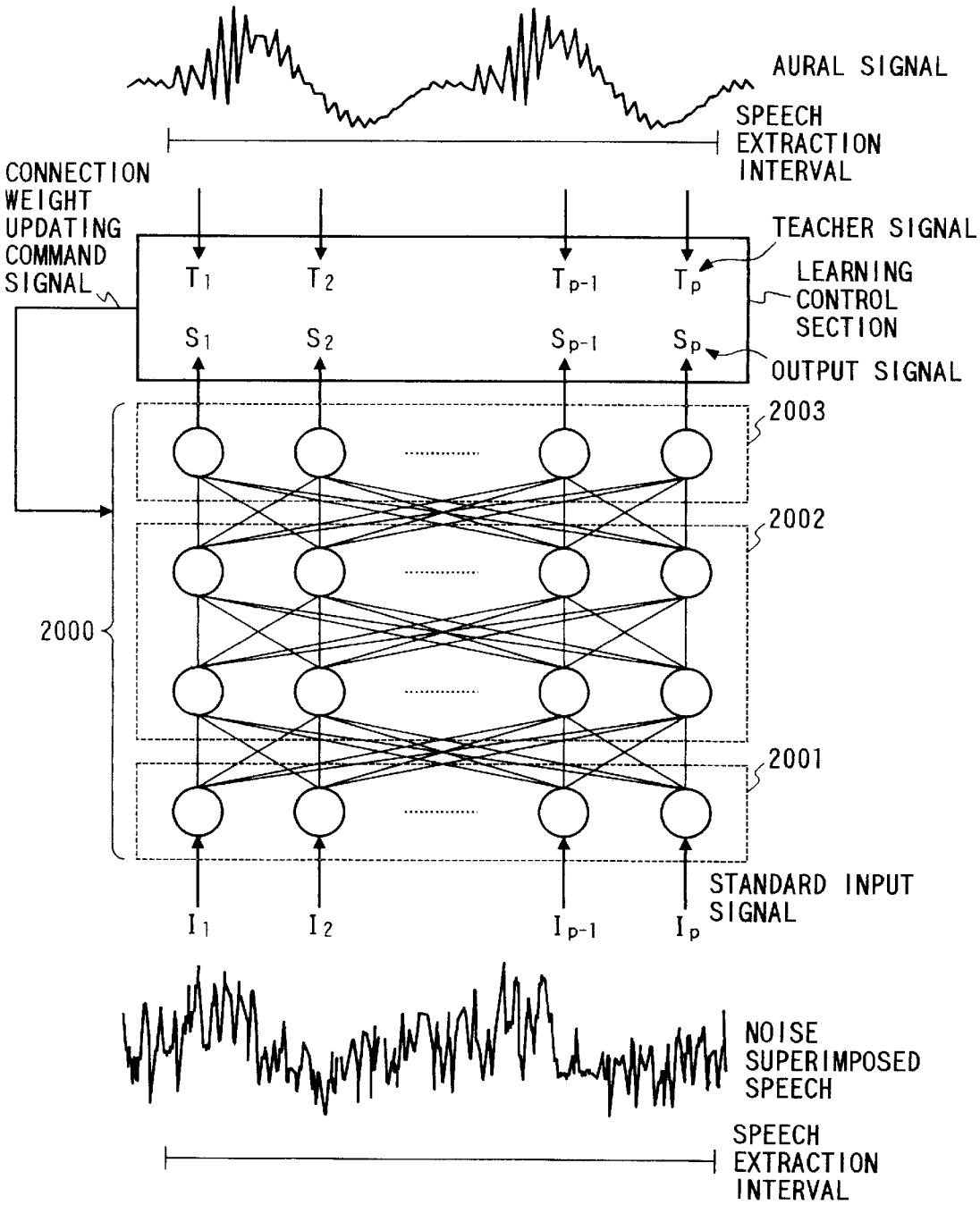
FIG. 38 PRIOR ART
FIG. 38 shows a functional arrangement of a layered neural network model based upon a prior method.
Figure 39A:
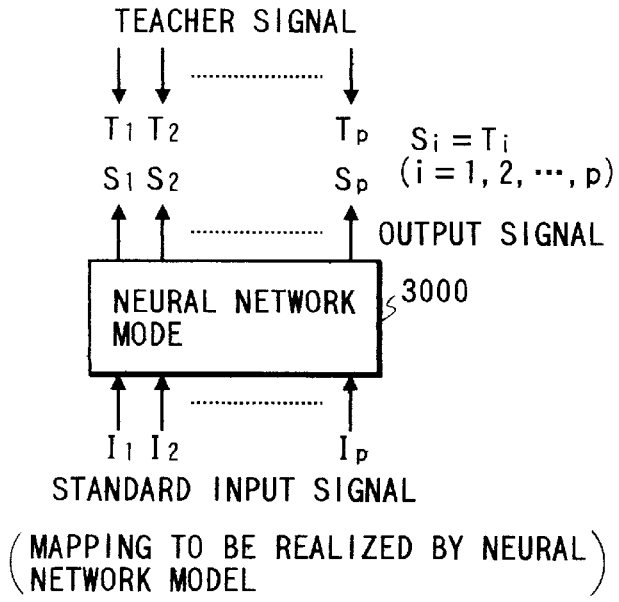
FIG. 39A PRIOR ART
FIGS. 39A to 39C are illustrations for describing the processing of a prior layered neural network model.
Figure 39B:
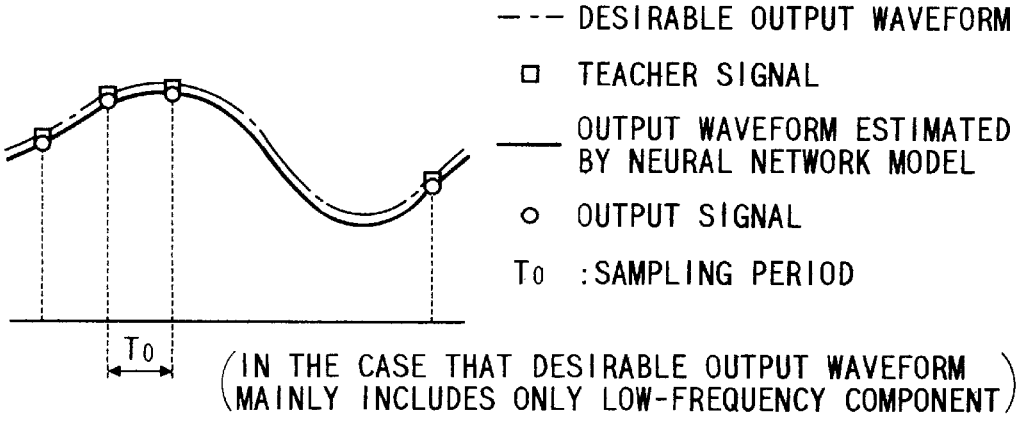
FIG. 39B PRIOR ART
Figure 39C:
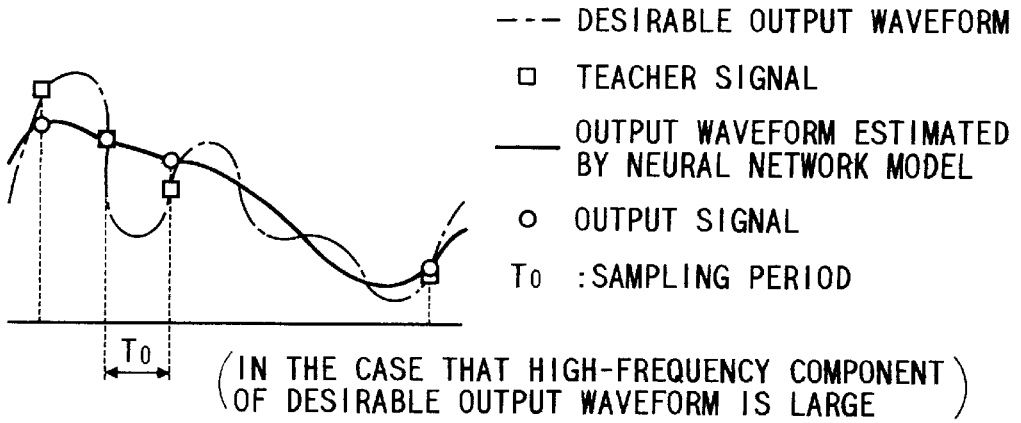
FIG. 39C PRIOR ART
Figure 40:
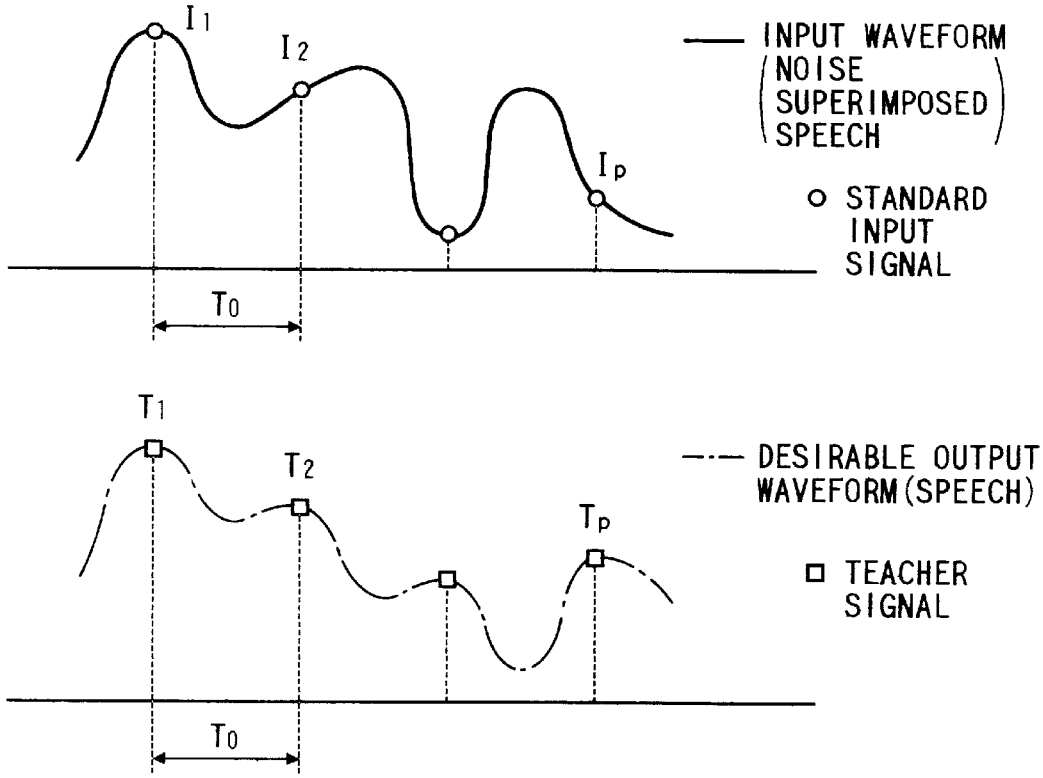
FIG. 40 PRIOR ART
FIG. 40 is an illustration of signals of a prior layered neural network model.

FIG. 22 shows a functional arrangement of the layered neural network model 212which receives the standard input signals I1, I2, I3, . . . , $I_p$ from the learning control section 214. The operation and learning method of the layered neural network model 212 have been written in the document "Parallel Distributed Processing", Vol. 1, Chapter 8, pp. 318–362, MIT press (1986). The layered neural network model 212 is composed of three layers having units (corresponding to neurons): an input layer 250 comprising a single layer, an intermediate layer 252 comprising two layers and an output layer 254 comprising a single layer. The number of input units 250*a* in the input layer 250 is P and the number of output units 254*a* of the output layer 254 is 2P. Because of the addition of the additional teacher signals $T_1', T_2', T_3', \ldots, T_p'$, the number of units in the output layer 254 is increased by P corresponding to additional output units 254*b* for the comparison with the additional teacher signals $T_1', T_2', T_3', \ldots, T_p'$, as compared with the prior output layer 2003 as shown in FIG. 38. if not particularly specified, the ordinary output units 254*a* and the additional output units 254*b* are wholly referred to as output units. In this case, it is possible to appropriately determine the number of intermediate units 252*a*.

A description will be made hereinbelow of the whole procedure of the first executed learning mode in the signal processing system 202. When the standard patterns are taken to be M in number, the learning control section 214 successively derives M standard patterns from the standard pattern storage section 218 and gives P standard input signals $I_1, I_2, I_3, \ldots, I_p$ of the respective standard patterns to the P input units 250*a* of the input layer 250 of the layered neural network model 212. As a result of this input, the layered neural network model 212 outputs 2P output signals $S_1, S_1', \ldots, S_p, S_p'$ through the 2P output units 254*a*, 254*b* of the output layer 254. The comparison section 216 individually compares these 2P output signals $S_1, S_1', \ldots, S_p, S_p'$ with the 2P teacher signals $T_1, T_1', \ldots, T_p, T_p'$ given from the learning control section 214 and outputs the comparison results as comparison signals to the learning control section 214. On the basis of the comparison signals, the learning control section 214 adjusts the weights on connections between the units 250*a*, 252*a*, 254*a* of the layers 250, 252 and 254 so that the 2P output signals $S_1, S_1', \ldots, S_p, S_p'$ from the output layer 254 of the layered neural network model 212 coincide with the 2P teacher signals $T_1, T_1', \ldots, T_p, T_p'$, respectively, thus making the layered neural network model 212 learn.

The above-described learning is conducted for all the M standard patterns until the output signals $S_1, S_1', \ldots, S_p, S_p'$ coincide with the teacher signals $T_1, T_1', \ldots, T_p, T_p'$, respectively, and the learning is completed after the coincidence therebetween. Owing the above-mentioned learning, the layered neural network model 212 can obtain a mapping to suppress the noises of the input signal and to selectively take out and output only the aural signal.

After the completion of the learning, in order to use the layered neural network model 212 in the execution mode, the additional output units 254*b* and the connections between the additional output units 254*b* and the units coupled thereto are removed from the output layer 254 of the layered neural network model 212 so as to produce the layered neural network model 212 in which the input units 250*a* of the input layer 250 coincide in number (P) with the output units 254*a* of the output layer 254.

Figure 23:
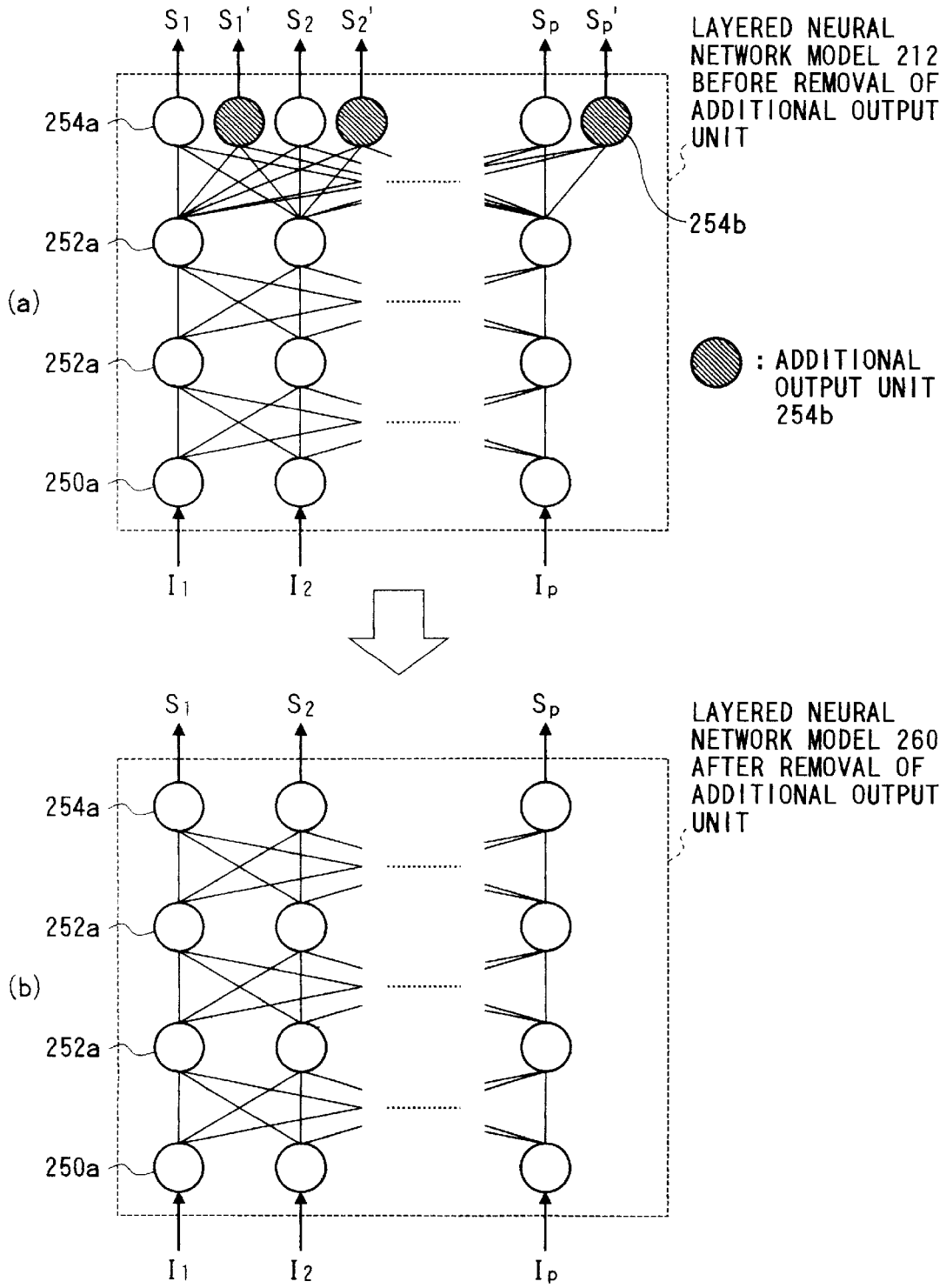
FIG. 23 is an illustration available for explaining an arrangement of the layered neural network before the removal of an additional output unit (at a learning mode) and after the removal (at an execution mode) in the ninth embodiment.

FIG. 23 shows an arrangement of the layered neural network model 212 (indicated by (a)) before the removal of the additional output units 254*b* (the learning mode) and an arrangement of a layered neural network model 260 (indicated by (b)) after the removal of the additional output units 254*b* (the execution mode). As compared with the layered neural network model 212 in the learning mode, in the layered neural network model 60 in the execution mode, the number of output units 254*a*, 254*b* decreases from 2P to P because of the removal of the additional output units 254*b* and becomes equal to that of the input units 250*a*. Accordingly, the layered neural network model 260 takes a P input and P output structure. At this time, the layered neural network model 260 has the same arrangement as the FIG. 38 prior layered neural network model 2000 except for the states of the connection weights between the units 250*a*, 252*a* and 254*a*.

In the execution mode, the input and output of the layered neural network model 260 are switched to the external input and output through the change-over switches 210, 211 in a state where the connection weights of the layered neural network model 260 with the P input and P output structure obtained in the learning mode are fixed. That is, the layered neural network model 260, in place of the learning control section 214, receives the input signals from the input buffer 202 side and, in place of the comparison section 216, outputs the output signals to the output buffer 222 side.

In the case that the signal processing system 202 processes the actual noise superimposed speech in this execution mode, first an acoustic wave including an inputted speech and an environmental noise is taken by the microphone 204 and fed as an analog input signal to the A/D converter 206. The A/D converter 206 performs the discrete processing of the analog input signal at the sampling frequency f0 to output it as a digital input signal. The input buffer 208 successively accepts the P digital input signals and outputs a buffered input signal comprising the P parallel input signals to the layered neural network model 260. The layered neural network model 260 receives the buffered input signal to extract only the aural signal therefrom and outputs the P parallel output signals from the output units 254*a* as buffered output signals to the output buffer 222. The output buffer 222 receives the P output signals and sends them as digital output signals one by one in order to the D/A converter 224. The D/A converter 224 receives that aural signal and converts it into an analog output signal at the sampling frequency f0, with the analog output signal being outputted as a speech from the speaker 226.

In the signal processing system 202 according to this ninth embodiment, in the execution mode after the learning, the change-over switches 210, 211, the learning control section 214, the comparison section 216 and the standard pattern storage section 218 can be removed to produce a speech filter dedicated arrangement.

As described above, in the case of the high sampling frequency method this signal processing system 202 employs, the number of output units of the layered neural network model 212 for the input and output of the time series signal (in this case, aural signal) is doubled and the sampling frequency for the teacher signals given at the learning is heightened to twice the requirements sampling frequency f0, thus increasing the desirable waveform information. For this reason, the layered neural network model 212 can easily learn the weights on connections and can further realize the connection weights to make the high-frequency component included in the output waveform more accurately follow the desirable waveform.

In addition, since particularly the neural network model is of the layered type, after the completion of the learning the additional output units 254*b* and the connections thereto can be removed and in the execution mode the model can be the same in arrangement as the prior neural network model except for the weights on connections. This signifies that the calculation amount and memory use amount of the layered neural network model 260 in the execution mode become equal to those of the prior model. Thus, according to this embodiment, the learning becomes easier and the waveform follow-up characteristic becomes more excellent, nevertheless the signal processing system 202 can be offered at a low cost as well as the prior art.

Moreover, the above-described ninth embodiment is not limited to setting the sampling frequency for the desirable waveform to twice the requirements sampling frequency f0, but it is also possible to arbitrarily employ twice or more integer times of the requirements sampling frequency. In general, if the sampling frequency for the teacher signal is multiplied by k (k: an integer being 2 or more), the layered neural network model is made such that P input k×P output (P output units+(k−1)×P additional output units). After the completion of the learning, the connections to the (k−1)×P additional output units are removed so that the layered neural network model has the P input and P output structure for the processing of the actual signal. Thus, more improved treatment for high-frequency components is possible. Moreover, the multiple of the sampling frequency is not always limited to twice or more integer times, if using the sampling frequency for the teacher signal which satisfies the relation of the teacher signal sampling frequency>the requirements sampling frequency, the waveform information can increase and the same effects are obtainable.

Figure 25:
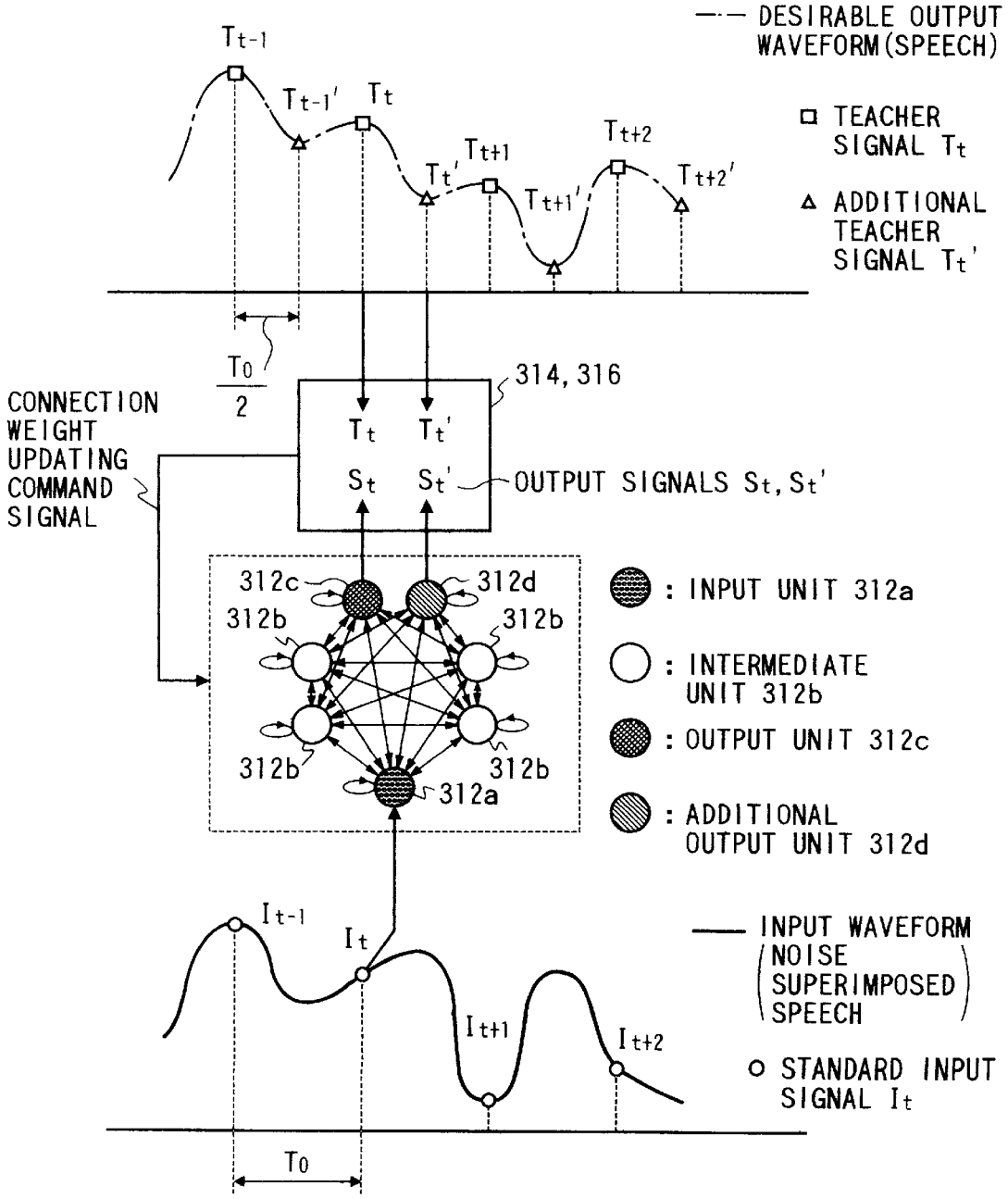
FIG. 25 is an explanatory illustration of a functional arrangement of the recurrent neural network in the tenth embodiment.

Furthermore, a description will be made hereinbelow of a signal processing system according to a tenth embodiment of the present invention. A big difference between this tenth embodiment and the above-described ninth embodiment is that a recurrent neural network 312 is used in place of the layered neural network model. FIG. 25 shows an arrangement of a signal processing system, generally designated at numeral 302, according to the tenth embodiment of this invention. This arrangement is the same as the arrangement of the ninth embodiment except for the use of the recurrent neural network 312 and the removal of the input buffer 208 and the output buffer 222. This signal processing system 302 operates in two modes: a learning mode and an execution mode, as well as the signal processing unit 202 according to the ninth embodiment. The details of the operation and learning method of the recurrent neural network have been written in, for example, Sato, M : "A learning algorithm to teach spatio-temporal patterns to recurrent neural networks", Biol. Cybern., 62, pp. 259–263 (1990) and Japanese Patent Application No. 6-288747 (not published). The recurrent neural network is a neural network model which can process a time series signal without buffering by the input buffer 208.

Figure 41:
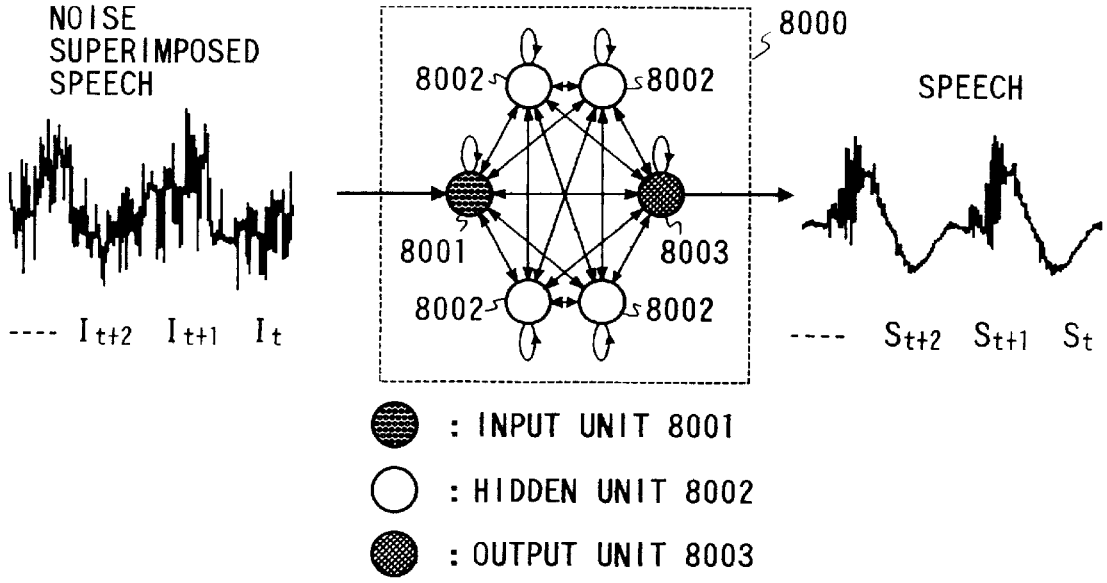
FIG. 41 PRIOR ART
FIG. 41 is an illustration for explaining the processing in a prior recurrent neural network.

An example of the prior noise suppression methods using a recurrent neural network 8000 is shown in FIG. 41. FIG. 41 illustrates the contents in which the recurrent neural network 8000 is made in advance to learn to extract and output a speech from a noise superimposed speech and after the completion of the learning the noise is removed from the input signal through the use of the recurrent neural network 8000. The recurrent neural network 8000 comprises one input unit 8001, one output unit 8003 and intermediate units (hidden units) 8002. The number of intermediate units is appropriately determined. When the sampled values $I_t$, $I_{t+1}$, $I_{t+2}$, . . . obtained by the A/D conversion of a noise superimposed speech at the requirements sampling frequency f0 are successively inputted to the recurrent neural network 8000, the recurrent neural network 8000 derives speech components from the sampled values to successively output them as sampled values $S_t$, $S_{t+1}$, $S_{t+2}$, . . . These sampled values $S_t$, $S_{t+1}$, $S_{t+2}$, . . . are D/A-converted at the requirements sampling frequency f0, thus obtaining a speech.

Figure 42:
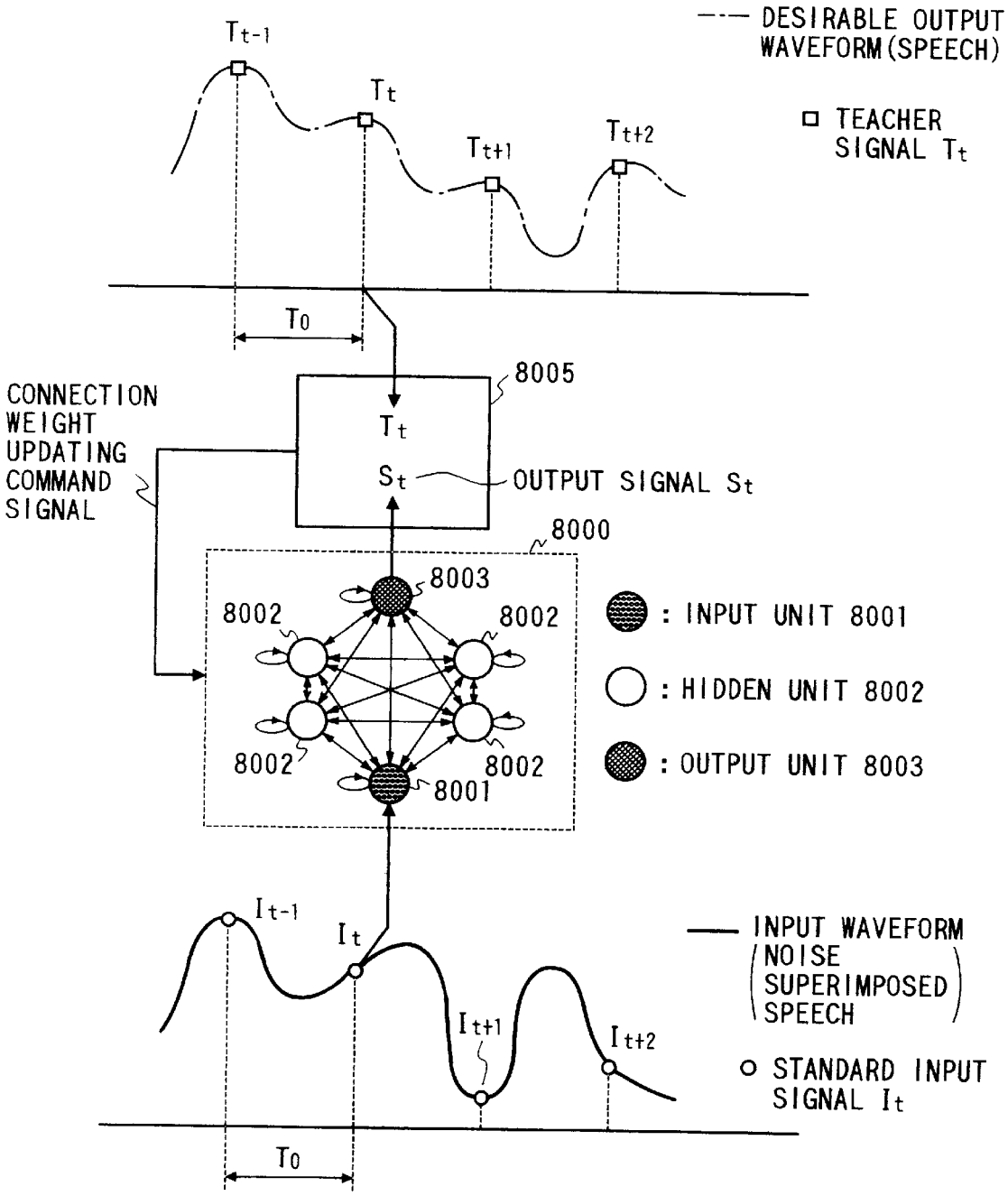
FIG. 42 PRIOR ART
FIG. 42 is an explanatory illustration of a functional arrangement of a prior recurrent neural network.

The learning method for the prior recurrent neural network 8000 is as follows. In the prior method, as shown in FIG. 42, for the standard patterns a noise superimposed speech and a speech included in this noise superimposed speech are respectively sampled at the requirements sampling frequency f0 (sampling period T0=1/f0) to obtain standard input signals and teacher signals. That is, the number of sampled values constituting the standard input signals and the number of sampled values organizing the teacher signals are equal to each other. The number is taken to be L. When the number of standard patterns in the standard pattern storage section is taken to be M, a learning control and comparison section 8005 executes the following operation for each of the M patterns. That is, when the standard input signals and the teacher signals at time t=1, 2, . . . , L are respectively taken as $I_t$ and $T_t$, the learning control and comparison section 8005 gives the standard input signals $I_t$ to the recurrent neural network 8000 in the order of t=1, 2, . . . , L to obtain the output signals $S_t$. Further, the learning control and comparison section 8005 compares the output signals $S_t$ with the teacher signals $T_t$ and then outputs a connection weight updating command signal to the recurrent neural network 8000 on the basis of the comparison result. In the recurrent neural network 8000 the connection weights are updated on the basis of the connection weight updating command so that the output signals $S_t$ coincide with the teacher signals $T_t$. The learning control and comparison section 8005 repeatedly performs this operation till the coincidence between the output signals $S_t$ and the teacher signals $T_t$.

Secondly, referring to FIG. 25, a description will be taken hereinbelow of a learning method of the recurrent neural network based upon the high sampling frequency method according to the tenth embodiment. The difference between the recurrent neural network 312 in this tenth embodiment and the prior recurrent neural network 8000 as shown in FIG. 42 is that in the recurrent neural network 312 an additional output unit 312*d* is provided in addition to an input unit 312*a*, intermediate units 312*b* and an output unit 312*c*, that is, it has 1 input and 2 output structure.

In the learning mode, through change-over switches 310, 311, the standard input signal is inputted from a learning control section 314 into the input unit 312*a*, while output signals from the output units 312*c*, 312*d* are given to a comparison section 316 to be compared with a teacher signal and an additional teacher signal. As the standard input signal, there is used a signal obtained by sampling a noise superimposed speech at the requirements sampling frequency f0 (sampling period T0), and as the teacher signal and the additional teacher signal there are used signals obtained by sampling a speech included in the standard pattern at a sampling frequency 2f0 (sampling period T0/2). When the number of standard patterns in a standard pattern storage section 318 is taken as M, the learning control section 314 and the comparison section 316 perform the following operations for each of the M patterns.

When the number of standard input signal sampled values is taken as L, the standard input signals at time t=1, 2, . . . , L are taken as It, and the teacher signals and the additional teacher signals at time t=1, 2, . . . , L are respectively taken to be $T_t$ and $T_t'$, the learning control section 314 supplies the standard input signals It in the order of t=1, 2, . . . , L to the input unit 312a of the recurrent neural network 312 which in turn, provides output signals $S_t$ through the output unit 312*c* and further provides output signals $S_t'$ through the additional output unit 312*d*. The comparison section 316 compares the output signals $S_t$, $S_t'$ with the teacher signal $T_t$ and the additional teacher signal $T_t'$, respectively. Thereafter, the learning control section 314 receives the comparison results in the form of comparison signals to output a connection weight updating command signal to the recurrent neural network 312 on the basis of the comparison results. In the recurrent neural network 312 the update is made of the weights on connections between the units 312*a*, 312*b*, 312*c* and 312*d* and the weights on connections leading into or returning to the units 312*a*, 312*b*, 312*c* and 312*d*. The learning control section 314 and the comparison section 316 repeatedly perform the above-mentioned operations till the coincidence between the output signals $S_t$, $S_t'$ and the teacher signals $T_t$, $T_t'$.

Figure 24:
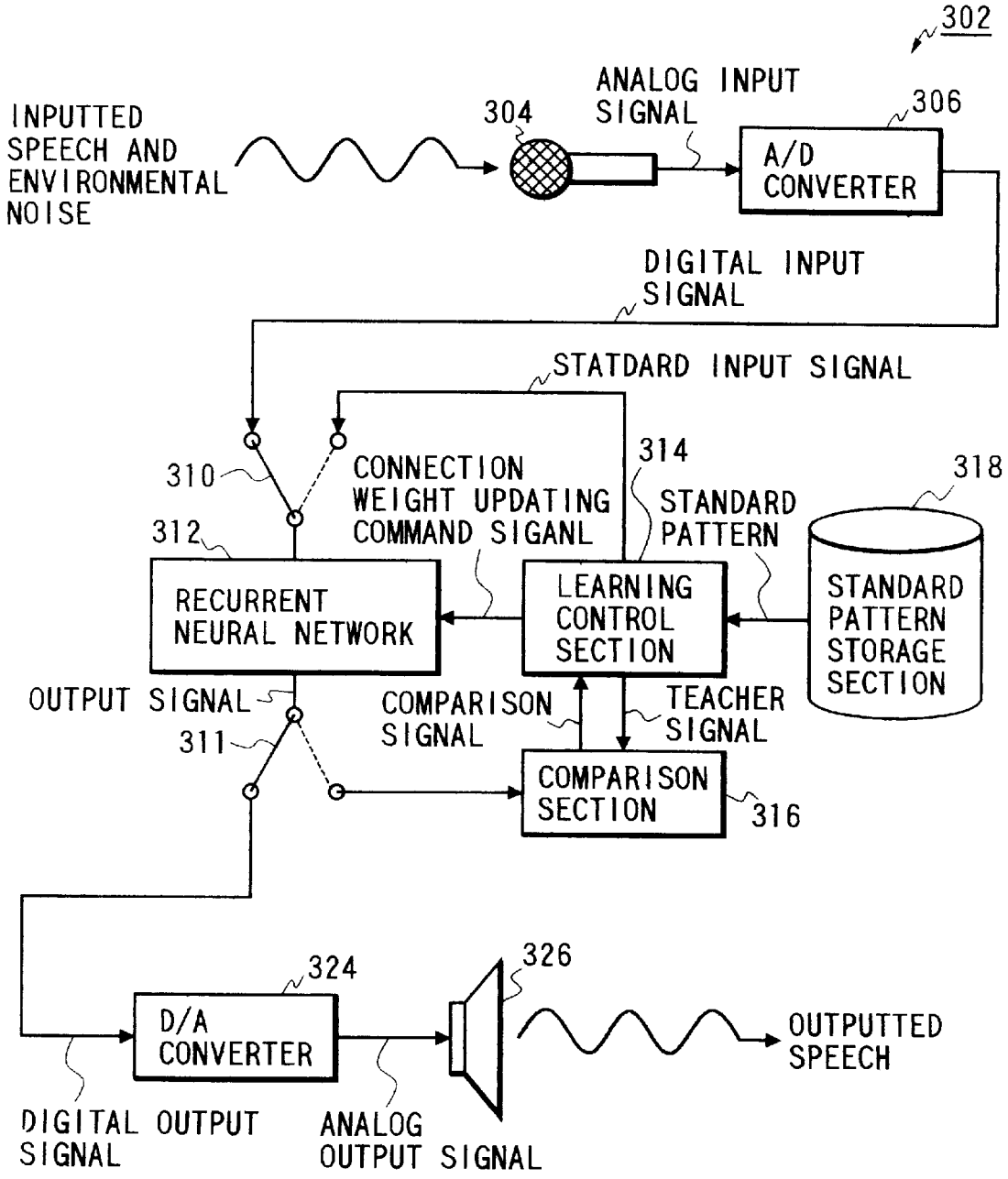
FIG. 24 is an illustration of an arrangement of a signal processing system incorporating a recurrent neural network based on a high sampling frequency method according to a tenth embodiment of this invention.

After the completion of the learning mode, then for the execution mode the connection weights of the 1 input and 2 output recurrent neural network 312 taken in the learning mode are fixed, and through the switching operations of the change-over switches 3110, 311 in FIG. 24, in the signal processing system 302 a signal from a microphone 304 is inputted through an A/D converter 306 into the input unit 312*a* of the recurrent neural network 312. Further, a signal outputted from the output unit 312*c* of the recurrent neural network is outputted through a D/A converter 324 to a speaker 326. In this case, the additional output unit 312*d* is not used as the output unit, that is, the output of the additional output unit 312*d* is fed to the external. When processing the actual noise superimposed speech in the signal processing system 302 which is in the execution mode condition, first the microphone 304 takes in an inputted speech and an environmental noise and outputs them as an analog input signal. The A/D converter 306 performs the discrete processing of the analog input signal at the requirements sampling frequency f0 to produce a digital input signal, with this digital input signal being inputted to the input unit 312*a* of the recurrent neural network 312.

In response to the reception of the digital input signal, the recurrent neural network 312 extracts only an aural signal therefrom and successively sends, through the output unit 312*c*, output signals as digital output signals to the D/A converter 324. The D/A converter 324 D/A-converts the obtained digital output signals into an analog output signal at the requirements sampling frequency f0, with the analog output signal being outputted as an outputted speech through the speaker 326.

As described above, according to the tenth embodiment, in the recurrent neural network which outputs a time series signal according to the high sampling frequency method, for the standard pattern to be given at the learning, the sampling frequency for the teacher signal is set to twice the requirements sampling frequency f0 so as to increase a desirable output waveform information. Accordingly, as well as the above-described ninth embodiment, the easy learning of the recurrent neural network is practicable. In addition, the high-frequency component included in the output of the recurrent neural network can more accurately follow the high frequency component of the desirable output waveform.

Going the other way, since the recurrent neural network is employed as the neural network model, unlike the layered neural network model in the ninth embodiment, difficulty is experience to remove the additional output unit 312*d* and the connection thereto without condition after the completion of the learning. However, the removal is possible if using an arrangement where the additional output unit 312*d* does not send a signal to the other units 312*a,* 312*b* and 312*c.* Even if the additional unit 312*d* and the connections thereto are unremovable in the execution mode, the input unit 312*a* can be one in number as it is, and hence the disadvantages on the memory and the calculation amount coming from the weights on connections are not so serious if taking the gained effects into consideration. Further, in cases where the additional output unit 312*d* does not send a signal to the other units 312*a,* 312*b* and 312*c,* since the additional unit 312*d* and the connections to this additional output unit 312*d* are removable, as well as the above-described ninth embodiment the additional output unit 312*d* and connections thereto can be removed after the completion of the learning so that the system has the same arrangement as that of the prior neural network model except the connection weights in the execution mode. Thus, in the execution mode the calculation amount by the neural network model and the memory using amount can be the same as those due to the prior method. Accordingly, as compared with the prior system, the learning becomes easier and the waveform follow-up characteristic for the high-frequency components is more improved, nevertheless the signal processing system can be provided at a low cost like the prior system.

Furthermore, the sampling frequency for the teacher signal is not always set to twice the requirements sampling frequency, and it is possible to use the sampling frequency which is twice or more integer times of the requirements sampling frequency. In general, if the sampling frequency for the teacher signal is multiplied by k (k: an integer being 2 or more), the recurrent neural network is made to have a 1 input and k output structure (one output unit+k−1 additional output units). Still further, the multiple of the sampling frequency is not necessarily limited to integers, if using the teacher signal sampling frequency which can satisfy the relation of the teacher signal sampling frequency>the requirements sampling frequency, the desirable output waveform information can be increased, so that the same effects are obtainable.

Figure 26:
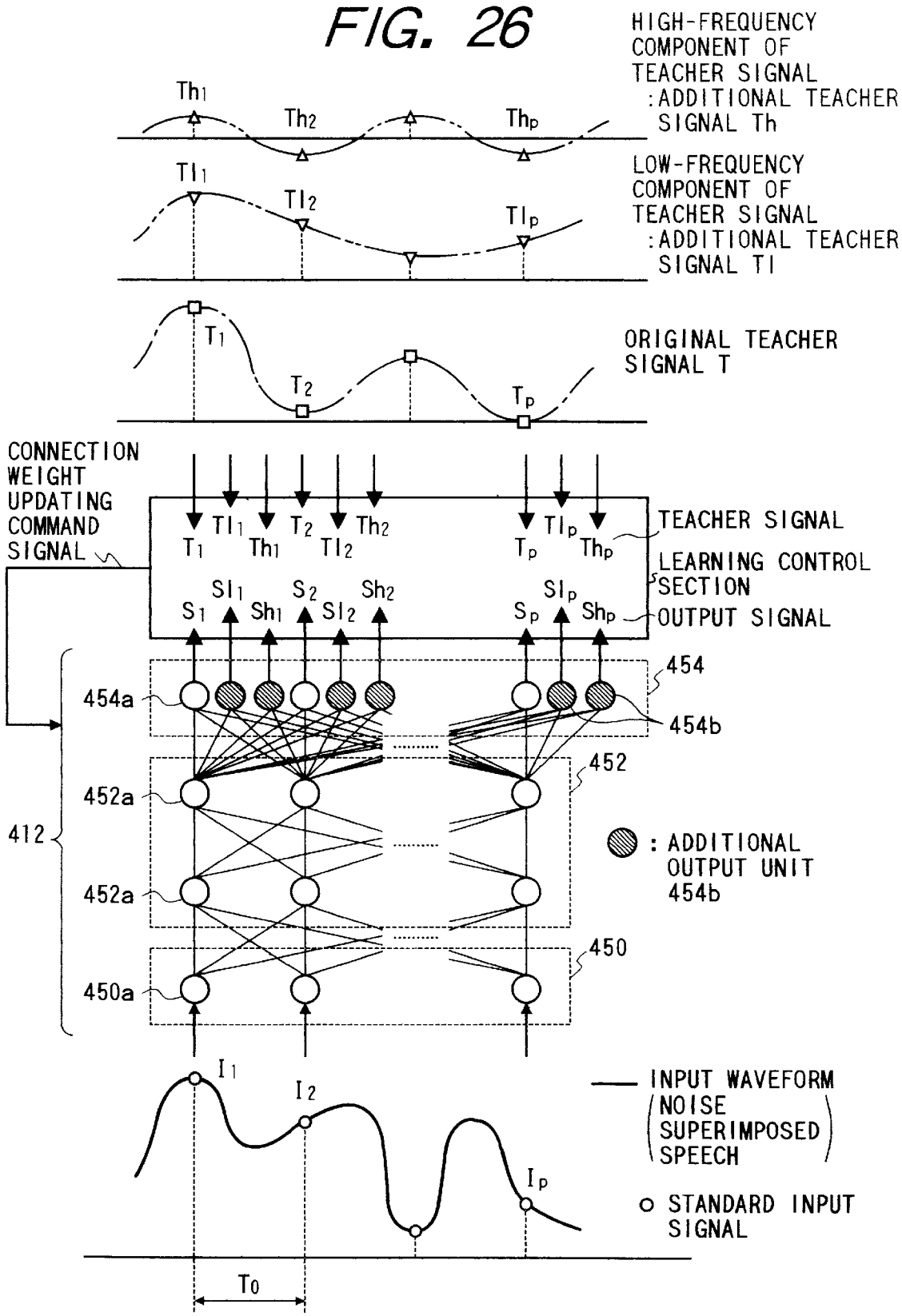
FIG. 26 is an explanatory illustration of a functional arrangement of a layered neural network model based on a band division method according to an eleventh embodiment of this invention.
Figure 27:
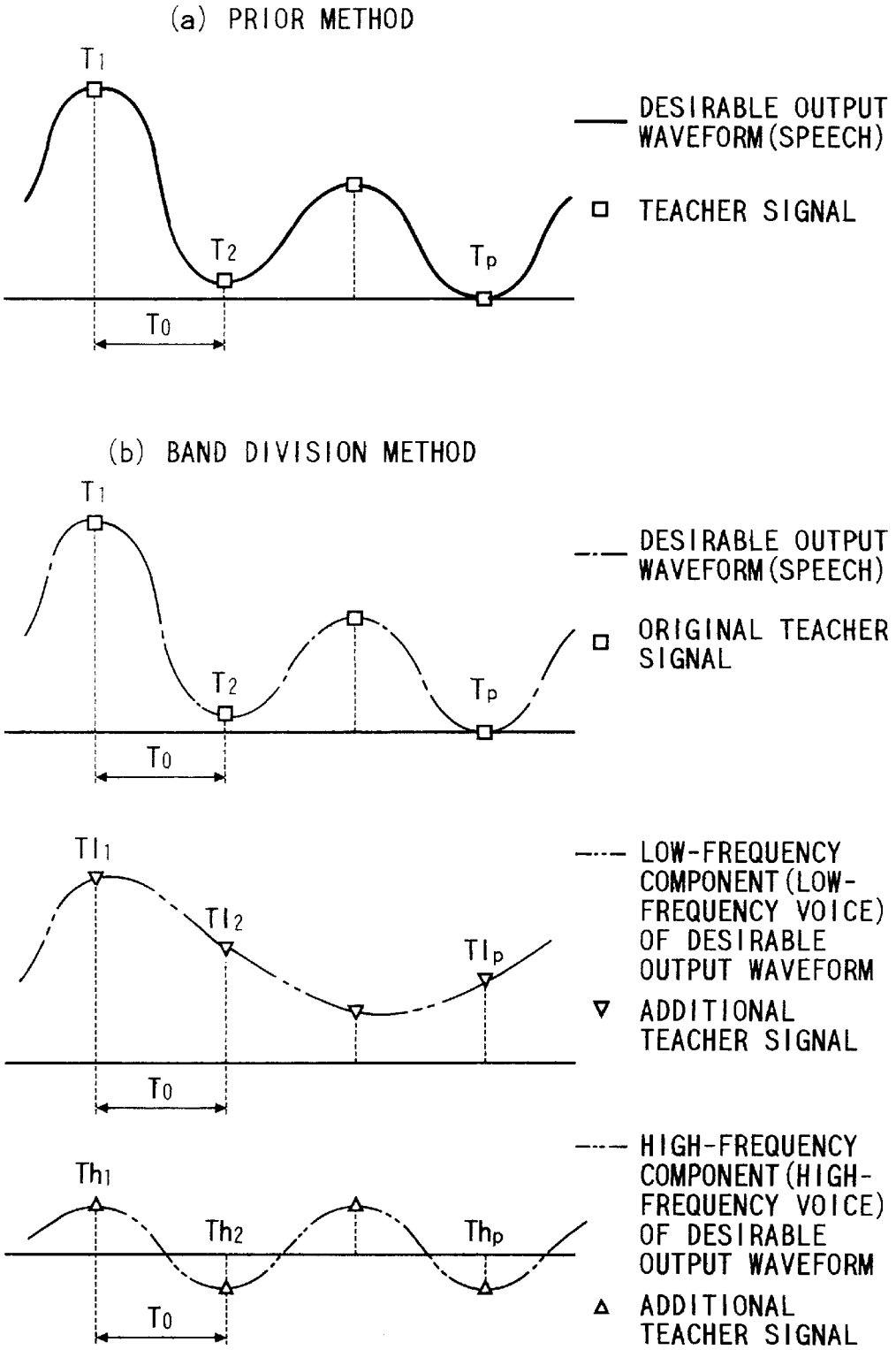
FIG. 27 is an illustration of waveforms of a teacher signal and an additional teacher signal in the eleventh embodiment.

A description will be made hereinbelow of a signal processing system according to an eleventh embodiment of this invention. This eleventh embodiment relates to a noise removal signal processing system using a band division method and the basic arrangement thereof is the same as that of the ninth embodiment. The difference from the ninth embodiment is that as shown in FIG. 26 a layered neural network model 412 is, at a learning mode, equipped with additional output units 454*b* whose number is twice the number of the additional output units 254*b* in the ninth embodiment. In the signal processing system according to the eleventh embodiment, in the learning mode the connection weights of the layered neural network model 412 are adjusted so that the layered neural network model 412 learns the input and output characteristic to extract an aural signal from an inputted noise superimposed aural signal. As well as the ninth embodiment, a standard pattern storage section stores A/D-converted aural signals to be used as learning data. Each of the standard patterns is composed of a combination of a standard input signal and a teacher signal, and the standard input signal is obtained by sampling a noise superimposed speech with a given time length at the sampling frequency f0, while as shown in FIG. 27 the teacher signal comprises an original or primary teacher signal obtained in a such manner that a speech included in the standard input signal is sampled at the sampling frequency f0, a low-frequency component additional teacher signal of two signals obtained by dividing the sampled signal into two bands, and a high-frequency component additional teacher signal being the other signal obtained by the division of the sampled signal. The cutoff frequency for the division into the low frequency and the high frequency is se to, for example 2 kHz. In addition to the original teacher signal, the two divided additional teacher signals are wholly referred to as teacher signals.

When the number of sampled values constituting the teacher signal in the prior method shown in FIG. 38 is taken as P, the number of sampled values organizing the teacher signal due to the band division method according to the eleventh embodiment is 3P. When the sampled value of the standard input signal is taken to be I, the sampled value of the original teacher signal is taken as T and the additional teacher signals respectively corresponding to the low-frequency component and high frequency component thereof are taken to be Tl and Th, the standard pattern due to the band division method is expressed by the standard input signals $I_1, I_2, I_3, \ldots, I_p$, and the teacher signals $T_1$, $T1_1$, $Th_1$, $T_2$, $Th_2$, $T_3$, $T1_3$, $Th_3$, . . . , $T_p$, $Tl_p$, $Th_p$ (3P sampled values). On the other hand, the standard pattern due to the prior method is expressed by the standard input signals $I_1, I_2, I_3, \ldots, I_p$, and the teacher signals $T_1, T_2, T_3, \ldots, T_p$ (P sampled values).

As shown in FIG. 26, the layered neural network model 412 comprises three layers: an input layer 450, an intermediate layer 452, and an output layer 454. The number of input units 450*a* in the input layer 450 is P, whereas the number of output units 454*a* in the output layer 454 is P and the number of additional output units 454*b* in the same output layer 454 is 2P (3P in total).

Because of the addition of the additional teacher signals Tl, Th, the number of output units 454*a* and 454*b* in the output layer 454 increases by 2P corresponding to the additional output units 454*b* as compared with the output layer 2003 in FIG. 38. If not particularly specified, the ordinary output units 454*a* and the additional output units 454*b* are wholly referred to as output units. The number intermediate units 452*a* in the intermediate layer 452 is appropriately determined.

At the learning, the standard input signal I is inputted so that the connection weights are updated to make the coincidence between the output signals S, Sl, Sh and the teacher signals T, Tl, Th. That is, as well as the ninth embodiment, when the number of the standard patterns is taken as M, a learning control and comparison section successively takes the M standard patterns and supplies the P standard input signals I of each of the standard pattern to the input units 450*a* of the layered neural network model 412. At this time, the layered neural network model 412 learns so that the output units 454*a* and the additional output units 454*b* outputs the corresponding teacher signals T, Tl, Th and the same output signals S, Sl, Sh. Further, This learning is conducted on the basis of the M standard patterns and is repeated until all the output signals S, Sl, Sh coincide with the teacher signals T, Tl, Th. With the above operation, the layered neural network model 412 gains a mapping to suppress the noise in the input signal and to selectively extract and output only an aural signal. Because of unnecessary after the completion of the learning, the additional output units 454*b* and connections thereto are removed, with the result that the number of output units decreases from 3P to 3.

Figure 28:
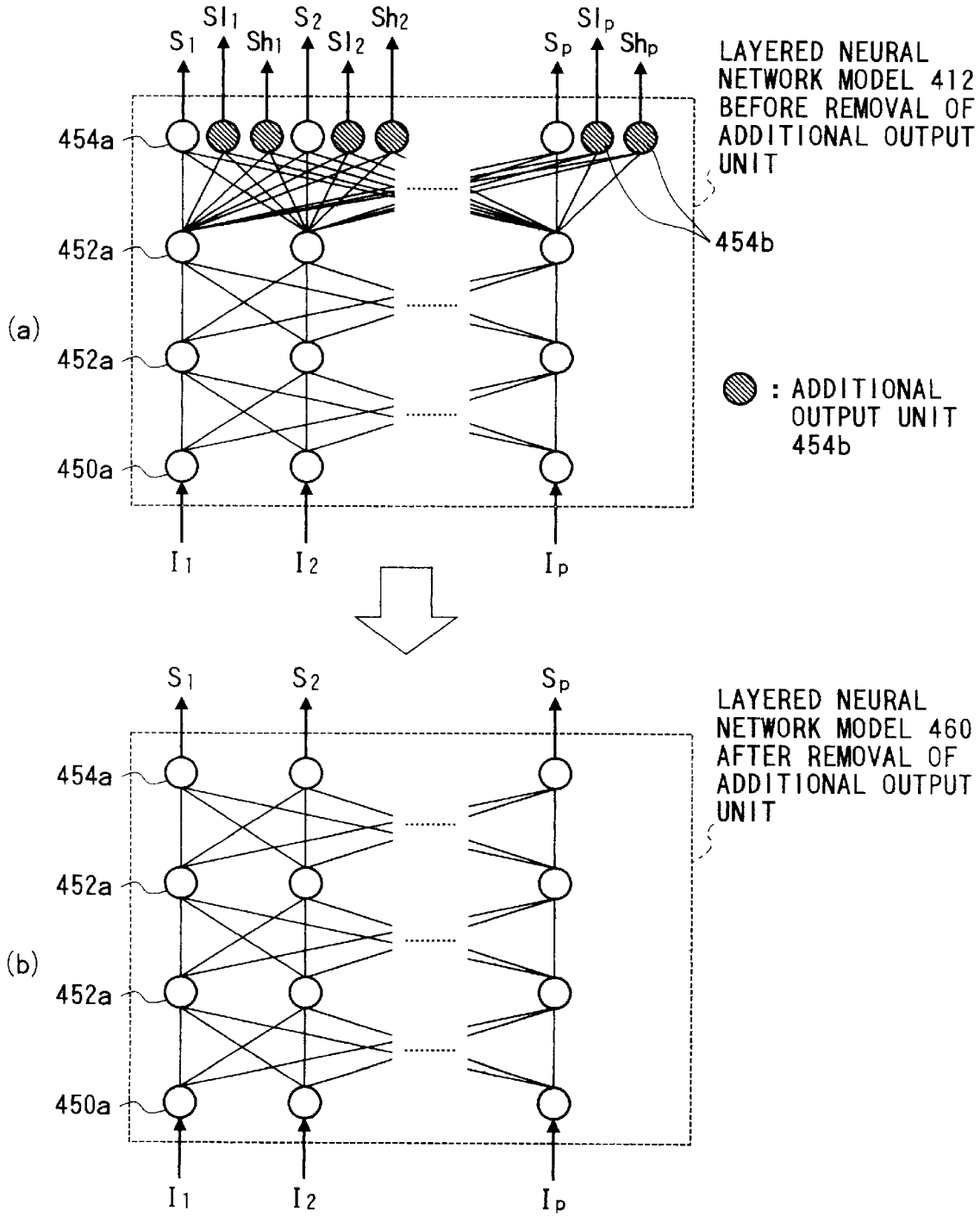
FIG. 28 is an illustration useful for describing an arrangement of a layered neural network model before the removal of an additional output unit (at a learning mode) and after the removal (at an execution mode) in the eleventh embodiment.

Accordingly, when shifting to the execution mode, as shown in FIG. 28 the layered neural network model 412 (indicated by (a)) in the learning mode turns to a layered neural network model 460 (indicated by (b)) with a P input and P output structure. That is, at this time, the layered neural network model 460 has the same arrangement as the layered neural network model 260 in the execution mode in the ninth embodiment and the layered neural network model 2000 as shown in FIG. 38 except for the connection weights between the units 450*a,* 452*a* and 454*a*. Further, in the execution mode, as well as the ninth embodiment, the layered neural network model 460 fixes the connection weights between the units 450*a,* 452*a* and 454*a* obtained in the learning mode. Through the switching operations of change-over switches, an input speech and an environmental noise are taken by a microphone which in turn, output them as an analog input signal. The discrete processing of this analog input signal is conducted at the sampling frequency f0 in an A/D converter which in turn, output it as a digital input signal. This digital input signal is inputted into an input buffer which in turn, at the time of being accumulated to P signals, outputs a buffered input signal to the layered neural network model 460. The layered neural network model 460 extracts only an aural signal from the buffered input signal and outputs P buffered output signals through its P output units 454*a* to an output buffer. The output buffer sends, as a digital output signal, the P aural signals one by one in order to a D/A converter which in turn, converts them into an analog output signal at the aural signal sampling frequency f0, with the analog output signal being outputted as an outputted speech from a speaker.

In the signal processing system according to this eleventh embodiment, as well as the ninth embodiment, in the execution mode after the learning the change-over switches, the learning control section, the comparison section and the standard pattern storage section which are necessary for the learning can also be removed to have a voice filer dedicated arrangement.

Figure 29:
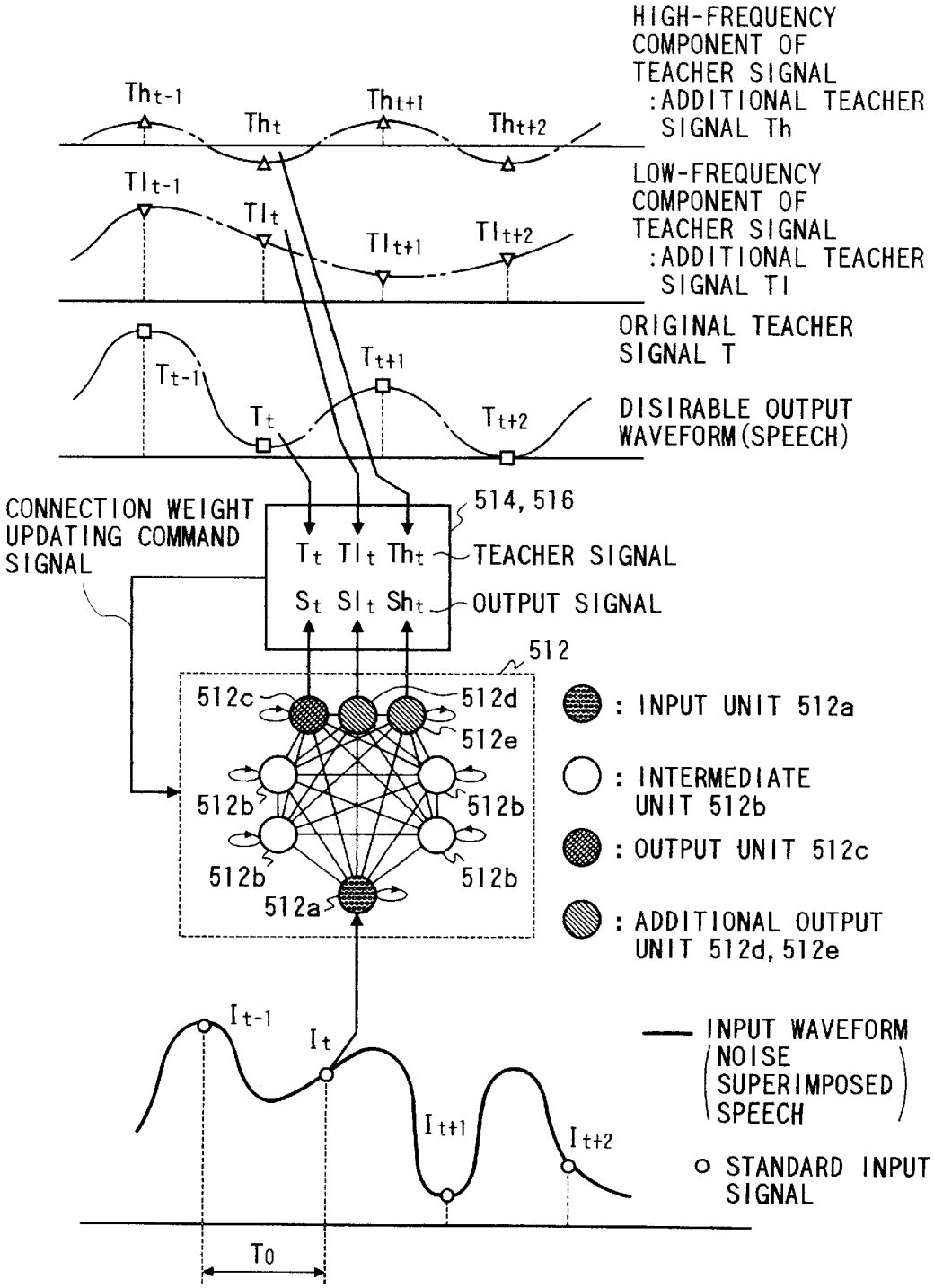
FIG. 29 is an explanatory illustration of a functional arrangement of a recurrent neural network based on a band division method according to a twelfth embodiment of this invention.

As described above, in the case of the signal processing system based upon the band division method according to this eleventh embodiment, in terms of the layered neural network outputting and inputting a time series signal, as the teacher signals given at the learning, in addition to the original teacher signals the low-frequency components and high-frequency components of the additional teacher signals produced by the band division are further given as teacher signals. Thus, the information with the desirable output waveform is increased to facilitate the learning of the layered neural network model 412. As a result, even the high-frequency component of the output of the layered neural network model 460 more accurately follows the high-frequency component of the desirable output waveform. particularly, since the neural network model is of the layered type, after the completion of the learning the additional output units 454*b* and the connections thereto can be removed so that the model has the same arrangement of that of the prior layered neural network model 2000. This means that the calculation amount and memory using amount of the layered neural network model 460 are made to be the same as those of the prior layered neural network model 2000. Accordingly, as compared with the prior art, there is no disadvantage in the processing speed and the manufacturing cost, but it is possible to realize a signal processing system with a higher performance. Moreover, the band of the teacher signal is not always required to be divided into the low frequency and the high frequency, but can arbitrarily be divided into two or more bands or can be narrowed down to any one of the low frequency and the high frequency. In general, if the number of bands is multiplied by k (k: an integer being 1 or more), the layered neural network model is made to have P inputs (k+1)×P outputs (P output units+k×P additional units). After the completion of the learning, the k×P additional output units and the connections thereto can be removed so that the layered neural network model has a P input and P output structure. Moreover, a description will be made hereinbelow of a signal processing system according to a twelfth embodiment of this invention. The twelfth embodiment relates to a noise removal signal processing system using a recurrent neural network based on a band division method, and its basic arrangement has the same arrangement as that in the tenth embodiment shown in FIG. 24. The difference from the tenth embodiment is that as shown in FIG. 29 a recurrent neural network 512 is equipped with two additional output units 512*d,* 512*e* to be used in the learning mode (in the tenth embodiment, one additional output unit 312*d*). A learning method based on the band division method for the recurrent neural network 512 will be described hereinbelow with reference to FIG. 29. As well as the eleventh embodiment, in addition to an original teacher signal T, a low-frequency component additional teacher signal Tl produced by the band division of the teacher signal and a high-frequency component additional teacher signal Th produced by the same band division are used as teacher signals.

As well as the eleventh embodiment, a standard input signal is produced in such a manner that a noise superimposed speech is sampled at the requirements sampling frequency f0 (sampling period T0) and an original teacher signal T is created by sampling the speech included in the standard input signal at the sampling frequency f0 (sampling period T0). Further, the low-frequency component and high-frequency component of the original teacher signal T are used as additional teacher signals Tl and Th. When the number of the standard patterns in the standard pattern storage section is taken as M, a learning control section 514 and a comparison section 516 perform the following operations on each of the M patterns. In this case, when the number of sampled values constituting the standard input signal I is L, the number of sampled values constituting the teacher signal T is tripled, that is, assumes 3×L.

Furthermore, at time t=1, 2, . . . , L, the standard input signal is expressed with $I_t$, the original teacher signal is expressed with $T_t$, the low-frequency component additional teacher signal is expressed by $Tl_t$ and the high-frequency component additional teacher signal is expressed by $Th_t$. In the learning mode, the learning control section 514 supplies the standard input signals $I_t$ in the order of t=1, 2, . . . , L to one input unit 512*a* of the recurrent neural network 512, while the comparison section 516 obtains output signals $S_t$, $Sl_t$, $Sh_t$ from three output units 512*c,* 512*d,* 512*e* of the recurrent neural network 512 to compare them with the teacher signals $T_t$, $Tl_t$, $Th_t$. On the basis of the comparison results, the learning control section 514 outputs a connection weight updating command signal to the recurrent neural network 512. In the recurrent neural network 512, the connection weights are renewed in accordance with the connection weight updating command signal. The learning control section 514 and the comparison section 516 repeatedly perform the above-mentioned operations until the output signals $S_t$, $Sl_t$, $Sh_t$ coincide with $T_t$, $Tl_t$, $Th_t$.

After the completion of the learning mode, the connection weights of the 1 input and 3 output recurrent neural network 512 made in the learning mode are fixed to be used in the execution mode. In the execution mode, the outputs of the additional output units 512*d,* 512*e* are not fed to the external.

In the execution mode, as well as the tenth embodiment, the input and output of the recurrent neural network 512 are switched to the external input and output through the use of change-over switches. Accordingly, the actual inputted speech and an environmental noise are taken by a microphone and supplied as an analog input signal therefrom to an A/D converter. The A/D converter performs the discrete processing of the analog input signal at the requirements sampling frequency f0 and outputs the resultant digital input signal to the input unit 512*a* of the recurrent neural network 512. The recurrent neural network 512 extracts only the aural signal from the digital input signal and successively outputs a digital output signal through its output unit 512*c* to a D/A converter. The D/A converter D/A-converts the digital output signal at the requirements sampling frequency f0 to produce an analog output signal, with this analog output signal being outputted as an outputted speech from a speaker.

As described above, according to the twelfth embodiment, in addition to the original teacher signal T the additional teacher signal Tl being a low-frequency component of the original teacher signal T produced by the band division and the additional teacher signal Th being a high-frequency component of the original teacher signal T by the same band division are given as teacher signals to the recurrent neural network 512. Thus, the desirable output waveform information is increased to facilitate the learning of the recurrent neural network 512. Moreover, even the high-frequency component included in the output of the recurrent neural network 512 more accurately follows the high-frequency component of the desirable output waveform. In this case, because of the use of the recurrent neural network, unlike the case of the layered neural network model, the additional output units 512*d,* 512*e* and the connections thereto can not be removed after the completion of the learning without condition. However, in the case of employing an arrangement in which the additional output units 512*d,* 512*e* do not send signals to the other units 512*a,* 512*b,* 512*c,* The removal of the additional output units 512*d,* 512*e* is possible.

Even if the additional output units 512*d,* 512*e* and the connections thereto are unremovable at the execution mode, the input unit 512*a* can be one in number, and hence, if taking the obtained effects into consideration, there is no great disadvantage in memory and calculation amount based the weight connections. In addition, if using employing a structure where the additional output units 512*d,* 512*e* do not send signals to the other units 512*a,* 512*b,* 512*c,* the additional output units 512*d,* 512*e* and the connections thereto are removable, and therefore, as well as the eleventh embodiment the additional output units 512*d,* 512*e* and the connections thereto can be removed after the completion of the learning so that at the execution mode the arrangement is similar to that of the prior neural network model except the connection weights. Accordingly, the calculation amount and memory using amount at the execution are the same as those in the prior system. The learning becomes easier and the waveform follow-up characteristic is improved even for the high frequency component, nevertheless the signal processing system can be provided at a low cost as well as the prior system.

The number of bands of the teacher signals is not necessarily limited to two, and the use two or more bands is practicable. Further, it is also possible that the band of the teacher signal is set to any one of the low frequency and the high frequency. In general, when the number of bands is taken as k (k: an integer being 1 or more), the recurrent neural network is made to have 1 input and (k+1) output (one output unit+k additional output units) structure.

Still further, a description will be made hereinbelow of a thirteenth embodiment of this invention. Although the signal processing systems based upon the high sampling frequency method or the band division method according to the above-described ninth embodiment to twelfth embodiment are used for the purpose of the noise suppression, they can additionally be used for the band extension of a speech, for example, the tone quality improvement of a synthetic voice. This is possible in such a manner as to make the neural network model learn to output a speech with a higher tone quality when a synthetic voice is inputted therein. The thirteenth embodiment relates to a band extension method.

Figure 30:
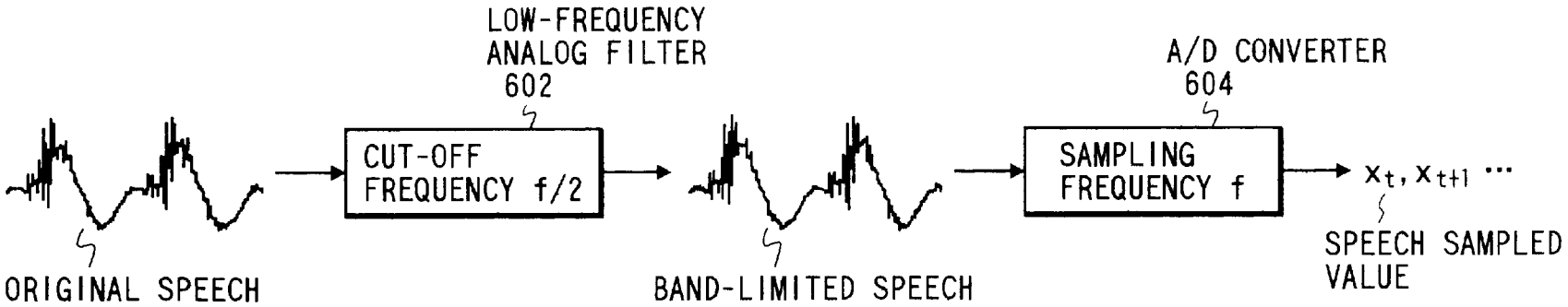
FIG. 30 is an illustration useful for describing a band extension method according to a thirteenth embodiment of this invention.

FIG. 30 shows a procedure to A/D-convert a speech to produce digital speech sampled values. In this case, the sampling frequency is set to fHz. In the case that the sampling frequency is fHz, the speech to be A/D-converted is required not to include a higher frequency component than f/2 Hz (if included, the sampling becomes difficult). In order to satisfy this condition, the original speech is converted into a band-limited speech through a low-frequency analog filter 602 with a cut-off frequency of f/2 Hz and subsequently converted through an A/D converter 604 into speech sampled values. The band extension signifies that a frequency component above f/2 Hz is estimated on the basis of the aural signals sampled at one sampling frequency fHz so that the aural signal is converted into an aural signal due to a higher sampling frequency f' satisfying f'>f. According to this thirteenth embodiment, there is provided a band extension system 606 which improves the sense of hearing by producing a higher quality speech in such a manner that a high-frequency component is added to a telephone voice band-limited to 0 to 4 kHz.

Figure 31A:
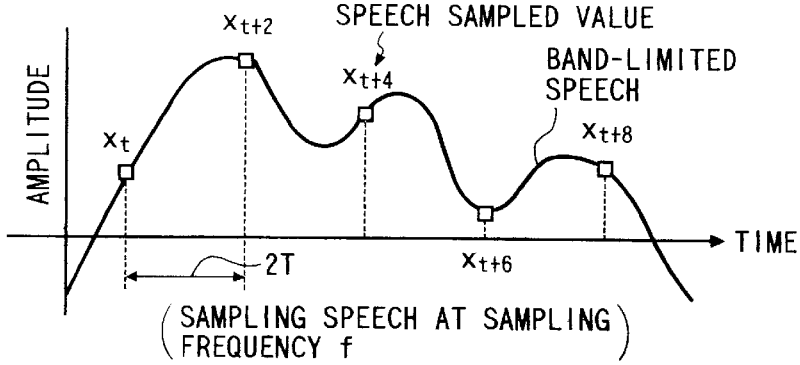
FIGS. 31A to 31D are illustrations useful for describing a speech sampling and an additional teacher signal production in the thirteenth embodiment.
Figure 31B:
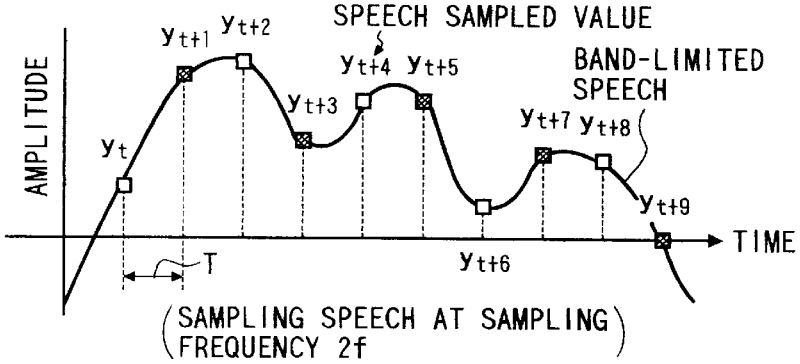

FIG. 31A shows an example of sampling the same original speech at the sampling frequency fHz, and FIG. 31B is an example of sampling it at the sampling frequency 2 fHz. During unit time, the number of sampled values in the example shown in FIG. 31B is twice the number of sampled values in the example shown in FIG. 31A. Further, the band-limited speech in the FIG. 31A example includes a component with a frequency of 0 to f/2 Hz while the band-limited speech in the FIG. 31B example includes a component with a frequency of 0 to fHz. Accordingly, both the waveforms differ from each other. Although on the time axis the sampled value $x_{t+i}$ corresponds to the sampled value $y_{t+i}$, the values do not always coincide with each other. The band extension is considered as being a problem to estimate time series signals $y_t$, $y_{t+1}$, $y_{t+2}$, $y_{t+3}$, $y_{t+5}$ . . . from time series signals $x_t$, $x_{t+2}$, $x_{t+4}$ . . . In this problem, the sampling frequency f0 required as the output of the band extension system 606 is 2f.

Figure 31C:
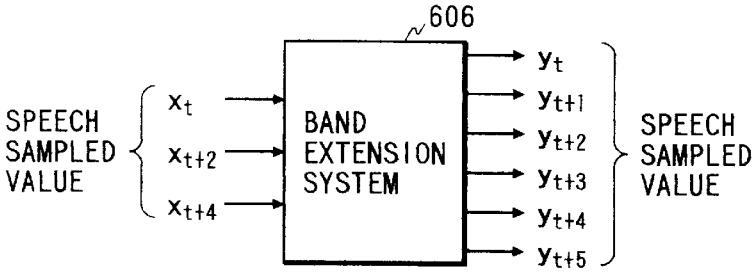
Figure 43:
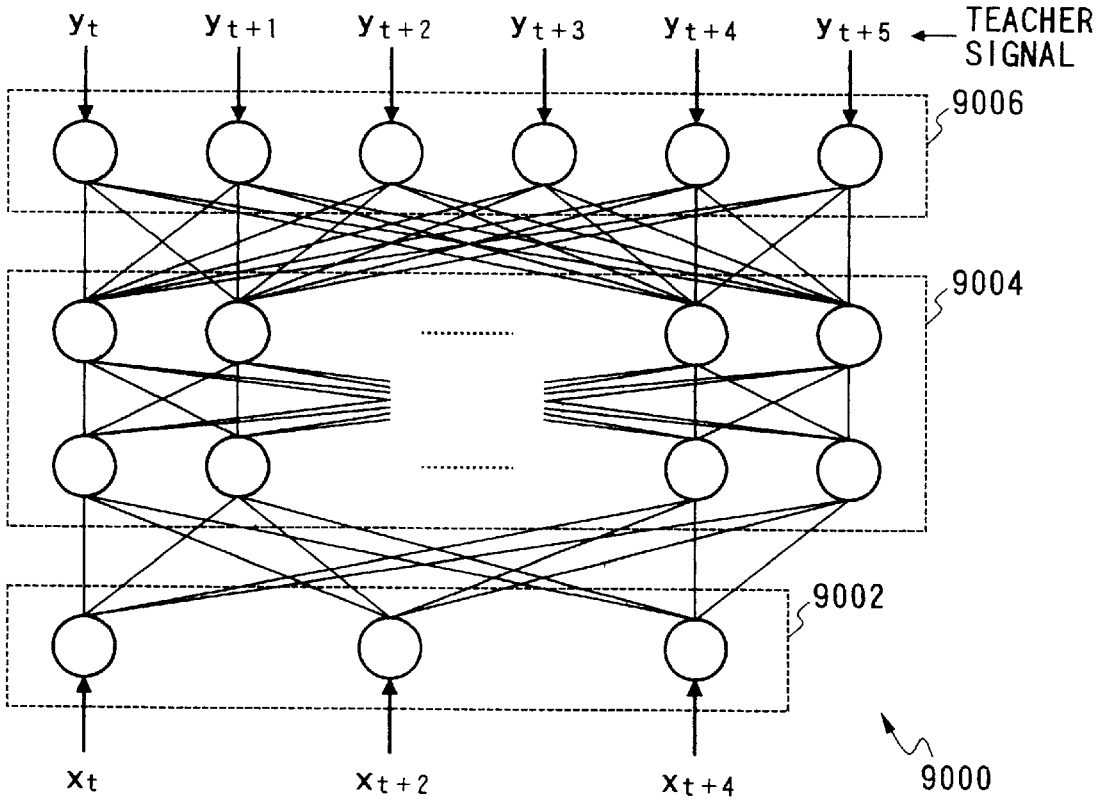
FIG. 43 PRIOR ART
FIG. 43 is an explanatory illustration of an arrangement of a layered neural network model based on a prior band extension.

FIG. 31C is an illustration of an example of the band extension system 606. This band extension system 606 receives three speech sampled values due to the sampling frequency fHz and outputs six speech sampled values due to the sampling frequency 2 fHz. FIG. 43 shows a prior example in which a band extension function is realized in a manner that a layered neural network model learns. A layered neural network model 9000 of the prior example has three input units in an input layer 9002 and 6 output units in an output layer 9006 and learns in a manner that the speech sampled values due to a sampling frequency 2 fHz are used as teacher signals.

Figure 31D:
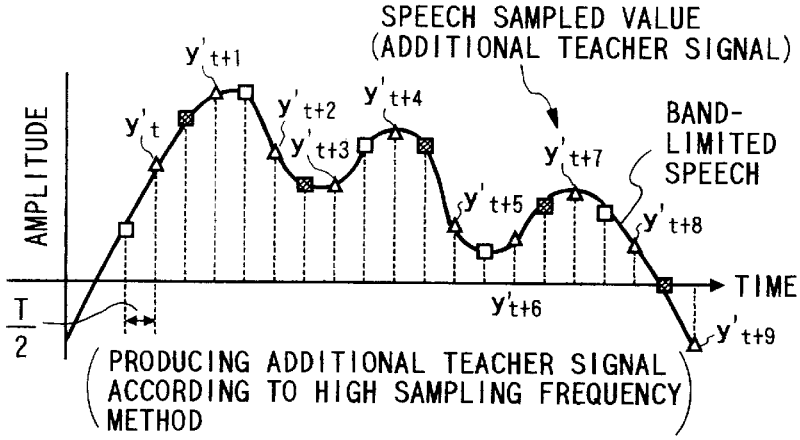
Figure 32:
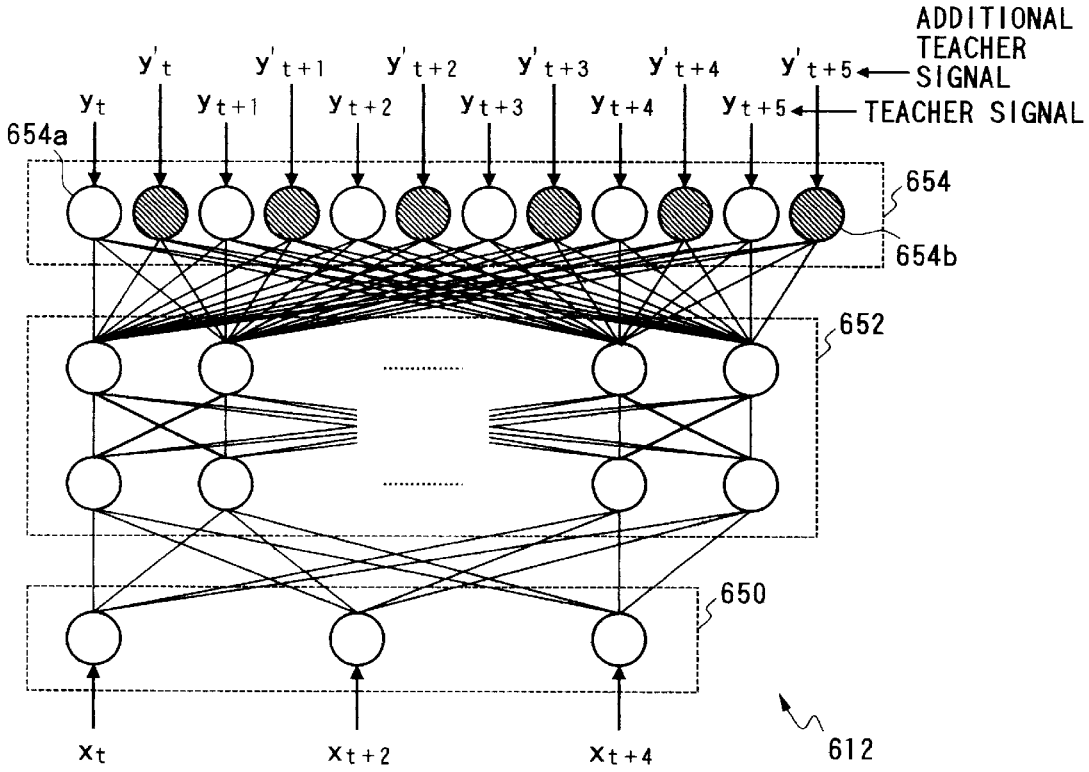
FIG. 32 is an explanatory illustration of a layered neural network model in the thirteenth embodiment.

FIG. 32 shows an example of making the band extension system 606 learn through the use of a layered neural network mode 612 in the thirteenth embodiment. The layered neural network model 612 is designed such that the number of output units in an output layer 654, i.e., the number of output units 654*a* plus the number of additional output units 654*b*, comes to 12, and sampled values obtained by sampling a band aural signal at a sampling frequency 2f0 being twice the requirements sampling frequency f0 are given as the teacher signals $y_t$, $y_{t+1}$, . . . and the additional teacher signals $y'_t$, $y'_{t+1}$, . . . That is, the sampled values indicated with triangular marks are added as shown in FIG. 31D. The number of units in an input layer 650 and the number of units in an intermediate layer 652 are the same as those of an input layer 9002 and an intermediate layer 9004 in the prior example.

After the completion of the learning, the additional output units 654*b* corresponding to the additional teacher signals are removed so that the layered neural network model 612 is used for the band extension system 606. If this band extension system 606 is incorporated into a telephone apparatus, it is possible to add a high-frequency component above 4 kHz to a telephone voice band-limited to 0 to 4 kHz, with the result that a reception speech with a high quality is obtainable irrespective of the band limitation of the speech to be received. Incidentally, although in FIGS. 31C and 31D the layered neural network model has a 3 input and 6 output structure, the numbers of the input and output data are not limited to this.

Although in the above-mentioned embodiments in the execution mode the layered neural network model and the recurrent neural network are incorporated into the signal processing systems from the start and the switching operation between the learning mode and the execution mode is made through the change-over switches, it is also appropriate that the learning is accomplished through a learning unit in the learning mode so that the layered neural network model or the recurrent neural network is completed as a signal processing filter and the signal processing filter is retained and built in the signal processing system when necessary.

Moreover, it is also appropriate that, after the completion of the layered neural network model or the recurrent neural network in the learning mode, the structure of the units and the connection weights are recorded as mere data and using these data the learning-completed layered neural network model or recurrent neural network is realized on a ROM or a backup RAM as the layered neural network model or recurrent neural network for the execution mode and incorporated into the signal processing system when necessary.

Figure 34A:
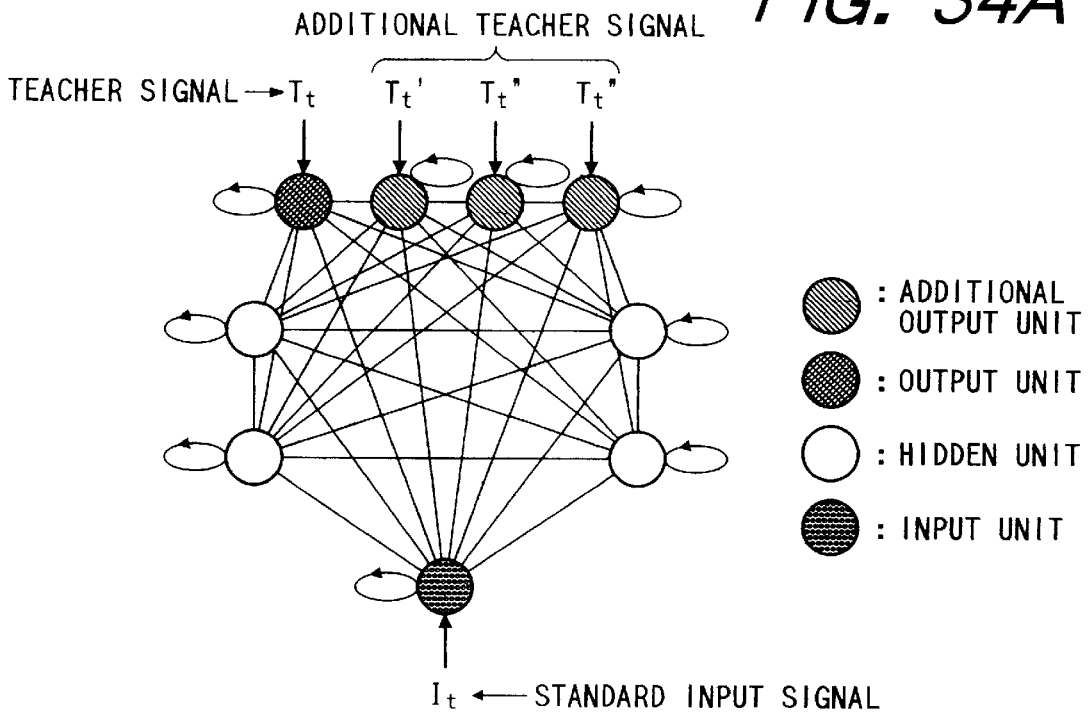
FIGS. 34A and 34B are illustrations useful for describing arrangements of the recurrent neural networks of the embodiments used for the experiments.
Figure 34B:
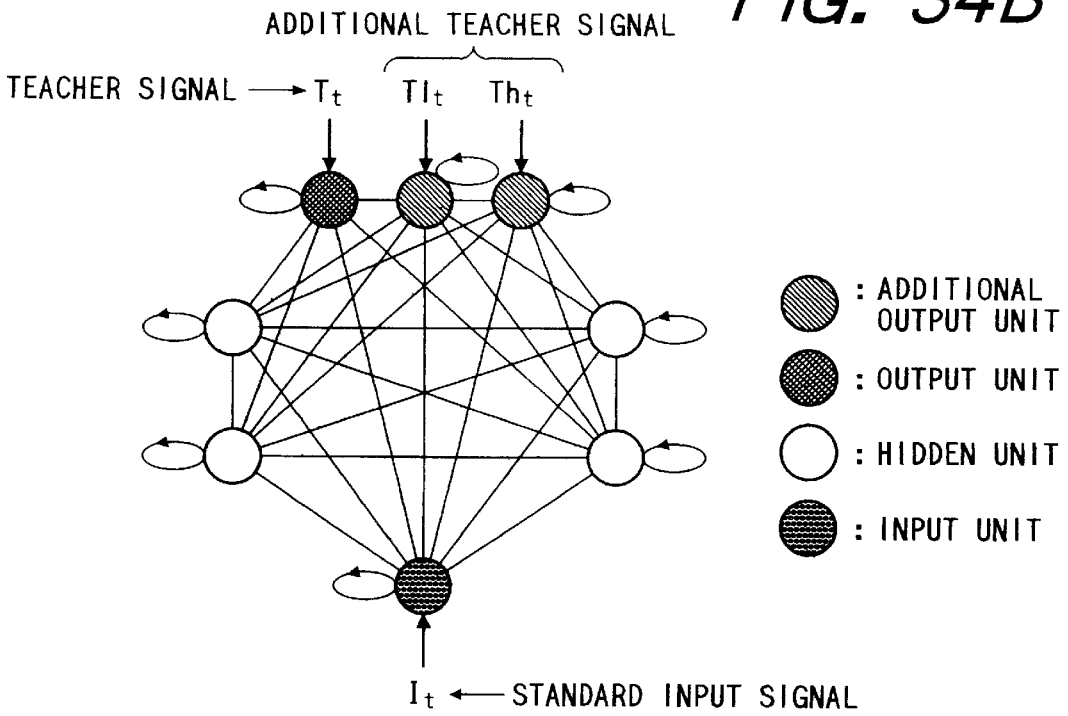

Comparative experiments between the prior art and the Embodiments of the Invention For the demonstration of the effects of the embodiments of this invention, comparative experiments were made among (1) signal processing systems based upon the prior art methods using the recurrent neural networks as shown in FIGS. 41 and 42, (2) a signal processing system based on the high sampling frequency method using the recurrent neural network as shown in FIG. 34A, and a signal processing system based upon the band division method using the recurrent neural network as shown in FIG. 34B. The comparison was made by checking the number of times of learning successes on the condition that the signal processing systems of (1), (2) and (3) learned the following example.

Example

Figure 33A:
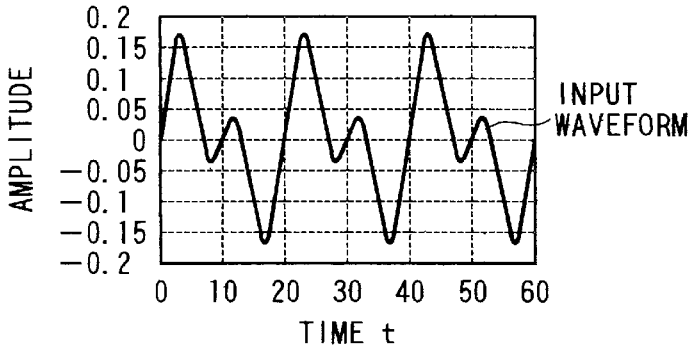
FIGS. 33A to 33D are illustrations of experiment results showing the performances in the embodiments.
Figure 33B:
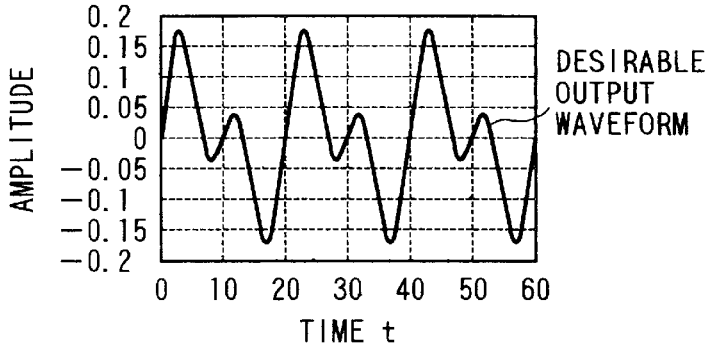
Figure 33C:
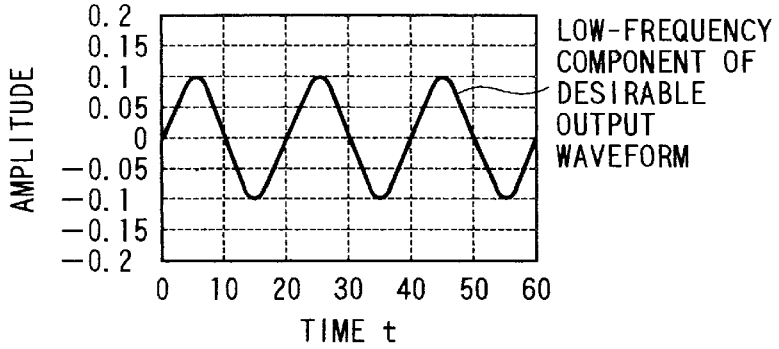
Figure 33D:
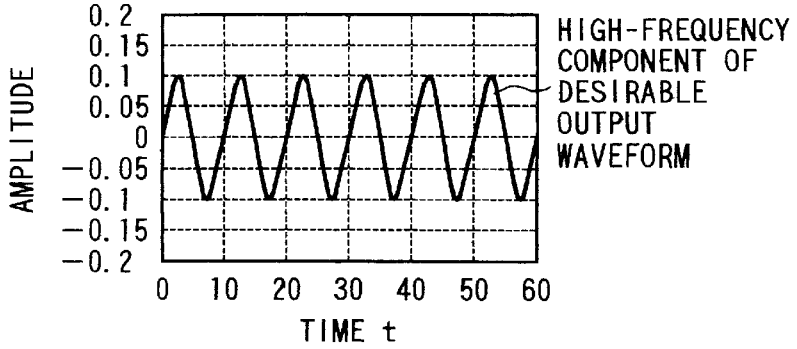

A waveform produced by the synthesis of two sine waveforms as indicated by the following equation is inputted and directly outputted. FIG. 33A shows the inputted waveform and FIG. 33B shows the desirable output waveform.

Inputted Waveform :I(t)=sinl(t)+sinh(t)

Desirable Output Waveform : T(t)=I(t)

where sin1(t)=0.1 sin (2 pt/20)

sinh(t)=0.1 sin (4 pt/20)

The difference among the (1), (2) and (3) signal processing systems depends upon the giving way of the teacher signals as described below. The standard input signal is the same. The standard input signal It is given by the following equation. The standard input signal It assumes one period or cycle at every 20 steps, that is, It=It+20.

Standard Input Signal : It=I(t) t=0, 1, 2, 3, . . .

(1) Prior Method

In the prior method, the teacher signal Tt was given so that the standard input signal It was directly reproduced as indicated by the following equation. At a given time t, Tt=It is satisfied. The used recurrent neural network has one input unit and one output unit as shown in FIGS. 41 and 42. The structure on the intermediate units is not always the same as that in FIG. 41 or 42.

Teacher Signal : Tt=T(t)

(2) Embodiment Using High Sampling Frequency Method

In the high sampling frequency method, the sampling frequency for the teacher signal was increased to four times and the teacher signals were given as indicated by the following equations with respect to the standard input signal It. The used recurrent neural network has one input unit and four output units as shown in FIG. 34A. The structure on the intermediate units is not always the same as that in FIG. 34A.

| | |
|---|---|
| Teacher Signal | Tt = T(t) |
| Addtional Teacher Signal | Tt' = T(t+0.25) |
| | Tt" = T(t+0.5) |
| | Tt''' = T(t+0.75) |

(3) Embodiment Using Band Division Method

In the band division method, a teacher signal Tt directly reproducing the standard input signal It, a low-frequency component Tlt of the teacher signal Tt and a high frequency component Tht thereof were given as teacher signals in relation to the standard input signal It as indicated by the following equations. The used recurrent neural network has one input unit and three output units as shown in FIG. 34B. The structure on the intermediate units is not always the same as that in FIG. 34B.

Teacher Signal : Tt=T(t)

Additional Teacher Signal : Tit=sinl(t)

: Tht=sinh(t)

In this comparative experiment, the (1), (2) and (3) signal processing systems were respectively used and the learning was made five times for the recurrent neural networks each having 10 to 14 units in total in a manner that the initial value was charged. When the output of the recurrent neural network showed the reproduction more than 80% of the low frequency portion sinl(t) and the high frequency portion sinh(t), the learning was considered as being succeeded. The learning time was 10 minutes for each trial.

Results of Experiment

The following table 9 shows the results of the experiment. In the case of (1) (prior method), although 25 trials were conducted, the learning succeeded only once. On the other hand, in the case of (2) and (3) (high sampling frequency method and the band division method), the number of times of success increased, and particularly (3) method is superior. This table shows that this invention allows easy learning. In addition, when one of a number of recurrent neural networks attained was actually applied, a sufficient performance was obtained as shown in FIG. 35B.

TABLE 9

| | Number of Times of Learning Success | | | | |
|---|---|---|---|---|---|
| | Number of Units | | | | |
| Method | 10 | 11 | 12 | 13 | 14 |
| (1) | 0 | 0 | 1 | 0 | 0 |
| (2) | 1 | 0 | 1 | 2 | 1 |
| (3) | 2 | 5 | 5 | 3 | 4 |

Figure 35A:
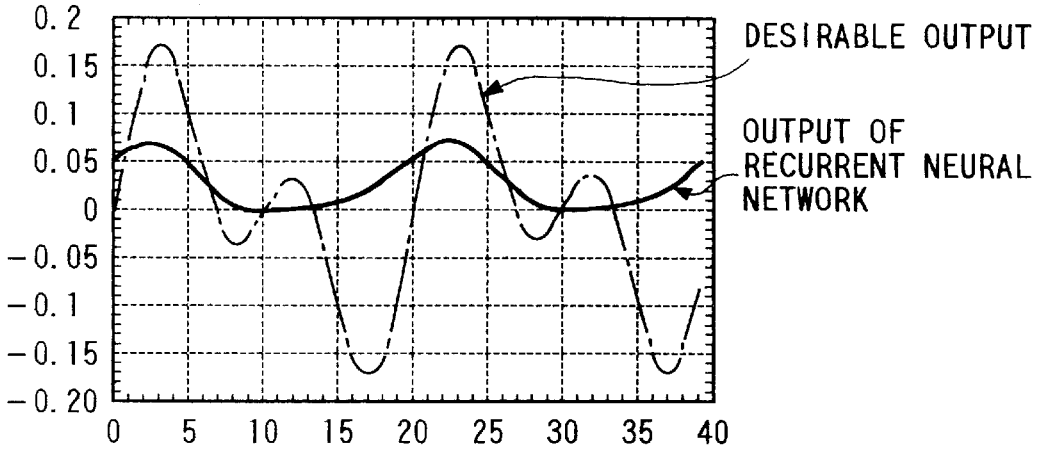
FIGS. 35A and 35B are illustrations for describing the experiment results showing the performance of the embodiments.
Figure 35B:
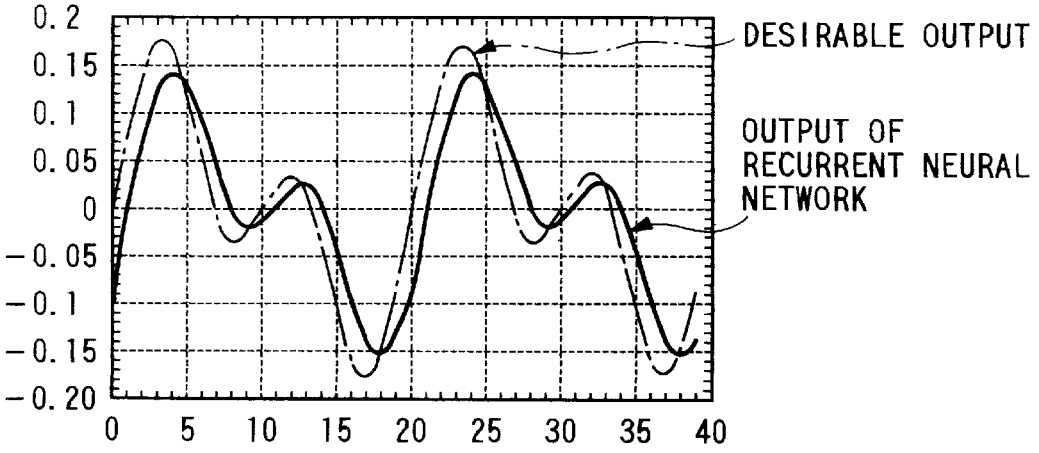
Figure 36:
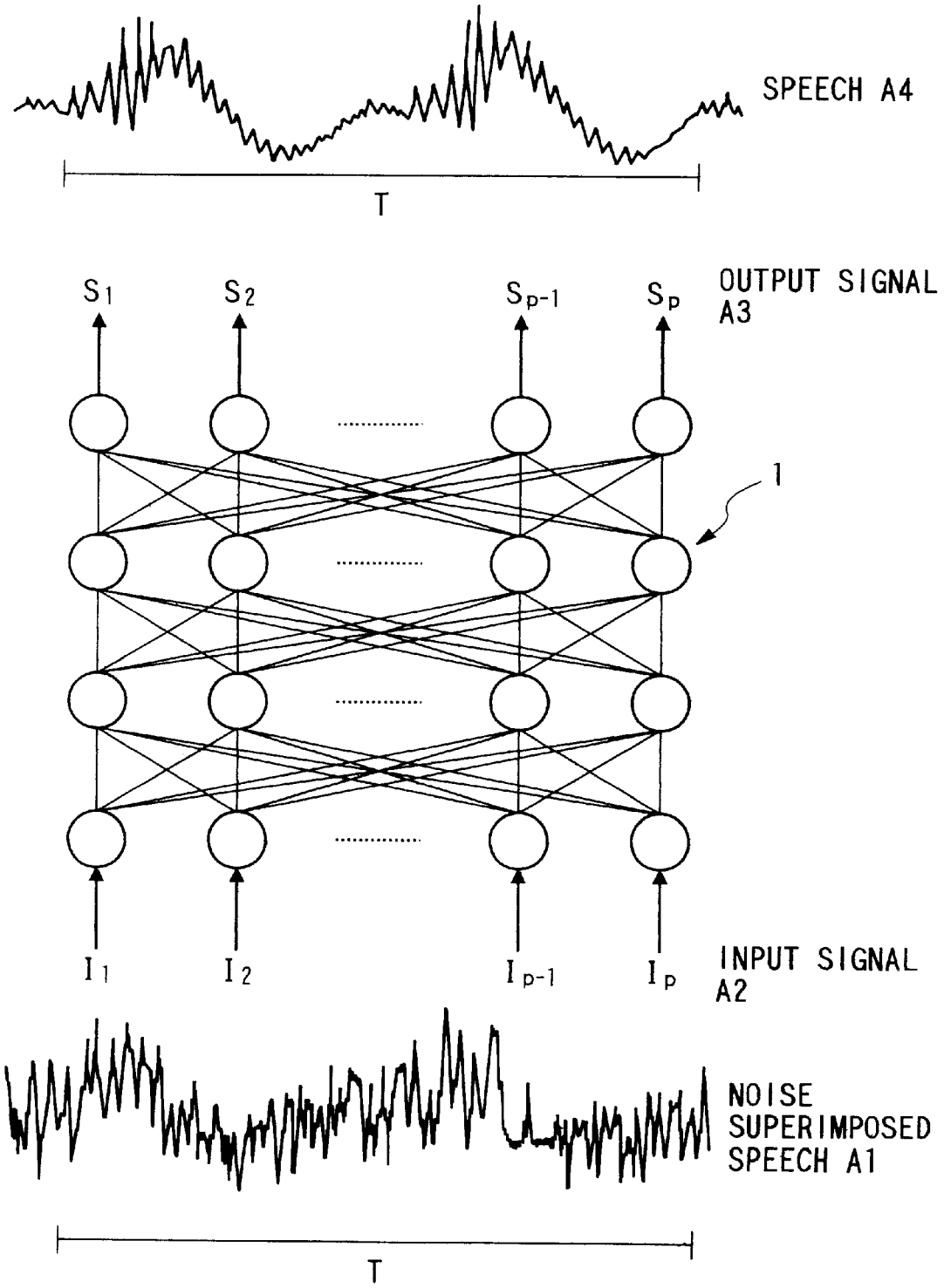
FIG. 36 PRIOR ART
FIG. 36 is an illustration of a prior speech restoration system.
Figure 37A:
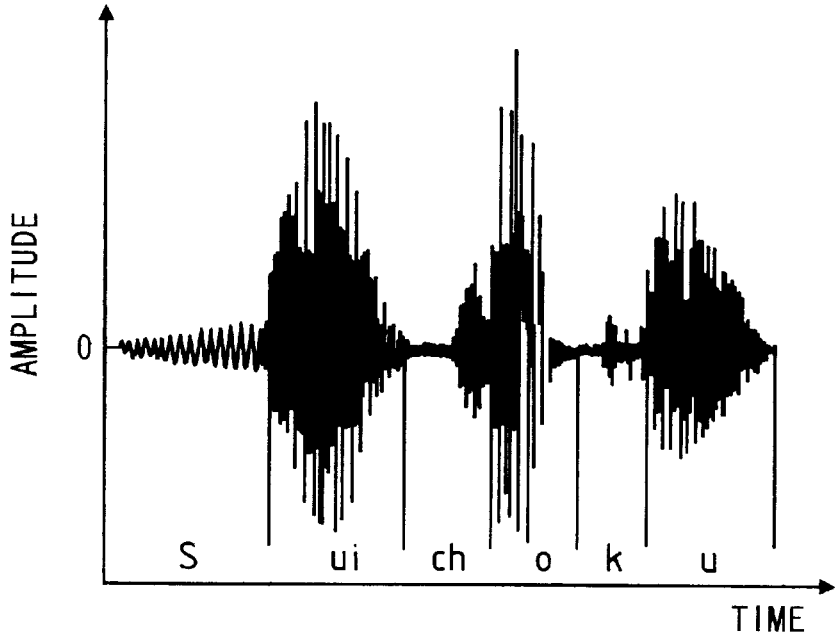
FIG. 37A PRIOR ART
FIGS. 37A and 37B are illustrations of an original speech and a corresponding voice estimation value in the prior art.
Figure 37B:
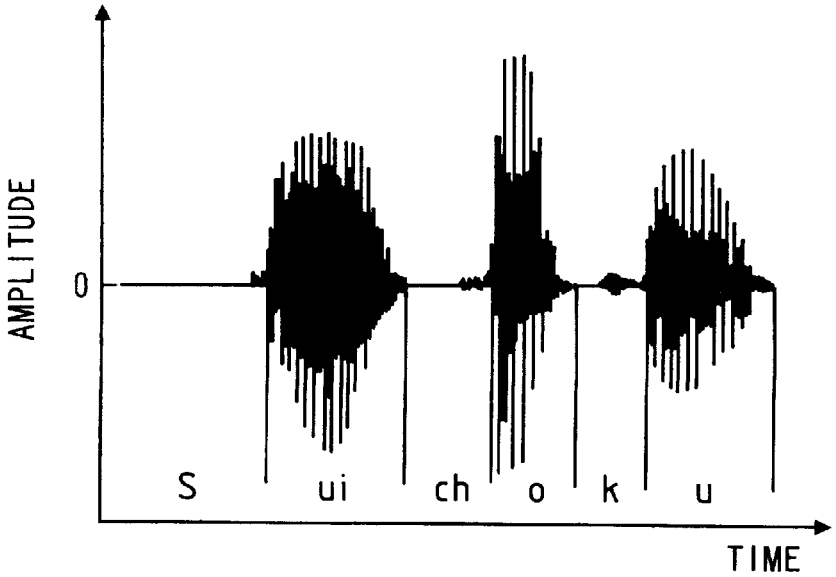
FIG. 37B PRIOR ART

FIGS. 35A and 35B show the output results of the recurrent neural networks in the case that the recurrent neural networks each having 10 units and the same initial value experienced the learning according to the prior method and the band division method in the embodiment of this invention. In the case of the prior method, as shown in FIG. 35A the output of the recurrent neural network does not follow the desirable output. On the other hand, in the case of the band division method of the embodiment, as shown in FIG. 35B the output of the recurrent neural network substantially accurately follows the desirable output. Thus, the (2) and (3) methods according to the embodiments of this invention show excellent effects.

It should be understood that the foregoing relates to only preferred embodiments of the present invention, and that it is intended to cover all changes and modifications of the embodiments of the invention herein used for the purposes of the disclosure, which do not constitute departures from the spirit and scope of the invention.

What is claimed is:

1. A signal extraction system comprising:

a recurrent neural network for receiving an input signal including a first signal component and a second signal component and extracting said first signal component and said second signal component, said recurrent neural network including:

an input unit for receiving the input signal;

a first output unit coupled to said input unit for extracting and outputting the first signal component; and a second output unit coupled to said input unit and said first output unit for extracting and outputting the second signal component.

2. A system as defined in claim 1, the input signal being a waveform signal in a time domain, and the first signal component and the second signal component each being outputted as a waveform signal in a time domain.

3. A system as defined in claim 1, the input signal being a waveform signal in a time domain divided through a plurality of filter groups into a plurality of bands and the first signal component and the second signal component each being outputted as one of (A) a waveform signal in a time domain which is not divided into a plurality of bands and (B) a waveform signal in a time domain divided into said plurality of bands.

4. A system as defined in claim 1, the input signal being a Fourier spectrum produced by a Fourier transform of a waveform signal in a time domain and the first signal component and the second signal component each being outputted as a Fourier spectrum.

5. A system as defined in claim 1, the input signal being wavelet conversion data produced through a wavelet conversion of a waveform signal in a time domain and the first signal component and the second signal component each being outputted as wavelet conversion data.

6. A system as defined in claim 1, the input signal being a waveform signal in a time domain, and the first signal component and the second signal component each being outputted as a Fourier spectrum.

7. A system as defined in claim 1, the input signal being a Fourier spectrum produced by a Fourier transform of a waveform signal in a time domain and the first signal component and the second signal component each being outputted as a waveform signal in a time domain.

8. A system as defined in claim 1, the input signal being wavelet conversion data obtained by a wavelet conversion of a waveform signal in a time domain and the first signal component and the second signal component each being outputted as a waveform signal in a time domain.

* * * * *